US006540327B1

(12) United States Patent
Akiyama et al.

(10) Patent No.: US 6,540,327 B1
(45) **Date of Patent: *Apr. 1, 2003**

(54) RECORDING HEAD CAPABLE OF DISCHARGING A PLURALITY OF A INK HAVING DIFFERENT DESITIES AND INK JET RECORDING METHOD AND INK JET RECORDING APPARATUS WHICH USE SUCH A RECORDING HEAD

(75) Inventors: Yuji Akiyama, Yokohama (JP); Hiromitsu Hirabayashi, Yokohama (JP); Toshio Kashino, Chigasaki (JP); Hitoshi Sugimoto, Kawasaki (JP); Miyuki Matsubara, Tokyo (JP); Fumihiro Gotoh, Kawasaki (JP); Hidehiko Kanda, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/892,067

(22) Filed: Jul. 14, 1997

Related U.S. Application Data

(63) Continuation of application No. 08/191,296, filed on Feb. 3, 1994, now abandoned.

(30) Foreign Application Priority Data

Feb. 5, 1993 (JP) ..... 5-018662
Apr. 28, 1993 (JP) ..... 5-102756

(51) Int. Cl.[7] ..... B41J 2/21; B41J 2/05

(52) U.S. Cl. ..... 347/43; 347/65

(58) Field of Search ..... 347/15, 41, 40, 347/43

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |

(List continued on next page.)

FOREIGN PATENT DOCUMENTS

| | | | | |
|---|---|---|---|---|
| EP | 0150119 | * | 7/1985 | ..... B41J/3/04 |
| EP | 0532302 | | 3/1993 | |
| JP | 54056847 | | 5/1979 | |
| JP | 55113573 | | 9/1980 | |
| JP | 58065666 | | 4/1983 | |
| JP | 58194541 | | 11/1983 | |

(List continued on next page.)

OTHER PUBLICATIONS

Gonzalez, Rafael C., Digital image processing, Addison–Wesley Publishing Company, Inc., pp. 221–249, 701–702, 1992.*

Takahashi, et al., "Full–Color Ink–Jet Printer", *N.E.C. Research & Development*, No. 1, pp. 38–40, Jan. 1986.

*Primary Examiner*—Thinh Nguyen
(74) *Attorney, Agent, or Firm*—Fitzpatrick, Cella, Harper & Scinto

(57) ABSTRACT

An ink jet recording apparatus uses a recording head having discharge ports to discharge ink, and records by discharging ink from the recording head while enabling said recording head to travel in the direction of main scan. This apparatus comprises a recording head which is provided integrally with a plurality of recording units having a plurality of discharge port arrays for discharging ink of different colors, respectively, and then, the plurality of recording units are arranged in the direction of main scan to discharge ink of different densities, respectively. With the structure thus arranged, the recording in all the colors is not executed at a time thus making it possible to obtain an excellent image with a lesser deterioration of image due to ink blur and the like.

19 Claims, 51 Drawing Sheets

U.S. PATENT DOCUMENTS

| | | | | | |
|---|---|---|---|---|---|
| 4,463,359 | A | | 7/1984 | Ayata et al. | |
| 4,528,576 | A | * | 7/1985 | Koumura et al. | 347/15 |
| 4,558,333 | A | | 12/1985 | Sugitani et al. | |
| 4,608,577 | A | | 8/1986 | Hori | |
| 4,635,078 | A | * | 1/1987 | Sakurada et al. | 347/15 |
| 4,686,538 | A | | 8/1987 | Kouzato | |
| 4,723,129 | A | | 2/1988 | Endo et al. | |
| 4,740,796 | A | | 4/1988 | Endo et al. | |
| 4,748,453 | A | | 5/1988 | Lin et al. | |
| 4,750,009 | A | * | 6/1988 | Yoshimura | 347/43 |
| 4,855,753 | A | | 8/1989 | Ichikawa et al. | |
| 4,952,942 | A | * | 8/1990 | Kanome et al. | 347/15 |
| 4,967,203 | A | | 10/1990 | Doan et al. | |
| 4,967,204 | A | * | 10/1990 | Terasawa et al. | 347/23 |
| 4,999,646 | A | * | 3/1991 | Trask | 347/43 X |
| 5,355,159 | A | * | 10/1994 | Kaneko | 347/3 |

FOREIGN PATENT DOCUMENTS

| | | | | |
|---|---|---|---|---|
| JP | 59123670 | | 7/1984 | |
| JP | 59138461 | | 8/1984 | |
| JP | 60071260 | | 4/1985 | |
| JP | 60107975 | | 6/1985 | |
| JP | 63295270 | | 12/1988 | |
| JP | 1-281945 | * | 11/1989 | B41J/3/04 |
| JP | 3-189167 | * | 8/1991 | B41J/2/21 |
| JP | 3-272862 | * | 12/1991 | 347/43 |

* cited by examiner

CROSS PATTERN

COUNTER-CROSS PATTERN

RECORDING HEAD CAPABLE OF DISCHARGING A PLURALITY OF A INK HAVING DIFFERENT DESITIES AND INK JET RECORDING METHOD AND INK JET RECORDING APPARATUS WHICH USE SUCH A RECORDING HEAD

This application is a continuation of application Ser. No. 08/191,296, filed Feb. 3, 1994, now abandoned.

BACKGROUND OF THE INVENTION

1. Field of the Invention

The present invention relates to an ink jet recording head and the recording by an ink jet recording apparatus. More particularly, the invention relates to the ink jet recording head which uses ink having different densities for the same color series for recording images.

2. Related Background Art

With the wide use of an information processing apparatus, such as a copying machine, a word processor, a computer, and also, of communication equipment, an apparatus which digitally records images by use of a recording head of an ink jet method has rapidly become popular as one of the image formation apparatuses (hereinafter referred to as recording apparatus) serving as information output means for these equipment. For a recording apparatus of the kind, it is generally practiced that the so-called multinozzle head, in which a plurality of ink discharge ports, liquid passages conductively connected to these ports, and others are integrated, is used as a recording element in order to improve the recording speed.

As a recording method of the kind, there is adopted for controlling a recording in an intermediate tone, a dot density control method with which to produce such an intermediate tone by controlling the number of recording dots per unit area by the application of the recording dots of a specific size, or a dot diameter control method with which to produce such an intermediate tone by controlling the sizes of the recording dots.

Here, the latter method which controls the dot diameters requires a complicated control to be carried out for the fine modification of the sizes of the recording dots, hence automatically restrict its implementation. In general, therefore, the former method which controls the dot densities is adopted.

The electro-thermal energy transducing elements, which make a high resolution possible, are used because of the ease with which to prepare the elements in a high density, but it is also difficult to control the amount of pressure variation, thus disabling the diameters of the recording dots to be modulated. For recording, therefore, the method for controlling dot density is adopted.

As one of the typical binarization methods for the intermediate tonal representation used for the dot density control method, an organizational design method may be employed. This method, however, has a problem that the number of gradations is limited by the matrix size. In other words, to increase the number of gradations, it is necessary to make the matrix size larger. If the matrix size is made larger, there is a problem encountered, among others, that one pixel of a recorded image consisting of one matrix becomes greater, thus spoiling the resolution. Also, there is a design method of a conditionally determining type, such as an error diffusion method as another typical type of binarization method. Whereas the aforesaid organizational design method is of an independently determining type for binarization using a threshold value which is not related to any input pixels, this type of method varies the threshold value in consideration of the surrounding pixels of an inputted pixel. The design method of a conditionally determining type which is represented by the error diffusion method has an excellent compatibility of tonality and resolution. Also, when an original image is a printed image, the creation of the moire pattern on the recording image is extremely small among other advantages, but, on the other hand, the graininess of the bright part of the image tends to become conspicuous, and a problem is encountered that the evaluation of the image quality is lowered. This problem is particularly conspicuous in a recording apparatus having a low recording density.

Therefore, in order to make the above-mentioned graininess less conspicuous, there is proposed a method for a conventional ink jet recording apparatus that the two recording heads, which discharge ink having a low density of a recorded image, and ink having a high density thereof, respectively, are provided so that the recording dots are formed with ink having a low density (light ink) for the bright part to the intermediate tonal part of an image, and also formed with ink having a high density (dark ink) for the intermediate tonal part to the dark part of the image.

FIG. 1 is a perspective view showing the principal part of a conventional color ink jet recording apparatus of a serial printing type which uses dark and light ink according to the above-mentioned recording method.

On a carriage 241, there are respectively arranged at a given distance, a recording head Kk which discharges black dark ink; a recording head Ku, black light ink; a recording head Ck which discharges cyan dark ink; a recording head Cu, cyan light ink; a recording head Mk which discharges magenta dark ink; a recording head Mu, magenta light ink; and a recording head Yk which discharges dark yellow ink; a recording head Yu, yellow light ink. The carriage 241 is slidably supported by a guide shaft 243 to be guided to reciprocate along the above-mentioned guide shaft 243 by the driving force of a carriage motor 245 transmitted through a driving belt 244.

In the liquid passages each conductively connected to the respective ink discharge port of each recording head, the heat generating elements (electro-thermal transducers) are arranged to generate the thermal energy used for discharging ink.

The ink used by each of the recording heads is retained in each of the ink cartridges 248 provided for the respective colors, and is supplied through each of the ink supply passages. Also, the control signals and driving signals are transmitted from an apparatus controller to the recording heads through a flexible cable 249.

A recording material such a recording sheet or a plastic thin sheet is conveyed in the direction indicated by arrows in FIG. 1 by means of a feed roller (not shown) and exhaust sheet rollers 242 when a feed motor (not shown) is driven. During this period, a recording is being executed on the surface of the recording material facing the recording heads along the traveling of each of the heads. In other words, in accordance with the reading timing of an encoder (not shown) which detects the traveling positions of the carriage 241, the above-mentioned heat generating elements are driven on the basis of the recording signals to discharge each of the ink, black dark and light, cyan dark and light, magenta dark and light, and yellow dark and light, on the recording material in that order, thus enabling them to adhere thereto for recording images on the material.

In the home position defined outside the recording area in the carriage 241 travels, a recovery unit 246 is arranged with a capping unit 247. With the recovery process by this recovery unit, the ink discharge characteristics are stabilized for each of the recording heads.

The conventional ink jet recording apparatus which uses the dark and light ink as described with reference to FIG. 1 can solve the problem of the graininess of the recorded image comparatively well, and presents one of effective techniques in improving the quality of recorded image. However, there are roughly three problems still to be solved as described below.

1) Firstly, the conventional ink jet recording apparatus which uses the dark and light ink is at first provided with a recording head and an ink cartridge per ink to be used. Consequently, the number of recording heads and ink cartridges is increased, inevitably bringing about a larger size of the apparatus.

Also, the weight of the recording heads and the carriage is increased. At the same time, the distance required for the ramp up and down becomes long when the carriage travels, thus resulting likewise in the larger size of the apparatus. Also, due to.the increased weight, the load required to drive the carriage is increased, necessitating the provision of a driving motor having a greater torque. There is also a need for a complicated mechanism to maintain the capping performance of many numbers of the caps arranged in response to the number of the recording heads, hence increasing the cost accordingly.

Further, as the number of recording heads is increased, it is necessary to register the recording head for each color in a severer precision. Thus expensive parts having a higher precision must be used. Also, the adjustment of complicated positioning and the correction control must be effectuated.

In addition, if the difference between the dot densities is great for the dark and light ink when a recording is made by use of the dark and light ink, the reproduction of the gradation is not linear in the part where the light ink and the dark ink are switched over in a recorded image, and a false contour tends to appear. Also, a problem is encountered that the variations of the graininess and tonality take place in the above-mentioned part where the ink is switched over in the recorded image, thus creating an unnatural image after all. In order to solve this particular problem, a method is adopted to provide more degrees of the densities by use of a low density ink, medium density ink, and high density ink, among others, but it is clear that this method will just promote the above-mentioned problems concerning the size of the apparatus.

2) Secondly, when ink of different densities is used for each of the plural color ink for recording in color, there is a problem that it is not easy to eliminate the unevenness and others in a recorded image due to the order in which each of color ink is superposed, and the order in which each of the same color ink but of different densities is superposed, respectively.

As a conventional technique to eliminate the above-mentioned unevenness and others, it is known that the same technique as to eliminate the uneven densities is applied. This will be described as follows:

In a color printer, for example, it is necessary for recording images to take into account various conditions, such as coloring ability, tonality, uniformity unlike a character printer and others which record only characters. Particularly, as to the uniformity, just a slight variation per nozzle created in the process of fabricating a multinozzle head produces adverse effects on the amount of discharged ink and the direction of discharges per discharge port in recording, resulting in the density unevenness in a recorded image to cause its quality to be degraded.

In conjunction with FIGS. 2A to 3C, the specific examples will be described.

In FIG. 2A, a reference numeral 91 designates the so-called multinozzle head. For simplification, the head is assumed to be structured with eight discharge ports 92 to discharge only one kind of ink having a single color and a single density. A reference numeral 93 designates ink droplets discharged from each of the discharge ports 92. As shown in FIG. 2A, it is ideal that the ink droplets 93 are discharged in the same amount and direction. Then, if the discharges are executed like this, the dots of the same size are recorded on a recording sheet as shown in FIG. 2B, thus making it possible to obtain an over all image uniformly without any density unevenness (see FIG. 2C).

In practice, however, there is often unevenness per discharge port as described earlier, and as shown in FIG. 3A, the amount and direction of ink droplets discharged from each discharge port are varied. Thus, as shown in FIG. 3B, the sizes of the recorded dots become uneven and its impacted positions vary. As a result, there exists a blank part in which the area factor is not satisfied 100% along the main scan direction of the recording head or on the contrary, the dots are superposed more than necessary, or as shown in the central part of FIG. 3B, a white streak is created. In this case, the density distribution is as shown in FIG. 3C. This condition is recognized as a density unevenness after all as far as observed by usual human eyes.

3) Thirdly, when the amount of sheet feeding which is repeated per recording scan is not controlled constantly, it also results in the same kind of density unevenness and others. For example, if the sheet is fed more than a specific amount, the dots in each of the end portions of the scanning area are recorded in the positions which are further apart than a regulated distance. This portion becomes conspicuous as a white streak. On the contrary, if the sheet is fed less than a specific amount, the dots in each of the end portions are superposed more than necessary to make such a portion conspicuous as a black streak. The higher the pixel density, the severer control is needed for the amount of this sheet feeding. If this is not satisfactorily controlled, it is inevitable that joining streaks are created on a recorded image.

In order to prevent the above-mentioned density unevennesses and streaks from being created, the following proposal has been made:

With reference to FIGS. 4A to 5C, such proposed method will be described. As shown in FIGS. 4A to 5C, it is necessary to scan the recording head 91 three times according to this method for the completion of a recording in an area shown in FIGS. 2A to 3C. However, in a half of such an area, that is, an area equivalent to a half of the discharge port region of the recording head, can be completely recorded by scanning the recording head two times. In other words, in this case, the eight discharge ports of the recording head are divided into two groups each four upper discharge ports and four lower discharge ports. For the first scan, the lower four discharge ports are used to record the dots of four pixel arrays, respectively, and then, after feeding the sheet for a portion of four discharge ports, the dots are recorded by the second scan by use of the upper four discharge ports on the portion where no dots of the above-mentioned four pixel arrays are recorded. At this juncture, in each of the second time scans, the dots which should be recorded by the second scan are thinned by approximately a half. Thus the dots to be recorded by each scan are in a complementary relationship. Hereinafter, a recording method such as this is called "divided recording method".

With a divided recording method, a recorded image is as shown in FIG. 4B because even when using a recording head whose discharge characteristics vary per discharge port as shown in FIGS. 3A to 3C, its unfavorable effect to the recorded image per discharge port is, reduced by half, hence making the black streak and white streak as shown in FIG. 3B less conspicuous. Therefore, compared to the density unevenness shown in FIG. 3C, there is also a considerable improvement in it as shown in FIG. 4C. Also, the joint streaks appearing at the boundaries between each of the scanning areas can be reduced by half if the divided recording method is applied because the dots on one pixel array are recorded by the discharge ports on the end portion of the recording head and those on the central portion of it.

When such a recording is executed, the image data are divided so that the dots are offset with each other (complementally) in accordance with certain arrays in the first and second scans. Usually, however, this division of the image data (hereinafter, may also be referred to as "thinned patterns") is most often such as shown in FIGS. 5A to 5C so that the dots can be arranged in a cross pattern per pixel vertically and horizontally. Therefore, in a unit recording area (here, a unit of four pixels), a recording is completed by the first scan which records the cross pattern and the second scan which records the counter-cross pattern.

FIGS. 5A, 5B, and 5C are views illustrating the process in which a recording in a specific area is completed by use of the cross and counter-cross patterns, respectively. At first, in the first scan, the dots 51 are recorded to form the cross pattern by use of the lower four nozzles (FIG. 5A). Then, in the second scan, the dots 52 are recorded to from the counter-cross pattern (FIG. 5B) after the sheet is fed for a portion of four pixels (a ½ of the head length). Further, in the third scan, the dots 53 are recording to from the cross pattern again (FIG. 5C) after the sheet is again fed for a portion of four pixels (a ½ of the head length). In this order, the sheet is fed for a four-pixel unit, and the cross and counter-cross patterns are recorded alternately, thus completing the recording area of the four-pixel unit per scan. As described above, it becomes possible to obtain an image of a high quality, in which the density unevenness is reduced by averaging the effect of the varied discharge characteristics of each discharge port in such a manner that the dots in the same pixel array are being recorded by two different kinds of discharge ports.

A recording method of the kind is disclosed in Japanese Patent Laid-Open Application No. 60-107975 and U.S. Pat. No. 4,967,203, for example, and it is described in these patent specifications, respectively, that the method is effectively applicable to solving the problem of the density unevenness and joint streaks. In the former, it is disclosed to the effect that the method has means to form a superposed portion by making the sheet feed per each of the main scans smaller than the width of a main scan so that the two adjacent main scans are superposed, and means to arrange the two main scans so as not to allow the printed dots in the aforesaid superposed portion to be superposed. In this laid-open application, a thinning mask is defined as "printed in cross wise in an odd number stage and an even number stage per one array" in some cases, but in some other cases, the odd number stage is printed by a first main scan, and the even number stage is printed by a second scan or the recording is executed at random per scan. Hence there are no complete limits set to the thinning mask and the width of the sheet feed.

Meanwhile, in the latter specification of the U.S. Pat. No. 4,967,203, the thinning mask which executes divided recordings is limited to the alternate pixel arrangement which is not adjacent in the vertical and horizontal directions such as disclosed to the effect that:

a) with a first path, the alternate pixel positions which are not adjacent in the horizonal and vertical directions are printed only for the upper half in a first band;

b) with a second path, a printing is executed for the pixels in the first band which are not printed in the first path, and the alternate pixels which are not adjacent horizontally and vertically in the lower half of the first band; and c) with a third path, the pixels in the first band which are not printed by the first and second paths are printed, and at the same time, the first path is executed for a band which immediately follows.

In this specification, a recording method is disclosed as an additional arrangement that several pixels are formed together as a super pixel to make a tonal representation and a multicolor representation, and that the alternate thinning printing is executed per super pixel. It is then described to the effect that according to this method, once a system to materialize the above-mentioned method is incorporated either in a programmed software or a printer (firmware) such a program can be called by the color number of the combination designated for the super pixel. As a result, without making the computer programming unnecessarily complicated for the preparation of many colors, this printing quality can be achieved. Also, as an effect, the simplification of the programming for the multicolor representation is described. Further, It is described that each of the super pixels is arranged with a purpose that it is recognized as a single homogeneous color, making any blur of colors in the super pixel harmless.

Now, in the conventional printer structured to arrange the recording heads for a plurality of colors in the direction of recording scan, there are some cases that the above-mentioned unevenness is created together with the color variation or the like if a bidirectional recording is attempted in order to enhance the recording speed without using the above-mentioned divided recording method. The reason will be described hereunder.

FIG. 6 is a cross-sectional view showing the state that the recording ink currently in use in general impacts on a recording medium (paper). Here, it is represented that ink (dots) of two different colors are absorbed (recorded) in the positions almost adjacent to each other with a time differential. Attention should be given to the fact that in the part where two dots are superposed, the dot which is impacted later than the dot which is recorded earlier tends to sink more in the depth direction of the sheet. This is because the coupling of the recording medium and the coloring matter of the dye in the discharged ink is made only at the stage where they are coupled physically and chemically, and also, because unless there is a great difference in the coupling force depending on the kinds of coloring matter, priority is given to the coupling of the recording medium and the coloring matter of the ink discharged earlier, and this coloring matter remains more on the surface of they recording medium, thus making it difficult for the coloring matter of the ink discharged later to couple with the recording medium on its surface. Conceivably, therefore, this coloring matter tends to sink in the depth direction of the recording medium in order to couple it.

In this case, even when two kinds of ink are recorded on the same impact point, the color priority becomes different depending on the order in which these two kinds of ink are impacted. Consequently, two different colors can appear by the way of order in which the imapacts are given because of the visual sensation of human eyes. For example, if a green (cyan+yellow) image should be formed in a given area, and ink is impacted on each of the pixels in order of cyan and yellow, the cyan which is absorbed earlier becomes the priority color, representing a green image having more cyanic coloring. On the contrary, if each ink is impacted in order of yellow and cyan, it is possible to obtain a green image having more yellowish coloring.

Here, taking a bidirectional recording into account, the order of impacting ink on the forward path and the order of impacting ink on the backward path are reversed because, as shown in FIG. 1, each of the color recording heads is arranged in the direction of recording scan. Therefore, the coloring of dots recorded on the forward path differs from that of dots, recorded on the backward path. If the sheet is being fed for a portion equivalent to the length of the discharge port arrangement per recording scan which is usually executed in such a state as above, the tonality and density of two different kinds appear alternately per scanning line, thus presenting a conspicous color unevenness in a recorded image as a whole, hence degrading the quality of the recorded image eventually.

However, a drawback of this kind can be overcome by use of the divided recording method described earlier. In other words, by executing the divided recording, it becomes possible as described in conjunction with FIG. 5 to mix the coloring of the dots recorded on the forward path (FIGS. 5A and 5C) and the coloring of the dots recording on the backward path (FIG. 5B) almost by half a number each in a given area. As a result, the difference in the coloring condition on both dots is averaged as a whole, making it possible to obtain just the intermediate coloring equally in any of the recording areas.

The above-mentioned structure and effect regarding the coloring condition are disclosed in the specification of U.S. Pat. No. 4,748,453, for example. Here, although no limit is set to the amount of sheet feed, the description is made to indicate that there is an effect to prevent the color banding (color unevenness) from taking place by reversing the orders of impacting ink on pixels of mixed colors for the first and second scans (reciprocal recording) for the formation of a color image when the ink beading should be avoided on a recording medium, a transparent film, for example, in such a manner that the recordings are executed complementarily by the divided recording scans into the first and second order (or more) for the pixels which are positioned alternately in the horizontal and vertical directions in each of the recording areas. In this specification, since the main purpose is to prevent the beading from taking place between each of the pixels, the method is characterized in that the pixels themselves, which are recorded per scan, are not adjacent to each other in the horizontal and vertical directions. A divided recording method of a kind is called "multipath printing".

In the meantime, the applicant hereof has disclosed the following method in Japanese Patent Laid-Open Application No. 58-194541:

A plurality of recording element arrays are arranged in parallel, and when a main scan is executed for the dot matrix recording by reciprocating the recording element arrays in the direction orthogonal to the aforesaid recording element arrays, each line of the recording dot matrix, and the dot numbers which are smaller than the total dots to be recorded at least on either one of the respective lines are intermittently recorded on the forward path of the aforesaid main scan, and at the same time, in the backward path of the aforesaid main scan, each of the aforesaid lines and the remaining dots at least on one of the respective lines are intermittently recorded. Thus the recording method is characterized in that the orders of superposition in which the superposed recording dots are recorded by the aforesaid plurality of recording element arrays are arranged to differ from each other on the forward path and the backward path of the aforesaid main scan. In this laid-open application, too, there is no limit set to the amount of sheet feed such as to make it smaller than the length of the recording element arrays as in the case of the divided recording described earlier. According to the disclosure, the effect of this method is to prevent the recorded image from being degraded due to the tonal deviation (color unevenness) of the recorded image caused by the repeated recording (superposed recording) in color ink. In this laid-open application, the main objective is the prevention of this tonal deviation. Therefore, no particular restriction is given to the positions of the dots to be recorded by each scan, and in its embodiments, there are described in addition to the checkered patterns (cross and counter-cross patterns), the horizontal thinning in which the recording is made alternately only in the vertical direction, and the vertical thinning in which the recording is made alternately only in the horizontal direction.

Also, in Japanese Patent Laid-Open Application No. 55-113573, there is disclosed a structure in which a reciprocal recording is executed by use of a pattern in the double-cut form (cross and counter-cross patterns), although not limited to a color printer. In this laid-open application, an arrangement is made so that no adjacent dots are printed continuously, and then, before the printed dots are dried, the adjacent dots are printed in order to achieve its objective, that is, to prevent any deformed dots from being created. Therefore, in this laid-open application, the thinning mask is limited to the pattern in the double-cut form as in the specification of the above-mentioned U.S. Pat. No. 4,748,453.

Now, the above-mentioned three disclosed specifications are all aimed at preventing the color unevenness and beading from being created when a reciprocal recording is executed. Therefore, unlike the divided recording method disclosed herein, none of them provides a structure that "the amount of sheet feed between each of scans is made less than the length of the discharge port arrangement" as one of the objectives to prevent the density unevenness from being created due to the variation of the discharge ports. Also, none of them discloses the case where two or more kinds of ink having different densities are used for recording.

As described above, when the divided recording is executed in the reciprocal recording, it is possible to distribute the two kinds of recording pixels having the opposite orders of impacting ink colors evenly in a recording area, thus making it possible to solve the color unevenness and eliminate, at the same time, the density unevenness caused by the variation of the discharge ports.

Nevertheless, the phenomenon that the dot fixation state differs by the order in which the ink is impacted not only results in the above-mentioned color unevenness, but also this phenomenon is equally applicable to the case where ink having different densities are impacted. In other words, if a dot is recorded with ink of a high density earlier, the density of this dot which is recorded earlier is given priority so that a clear image can be obtained with a high density. On the other hand, if ink of a high density is impacted subsequent to ink of a low density having been impacted, such ink is greatly permeated around the ink of a low density so that a smooth and even image can be obtained with a density which is not so high.

As described above, when the plural ink having different darkness and lightness are used for each of the plural kinds of ink in consideration of the graininess in the recorded imagea in executing a color recording by use of plural kinds of ink, there appears the dark and light unevenness due to the order in which the dark and light ink are superposed, in addition to the color unevenness due to the order in which each kind of ink is superposed; hence varying more the way in which the color unevenness and as the dark and light unevenness appear.

To describe this condition more precisely, in the ink jet recording apparatus shown in FIG. 1, the arrangement of the conventional recording heads Kk to Yu used for a color recording as described above is made in such a way as shown in FIG. 7. Therefore, the combination of the superposition of various kinds of ink including the dark and light ones, which is arrangeable by way of scanning in executing a color recording, becomes more varied as compared to the case where no dark and light ink are used.

As a result, even if the color unevenness and dark and light unevenness are to be averaged by use of the above-mentioned divided recording method, it does not work good enough in some cases. Also, as described later, the color unevenness and others cannot be completely eliminated depending on the permeated area of the ink impacted on each of the dots.

Now, FIG. 45 is a view showing another structure of the ink jet recording apparatus which records by use of the dark and light ink. FIG. 45 illustrates the structure of the printer unit when printing on the surface of a sheet by use of the above-mentioned multihead. Here, it is assumed that four recording heads for four colors are provided in the recording scan direction for color printing. In FIG. 45, a reference numeral 701 designates ink cartridges. These cartridges comprise the ink tanks containing four color ink—black, cyan, magenta, and yellow—each separately prepared in dark and light ink; and the recording heads 702.

FIG. 7 is a view showing the state of the discharge ports arranged on the recording heads observed in the direction z in FIG. 45. Here, the dark ink discharge port are arranged and the light ink discharge port array are arranged on the black head. Adjacent to it, the dark ink discharge port array and light ink discharge port are arranged on the cyan head. In this way, two arrays of ink discharge ports are arranged each for the four colors. In this respect, the head for each color including the dark and light discharge ports is represented as if arranged independently, but if only the arrangement of ink discharge ports itself is equal to the above-mentioned structure, the state of image formation is also the same even if all the discharge ports for each of the colors and densities are arranged on one and the same head.

Now, reverting to FIG. 45, a reference numeral 703 designates a feed roller which rotates in the direction indicated by an arrow while pressing a printing sheet 707 in cooperation with an auxiliary roller 704 to feed a printing sheet 707 in the direction indicated by an arrow y at all times; 705, a supply roller which supplies the printing sheet, and at the same time, serves to press the printing sheet 707 in the same manner as the rollers 703 and 704; 706, a carriage which supports the four ink cartridges, and at the same time, enables them to travel when printing. The carriage is on standby in the home position h indicated by dotted lines in FIG. 45 when no operation is executed for printing or when a recovery operation is executed for the multihead.

Before starting a printing, the carriage 706 is in the home position shown in FIG. 45. With a printing start command, the recording is executed for an area of a width D on the sheet by use of the n number of multinozzles on the multihead 702 while traveling in the direction x. This recording is executed in such a manner that in accordance with the timing read by an encoder, the aforesaid heat generating elements are driven on the basis of recording signals to discharge ink droplets on a recording material in order of dark black, light black, dark cyan, light cyan, dark magenta, light magenta, dark yellow, and light yellow, thus allowing them to adhere to the recording material for the formation of images. When the printing of data is completed to the end portion of the surface of the sheet, the carriage returns to the home position originally set when the printing is started, and then, the printing is again started in the direction x (forward scan direction) or, if the printing is reciprocal, it is executed while the carriage travels in the direction −x (backward scan direction). During the period from the completion of the first printing to the start of the second printing, the feed roller 703 rotates in the direction indicated by an arrow to convey the sheet in the direction y for a portion equivalent to the width D. In this way, a printing and a sheet feed for the area equivalent to the multihead width D are repeated by means of the carriage and scan to complete the printing on one surface of the recording sheet.

With the multipath printing method or divided recording method set forth above, which is applicable to a bidirectional printing in this ink jet recording apparatus, it is possible to anticipate excellent effects in recording by use of several kinds of ink each having different densities in a color recording or in a monochrome printing using only black ink.

However, when a structure should be arranged so that a total of eight kinds of ink—yellow, magenta, cyan, and black, each prepared in dark and light ink—may be recorded simultaneously, it is not good enough if the division is provided only for one reciprocal scan because the time is often too short for ink to be dried sufficiently.

In addition to it, if the amount of ink impacted per dot becomes great, the ink is often permeated into the area of the other pixels. For example, as shown in FIG. 48, even in a state that a recording is made only for a 50% of the total area, almost all the area is covered eventually. If such a condition is brought about, the ink recorded by the scan in the opposite direction almost sinks into the lower side of the surface of the sheet due to the principle described in conjunction with FIG. 6. Consequently, on the surface of the sheet, the resultant image tends to present a biased tonality.

Also, if the divided recording method is being used, the area recorded by the backward scan subsequent to the earlier recording by the forward scan, and the area recorded by the forward scan subsequent to the earlier recording by the backward scan appear alternately by half a pitch of the recording width of the head; hence inevitably presenting a conspicuous color unevenness in the sheet feeding direction.

Further, in a case of a monochrome printing, although no color unevenness such as above appears, there often encountered the difference in the way of ink permeation into the surface of the sheet when using two kinds of ink each having different density. In other words, even in a monochromic color, there is a possibility that density unevenness appears in the sheet feeding direction depending on the order of impacting each of the two kinds of ink.

Conceivablly, therefore, the number of divisions is increased to provide a method in which a printing is executed by two-reciprocal scans or four-reciprocal scans, but in this case, the problem is that the required recording time becomes longer still; hence canceling the favorable effects-of the bidirectional printing.

SUMMARY OF THE INVENTION

The present invention is designed to solve the problems encountered in recording by use of a plurality of ink each having different densities as described above. It is an object of the invention to provide a recording head which contributes to miniaturizing the apparatus, and suppresses the unevennesses in a recorded image; and an ink jet recording apparatus.

Also, the present invention is designed in consideration of the foregoing subject, and is aimed at providing an ink jet recording apparatus and an ink jet recording method capable of obtaining excellent images without any density unevenness.

In order to solve the above-mentioned problems, an ink jet recording apparatus according to the present invention has a recording head provided integrally with a plurality of recording units having a plurality of discharge port arrays integrally arranged in the direction orthogonal to the direction of main scan for discharging each of different colored inks. The aforesaid plural recording units are arranged in the aforesaid direction of main scan, and discharge ink each having different densities at the same time.

Also, an ink jet recording apparatus according to the present invention has a recording head provided integrally with a plurality of discharge port arrays for discharging inks having different densities in the direction which differs from the aforesaid direction of main scan. Further, the aforesaid recording head is integrally provided with a plurality of recording units having a plurality of discharge port arrays arranged in the direction almost orthogonal to the aforesaid direction of main scan for discharging inks having different densities.

Also, an ink jet recording apparatus according to the present invention has a recording head provided with the discharge port array having a plurality of discharge ports arranged in the direction different from the aforesaid direction of main scan for discharging inks, wherein a plurality of discharge port arrays, which are arranged in the direction different from said direction of main scan for discharging ink each having different densities, are arranged in the aforesaid direction of main scan per color of the aforesaid ink, and then, all the pixels in a recordable area by a one-main scan of the recording head are thinned in accordance with a plurality of thinning arrangement patterns which are in a complementary relationship with each other. The thinned image is recording by plural numbers of main scans of the aforesaid recording head, and plural numbers of correlative movements of the aforesaid recording head and the recording medium in the direction different from the aforesaid scan.

Also, an ink jet recording apparatus according to the present invention has a recording head provided with the discharging ports having a plurality of discharge ports arranged in the direction different from the aforesaid direction of main scan for discharging inks, wherein a plurality of discharge port arrays, which are arranged in the direction different from the aforesaid direction of main scan for discharging ink each having different colors, are arranged in the aforesaid direction of main scan per density of the aforesaid ink, and then, all the pixels in a recordable area by a one-time main scan of the aforesaid recording head are thinned in accordance with a plurality of thinning arrangement patterns which are in a complementary relationship with each other. The thinned image is recorded by the plural numbers of the main scans of the aforesaid recording head, and the plural numbers of the correlative movements of the aforesaid recording head and the aforesaid recording medium in the direction different from the aforesaid main scan.

Also, a recording head according to the present invention is provided with a plurality of discharge port arrays having a plurality of discharge ports arranged in a given direction, and is characterized in that the aforesaid discharge port arrays are arranged with a plurality of discharge port groups for discharging inks each having different densities.

Also, a recording head according to the present invention is characterized in that a plurality of discharge ports are arranged in a given direction, and each of them is provided with a plurality of discharge port arrays having a plurality of discharge port groups for discharging inks each having different colors, and that the aforesaid plural discharge port arrays discharge inks each having different densities.

Also, an ink jet recording apparatus according to the present invention uses a recording head capable of discharging a plurality of inks each having different densities, and forms images by discharging ink from the aforesaid recording head to a recording medium while enabling the aforesaid head to scan the recording medium correlatively, and is characterized in that there is provided means for controlling ink discharges to form an image by discharging ink having a desired density, which is selected from among the aforesaid plural inks each having different densities, in a first scan of the aforesaid recording head, and then, in a second scan subsequent to the aforesaid first scan, to form the image in the image area formed by use of the ink of the aforesaid desired density by discharging the ink which has the density different from the aforesaid desired density, which is selected from among the aforesaid inks each having different densities.

Also, an ink jet recording apparatus according to the present invention uses a recording head capable of discharging a plurality of inks each having different densities, and forms images by discharging ink from the aforesaid recording head to a recording medium, and is characterized in that there are provided reciprocal scanning means to enable the aforesaid recording head to reciprocally scan a recording medium correlatively; recording head driving means to drive the aforesaid recording head for the formation of images during the reciprocal detection by the aforesaid reciprocal scanning means; and means for controlling ink discharge to form an image by discharging ink having a desired density, which is selected from among the aforesaid plural inks each having different densities, in a first reciprocal scan by the aforesaid reciprocal scanning means, and then, in a second reciprocal scan subsequent to the aforesaid first reciprocal scan, to form the image by discharging the ink which has the density different from the aforesaid desired density.

Also, an ink jet recording method according to the present invention, which uses a recording head capable of discharging a plurality of inks each having different densities, and forms images while enabling the aforesaid recording head to reciprocally scan a recording medium correlatively, comprises the following steps of:

forming an image by discharging ink having a desired density, which is selected from among the aforesaid plural inks each having different densities, in one of scans executed by the aforesaid reciprocal scanning; and forming the image by discharging the ink having the different density from the aforesaid desired density, which is selected from among the aforesaid plural inks each having different densities, in the image area formed by use of the ink having the aforesaid desired density during the other scan executed by the aforesaid reciprocal scanning subsequent to the aforesaid one scan of the reciprocal scanning.

Also, an ink jet recording method according to the present invention, which uses a recording head capable of discharging a plurality of inks each having different densities, and forms images while enabling the aforesaid recording head to reciprocally scan a recording medium correlatively, comprises the following steps of:

forming an image by discharging ink having a desired density, which is selected from among the aforesaid plural inks each having different densities, in a first reciprocal scan; and forming the image by discharging the ink having the different density from the aforesaid desired density, which is selected from among the aforesaid plural inks each having-different densities, in the image area formed by use of the ink having the aforesaid desired density during a second reciprocal scan subsequent to the aforesaid first reciprocal scan in the image area formed by use of the ink having the aforesaid desired density.

DETAILED DESCRIPTION OF THE PREFERRED EMBODIMENTS

Hereinafter, with reference to the accompanying drawings, the detailed description will be made of the embodiments according to the present invention.

First Embodiment

Structure of a Recording Apparatus

Figure 8:
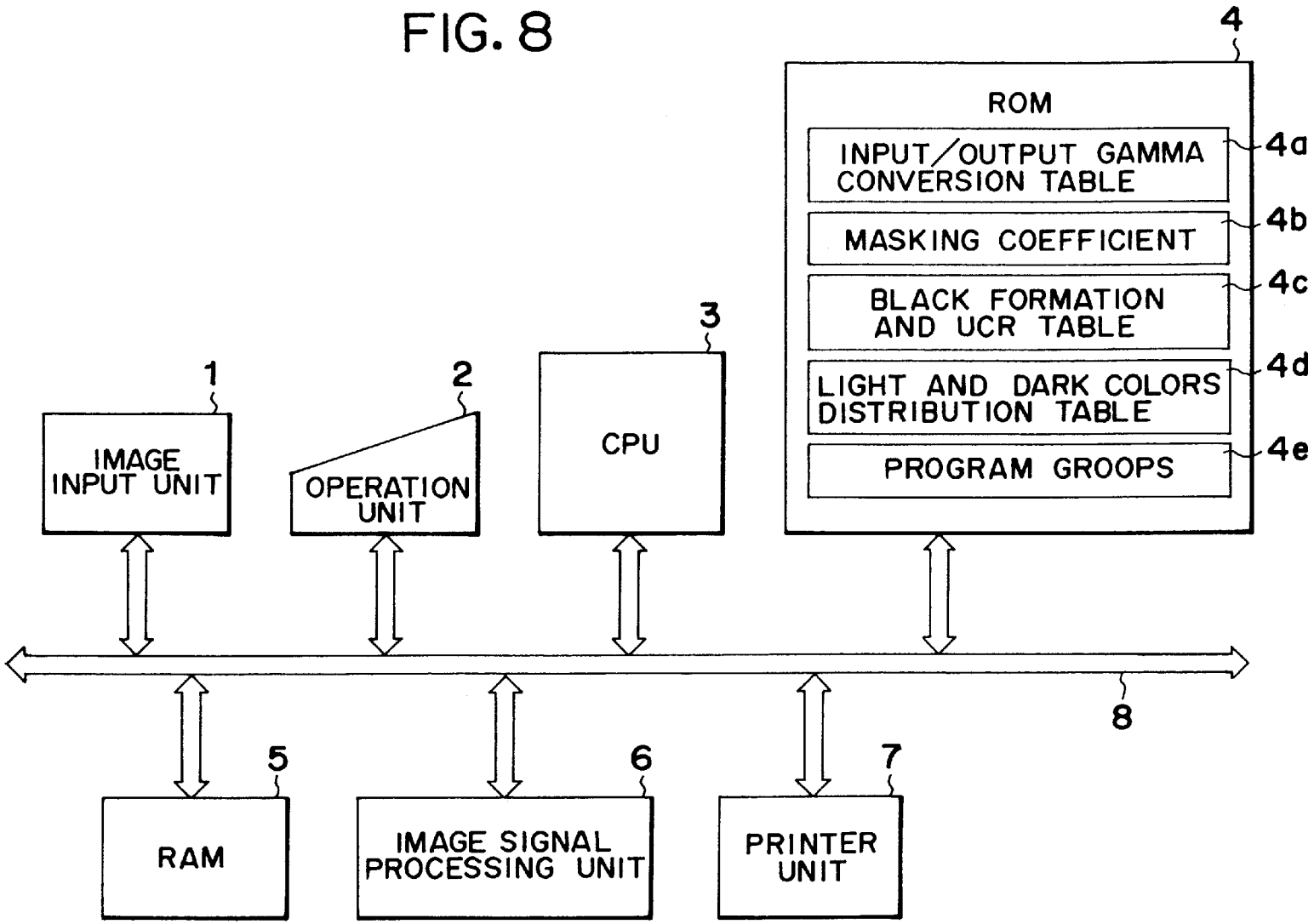
FIG. 8 is a block diagram showing the controlling structure of the color ink jet recording apparatus according to a first embodiment of the present invention.

FIG. 8 is a block diagram showing the controlling structure of a color ink jet recording apparatus according to an embodiment of the present invention.

In FIG. 8, a reference numeral 1 designates an image input unit through which an image obtainable by optically reading an original image by a CCD and others, image luminance signals (RGB) of an equipment, or the like is input; 2, an operation unit provided with various keys to command the setting of various parameters and start of recording; 3, a CPU which controls the entire systems of the recording apparatus in accordance with various programs stored in a ROM which will be described later; and 4, the ROM which stores the program and others to operate the recording apparatus in accordance with the control program and error processing program. In this ROM 4, a reference numeral 4*a* designates an input/output gamma conversion table which is referred to in the process of the input/output gamma conversion circuit which will be described later; 4*b*, the masking coefficient which is referred to in the process of the color correction (masking) circuit which will be described later; 4*c*, the black formation and UCR table which is referred to in the process of the black formation and UCR circuit which will be described later; 4*d*, the dark and light distribution table which is referred to in the process of the dark and light distribution circuit which will be described later; and 4*e*, the program groups which store the above-mentioned various programs, respectively.

Also, a reference numeral 5 designates a RAM which is used as a work area for the execution of various programs stored in the ROM 4, and also, as a temporary saving area in executing the error processes; 6, a processing unit to process the image signals which will be described later; 7, a printer unit to form dot images on the basis of the image signals processed in the image signal processing unit 6 at the time of recording; and 8, a bus line transmitting the address signals, data, control signals and others in the apparatus.

Image Signal Processing Unit

Now, the detailed description will be made of the image signal processing unit 6 shown in FIG. 8.

Figure 9:
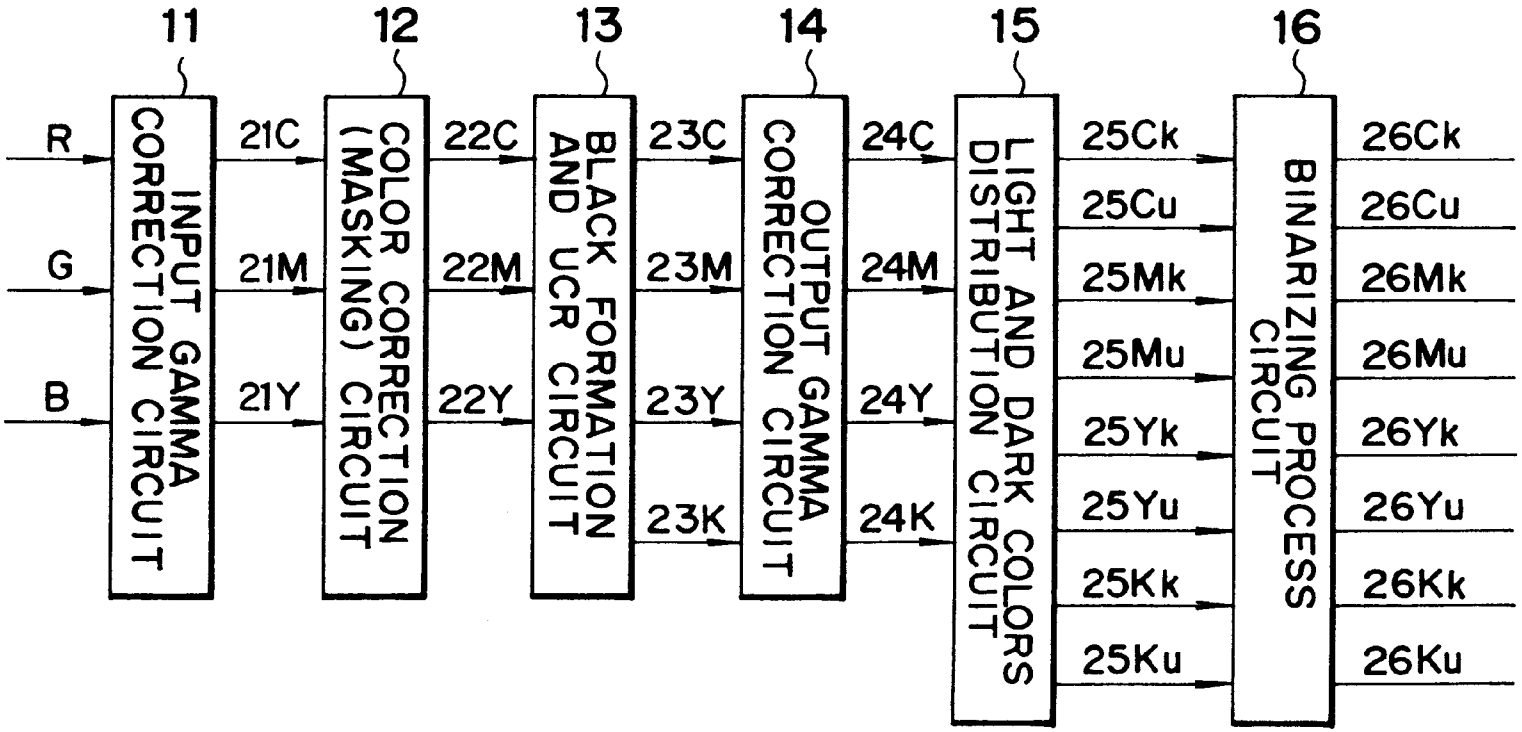
FIG. 9 is a block diagram showing an example of the image signal processing circuit shown in FIG. 8.

FIG. 9 is a block diagram showing an example of the circuits constituting the image signal processing unit 6 according to the present embodiment.

The image luminance signals R, G, and B, for read, green, and blue, which are transmitted from the host apparatus, are inputted into the input gamma correction circuit 11, and are converted into the image density signals 21C, 21M, and 21Y for cyan, magenta, and yellow, respectively. With color processing given in the color correction (masking) circuit 12 and black formation and UCD (under color removal) circuit 13, these signals are converted into new image density signals 23C, 23M, 23Y, and 23K for cyan, magenta, yellow, and black, respectively.

After the gamma correction is executed in the output gamma correction circuit 14, these image density signals are distributed by the dark and light distribution circuit 15 into the image density signals 25Ck, 25Mk, 25Yk, and 25Kk corresponding to the dark cyan, dark, magenta, dark yellow, and dark black, each having a high density in its dyestuffs, respectively, and the image density signals 25Cu, 25Mu, 25Yu, and 25Ku corresponding to the light cyan, light magenta, light yellow, and light black, each having a low density in its dyestuffs, respectively.

Figure 10A:
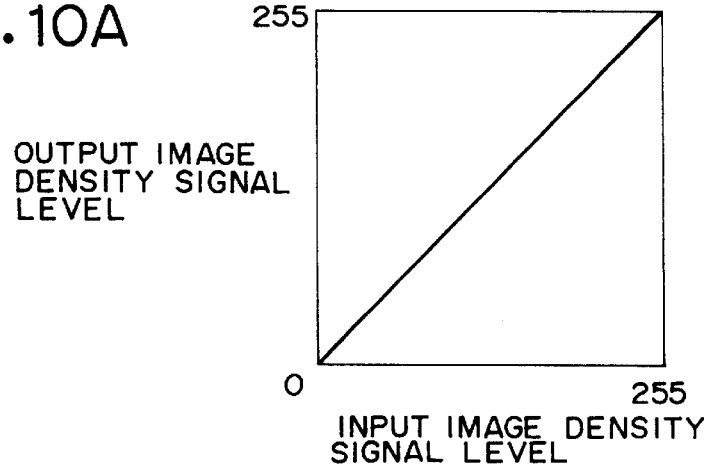
FIGS. 10A to 10C are schematic views showing a table for the dark and light allocation shown in FIG. 8.
Figure 10B:
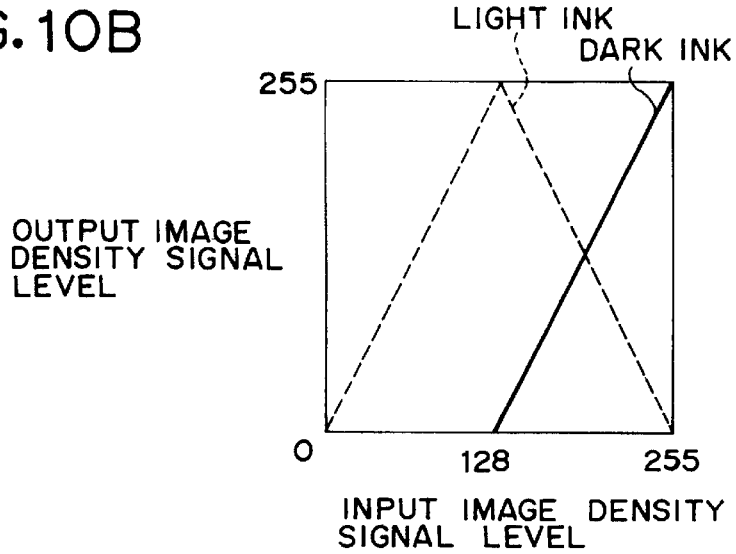
Figure 10C:
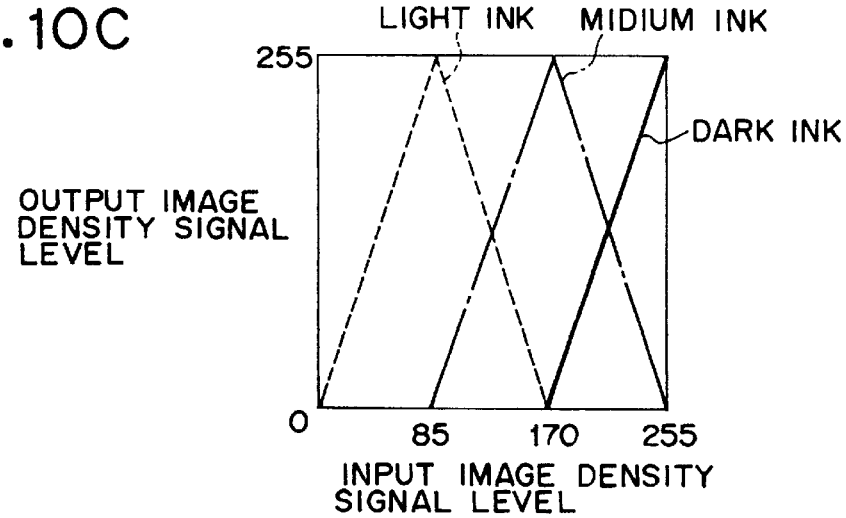

FIGS. 10A, 10B, and 10C are line diagrams showing an example of the dark and light distribution table.

When ink of two kinds of densities, dark and light, are used as in the present embodiment, for example, the conversion table shown in FIG. 10B is applied.

This table is arranged to indicate a proportionally linear relationship between the image density signal value and the optical reflection density value of an image after recording. The image density signals are converted into the dark and light signals by the dark and light distribution circuit on the basis of this dark and light distribution table. Each of the image density signals distributed to the dark and light signals, respectively, is binarized by a binarization circuit 6. In the printer unit 7, these binarized data are made the discharging signals for each of the recording heads. Thus ink is discharged from the ink discharge ports corresponding to each signal value of the recording heads to record a color image.

Printer Unit

Figure 11:
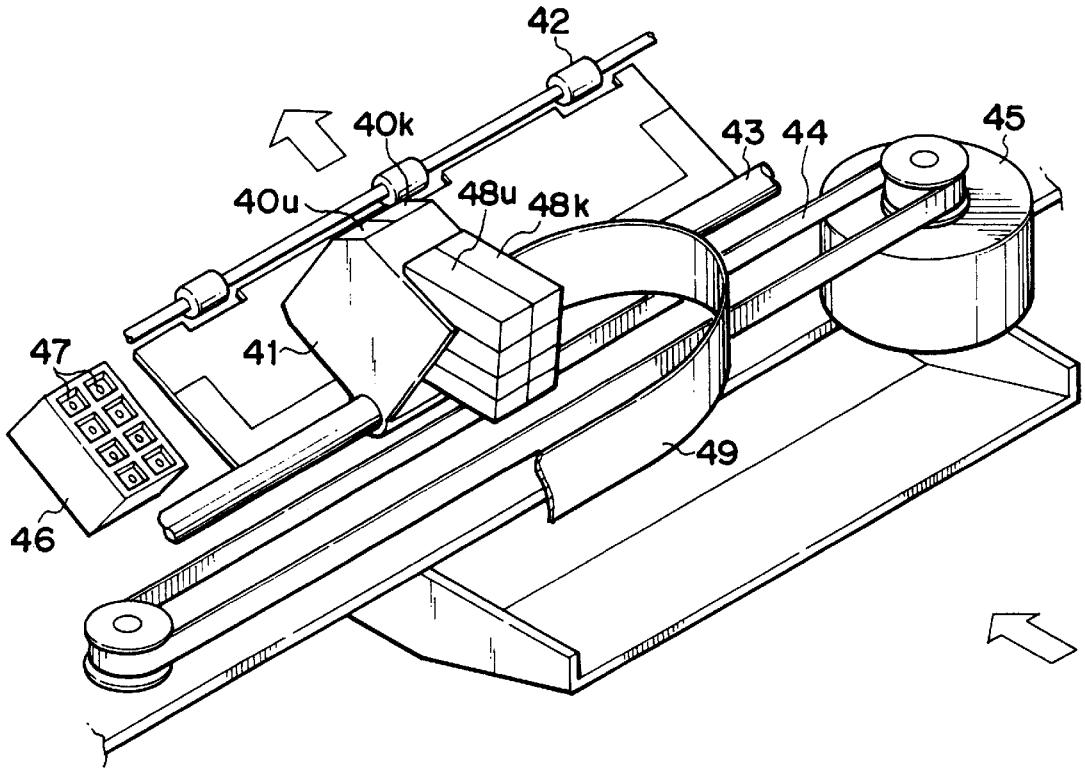
FIG. 11 is a perspective view showing the principal structure of a color ink jet recording apparatus according to an embodiment of the present invention.

FIG. 11 is a perspective view showing the principal structure of a color ink jet recording apparatus according to an embodiment of the present invention.

An ink jet unit 40*u* for light ink having each discharge port array which discharges light ink independently for black, cyan, magenta, and yellow, respectively, and an ink jet unit 40*k* for dark ink having each discharge port array which discharges dark ink for black, cyan, magenta, and yellow, respectively, are arranged on a carriage 41 apart from each other at a given distance. The carriage 41 is slidably guided on demand by a guide shaft 43 to reciprocate along the guide shaft 43 by the driving force of a carriage motor 45 through a driving belt 44.

On the liquid passages conductively connected to the ink discharge ports of each of the recording heads of the ink jet units 40*u* and 40*k*, there are arranged heat generating elements (electrothermal transducers) for generating the thermal energy which is utilized for discharging ink.

Ink is supplied to the corresponding discharge port arrays of each of the ink jet units 40*u* and 40*k* from the respective ink cartridges 48*u* and 48*k* through given supply passages. The interiors of these ink cartridges 48*u* and 48*k* are separated by walls to retain yellow, magenta, cyan, and black ink each having the respective densities. Also, the control signals and others are transmitted to the ink jet units 40*u* and 40*k* through a flexible cable 49.

A recording material, such as a recording sheet or a plastic thin board, is conveyed in the direction indicated by arrows by a feed roller (not shown) and exhaust rollers 42 having a feed motor (not shown) as its driving source. During this period, a recording is being made on the surface of the recording material facing each of the ink jet units as the units travel. In other words, the above-mentioned heat generating elements are driven on the basis of the recording signals in accordance with the timing read by an encoder which detects the traveling positions of the carriage 41, thus discharging ink droplets to the recording material in order of dark ink and light ink of each color to enable them to adhere to the recording material for recording an image.

In the home position of the carriage 41, which is arranged outside the recording area where a recording is executed by the traveling of the carriage 41, a recovery unit 46 having a cap unit 47 is arranged. When no recording is operated, the carriage 41 travels to the home position to close the ink discharge formation surface of the ink jet units 40*u* and 40*k* corresponding to each of the caps of the cap unit 47; hence preventing any clogging from taking place due to the solidification of ink caused by the evaporation of ink sorbet or the adhesion of foreign material such as dust particles.

Also, the above-mentioned cap unit 47 is utilized when an idle discharge mode is executed to discharge ink to the interior of the cap unit for the correction of defective discharge and the removal of clogging of the ink discharge ports having low frequency of recording, or when a discharge recovery is processed by sucking ink from the ink discharge ports which have allowed a disabled discharge to occur. Also, arranging a blade in the position adjacent to the cap unit makes it possible to clean the ink discharge port formation surface of the ink jet units.

Also, with the provision of partitions between each of the boundaries in the vertical direction in the cap unit 47, it is possible to prevent the ink which is sucked on the upper side from flowing into the lower side, thus avoiding the degradation of the image quality and others due to the mixture of color ink.

Ink Jet Units

Figure 12:
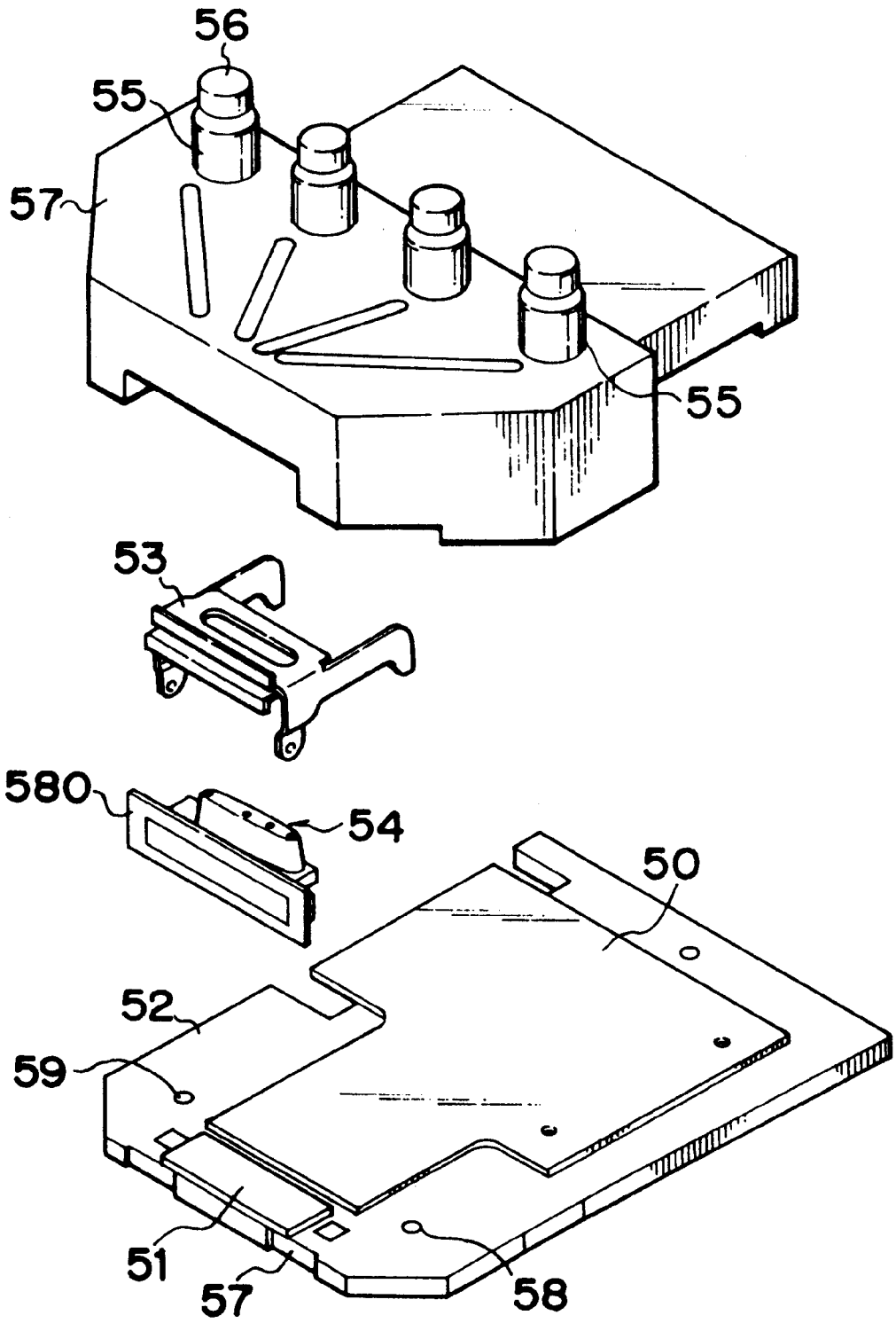
FIG. 12 is an exploded perspective view showing the structure of an ink jet recording apparatus according to an embodiment of the present invention.

FIG. 12 is an exploded perspective view showing the structure of the ink jet units 40*u* and 40*k* used for the present embodiment.

One end of the wiring base board 50 and the wiring part of the heater board 51 are connected with each other, and further, on the other end of the wiring base board 50, a plurality of pads are provided corresponding to each of the electrothermal transducers for receiving the control signals, discharge signals, and the like from the control unit of the apparatus. In this way, the electrical signals from the control unit of the apparatus are supplied to each of the electrothermal transducers.

A metallic supporting board 52, which supports the reverse side of the wiring base board 50 plainly, also serves as the bottom board of the ink jet units. A pressure spring 53 is to press the area in the vicinity of the ink discharge ports of the grooved ceiling board 54 linearly and resiliently. Therefore, this spring comprises a part formed by bending to provide an almost U-letter configuration at its cross-section; the hooking nail which utilizes the escape hole arranged on the base plate; and a pair of hind legs which receive the force working on the spring by the base plate. The wiring board 50 and the grooved ceiling board 54 abut upon each other by the force exerted by this spring. Also, the wiring board 50 is mounted on the supporting member by bonding using adhesives or the like.

For each of ink, yellow, magenta, cyan, and black, four ink supply tubes 55 are arranged, and on each end of the ink supply tubes 55, a filter 56 is provided. The ink supply member 57 is manufactured by a mold formation. The liquid passages are also formed to conduct ink from the supply tubes 55 to each of the ink supply inlets arranged on the grooved ceiling board 54. The ink supply member 57 is simply fixed to the supporting board 52 in such a manner that two pins (not shown) on the reverse side of the ink supply member 57 are extruded through the holes 58 and 59 arranged on the supporting board 52, and these are thermally bonded for fixation.

At this juncture, the space between the orifice plate unit 580 and the ink supply member 57 are formed uniformly. The sealing agent is filled in from the upper sealing agent inlet prepared on the ink supply member 57. Thus the wire bonding is sealed, and at the same time, the space between the orifice plate unit 580 and the ink supply member 57 is sealed. Further, the sealing agent flows through the grooves provided for the supporting board 52 to completely seal the space between the orifice plate unit 580 and the front end of the supporting board 52.

Figure 13:
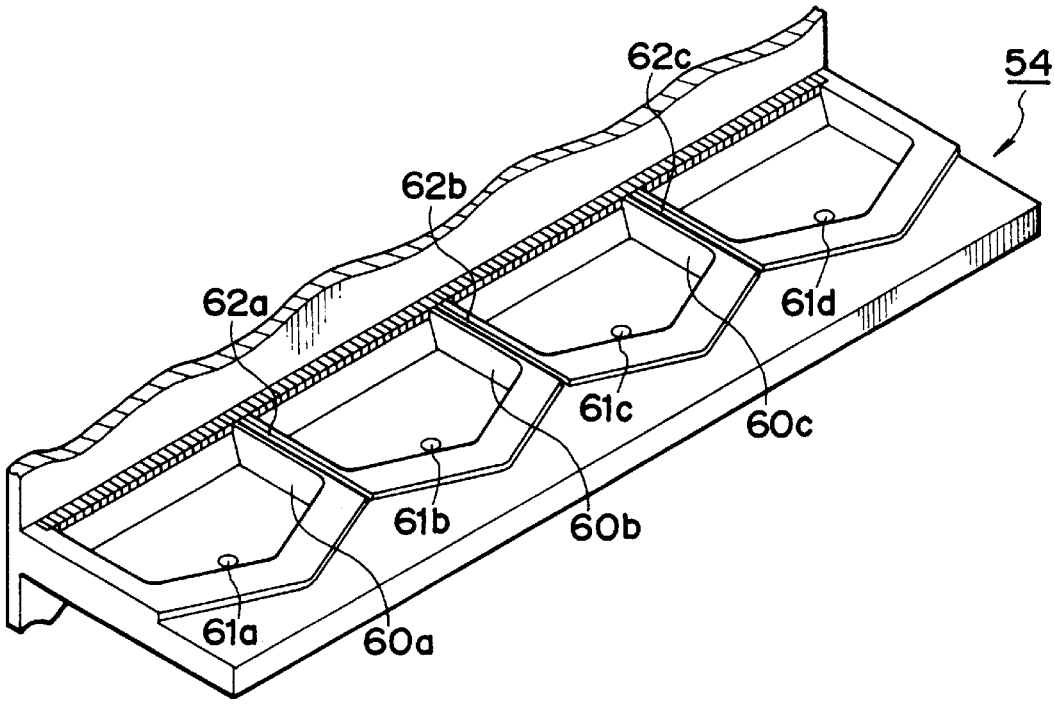
FIG. 13 is a perspective view showing a grooved ceiling board constituting the above-mentioned ink jet units.

FIG. 13 is a perspective view showing the above-mentioned grooved ceiling board 54 observed from the heater board 51 side.

In the grooved ceiling board 54, four grooves for common liquid chambers are provided for each of ink, yellow, magenta, cyan, and black. Each of the common liquid chambers is partitioned by walls 60*a* to 60*c*. For each of the common liquid chambers, supply inlets 61*a* to 61*d* are provided for supplying ink.

On the surface of partition walls 60*a* to 60*c* for each of the common liquid chambers, which abuts on the heater board 51, grooves 62*a* to 62*c* are provided. These grooves are conductively connected to the circumference of the grooved ceiling board 54. After the grooved ceiling board 54 is pressed closely to the heater board, the circumferential part is sealed by the aforesaid sealing agent. At this juncture, the sealing agent flows along the above-mentioned grooves to be permeated to fill in the space between the grooved ceiling board and heater board. In this way, it is possible to completely separate the common liquid chambers by the same processes used for the conventional recording head. The structure of the grooves differs by the physical properties of the sealing agent, and it is necessary to configure them accordingly.

By separating the common liquid chamber into plural numbers like this, it becomes possible to supply different ink to each of the ink discharge ports.

Figure 14A:
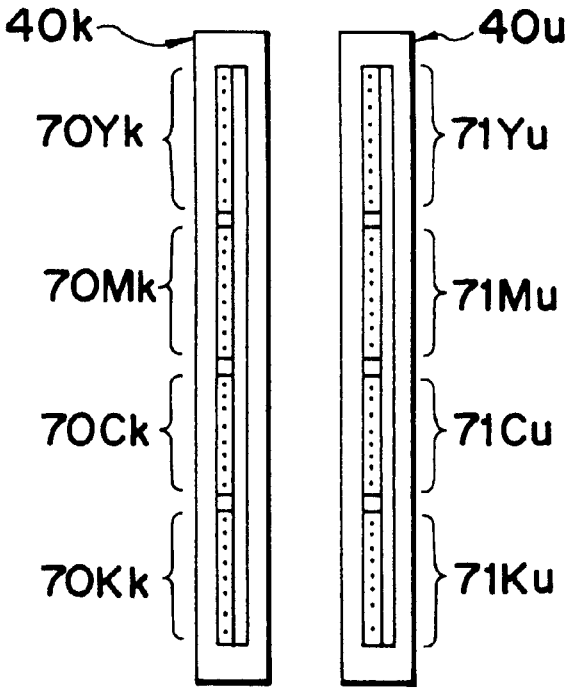
FIGS. 14A to 14C are schematic views showing the arrangement of ink discharge ports of the ink jet units according to an embodiment of the present invention.

FIG. 14A is a schematic view showing the ink discharge port arrays of the ink jet units 40*u* and 40*k* observed from the recording material side.

In the present embodiment, two ink jet units 40*u* and 40*k* are used. As described above, these are integrally provided with ink discharge port arrays each for yellow, magenta, cyan, and black for dark ink, and for light ink, respectively.

The reference marks 70Yk, 70Mk, 70Ck, and 70Kk of the ink jet unit 40*k* designate the discharge port array to discharge dark ink each for yellow, magenta, cyan, and black, respectively.

The reference marks 71Yu, 71Mu, 71Cu, and 71Ku of the ink jet unit 40*u* designate the discharge port array to discharge light ink each for yellow, magenta, cyan, and black, respectively. The discharge port array for each color has 32 discharge ports at a pitch of 360 dots per inch (360 dpi). Between each of the colors in these discharge port arrays, a space equivalent to eight dots is provided by the walls between the common liquid chambers.

Figure 15:
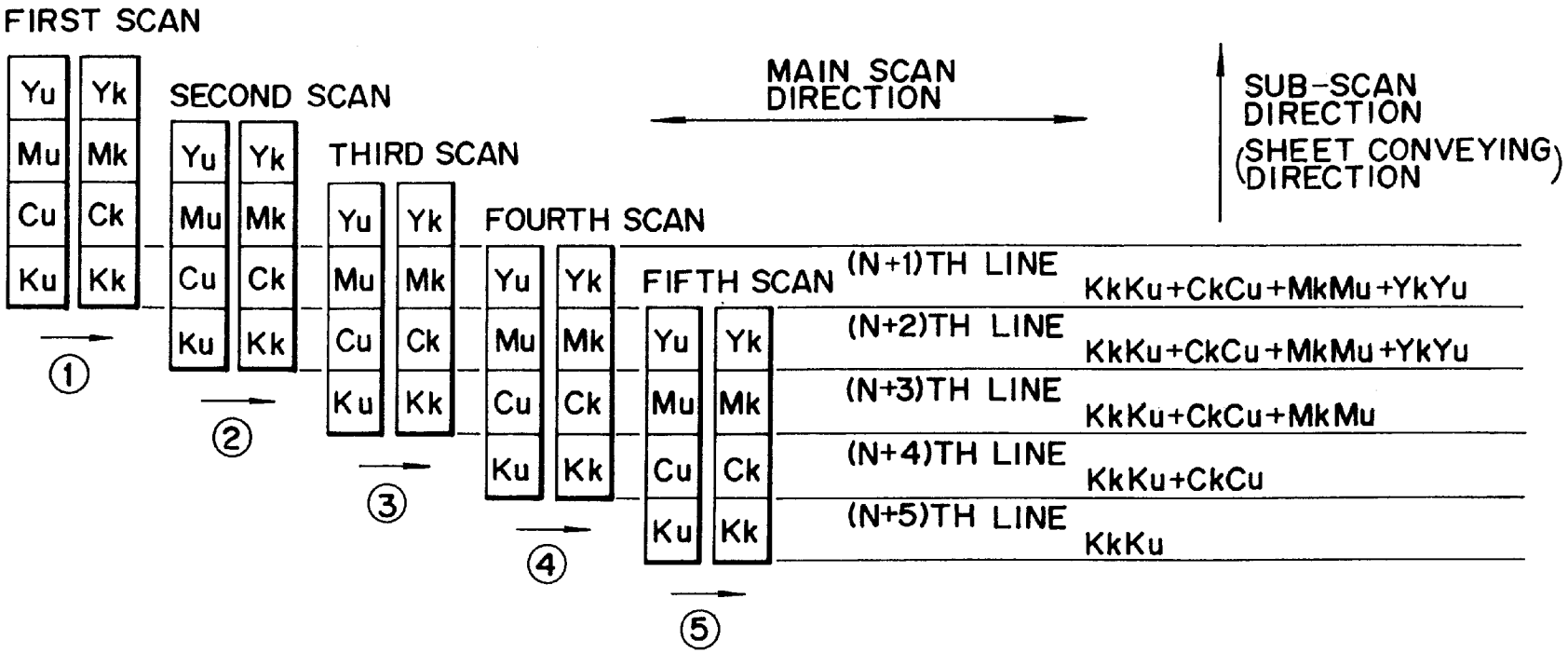
FIG. 15 is a view illustrating the formation process of an image by use of the ink jet recording units having the discharge port array shown in FIG. 14A.

FIG. 15 is a schematic view showing the image formation process by use of the ink jet units 40*u* and 40*k* shown in FIG. 14A.

In conjunction with FIG. 15, the description will be made of the image formation process.

Here, in this explanation, it is assumed that there is no space between the discharge port arrays for each of the colors.

Giving attention to the Nth+one line, it is understandable that after a recording for the dark black Kk and light black Ku is executed by the first scan, a line feed (hereinafter abbreviated to as LF) of the recording material is made for a given amount; a recording for the dark cyan Ck and light cyan Cu is executed by the second scan, followed by an LF; a recording for the dark magenta Mk, and light magenta Mu is executed by the third scan, followed by an LF; and then, a recording for the dark yellow Yk and light yellow Yu is executed by the fourth scan, followed by an LF, thus completing the recording of the Nth+one line. The amount of LF after each recording scan is equivalent to the length of the arrangement of 32 discharge ports of the discharge port array for each color. By four-time recording scans, an image is recorded for a 32-discharge port portion. In practice, however, the LF amount is set for a length of the discharge port arrangement for each color plus a space between discharge port arrays for each of the colors. The image for the 32-discharge port portion is thus recorded by the four-time recording scans.

Figure 14B:
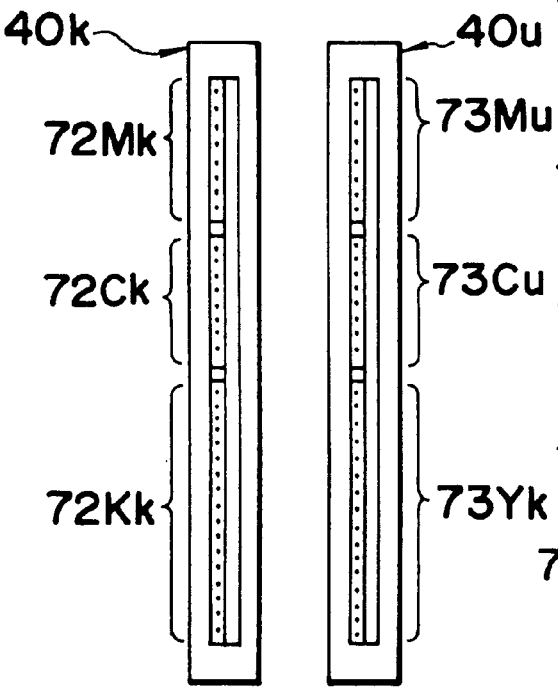

FIG. 14B is a view showing another example of the ink jet units 40*u* and 40*k*.

In the example shown in FIG. 14B, there are used one and the same unit having ink discharge arrays for each of the color ink, dark magenta, dark cyan, and dark black in the same unit, and also, one and the same unit having ink discharge arrays for each of the color ink, light magenta, light cyan, and dark yellow.

In FIG. 14B, the reference numerals 72Kk, 72Mk, and 72Ck of the ink jet unit 40*k* designate the discharge port arrays to discharge dark ink of black, magenta, and cyan, respectively; and also, 73Yk, 73Mk, and 73Cu of the ink jet unit 40*u*, the discharge port arrays to discharge light ink of yellow, magenta, and cyan, respectively.

In this structure, only dark ink having high density is used for yellow and black, respectively.

Since an yellow image has a high brightness, the graininess of the dots are not so conspicuous in the bright part of the image. Also, the black ink is used only for the high density part of an image. Its graininess is not so conspicuous, either. Therefore, only dark ink is used for yellow and black as described above.

For the unit arrangement shown in FIG. 14B, the dark and light distribution table shown in FIG. 10A is applicable to yellow and black, and the one shown in FIG. 10B is applicable to magenta and cyan. Also, the number of discharge ports for 72Kk and 73Yk is two times that of discharge ports for the other colors. The discharge port array has 32 discharge ports for dark and light magenta, and dark and light cyan, respectively, while 64 discharge ports for dark black and dark yellow, respectively, both at pitches of 360 dots per inch (360 dpi). Also, there is a space equivalent to eight discharge port portions each provided by the walls of liquid chambers for each of the colors between the discharge port arrays for the respective colors.

Figure 16:
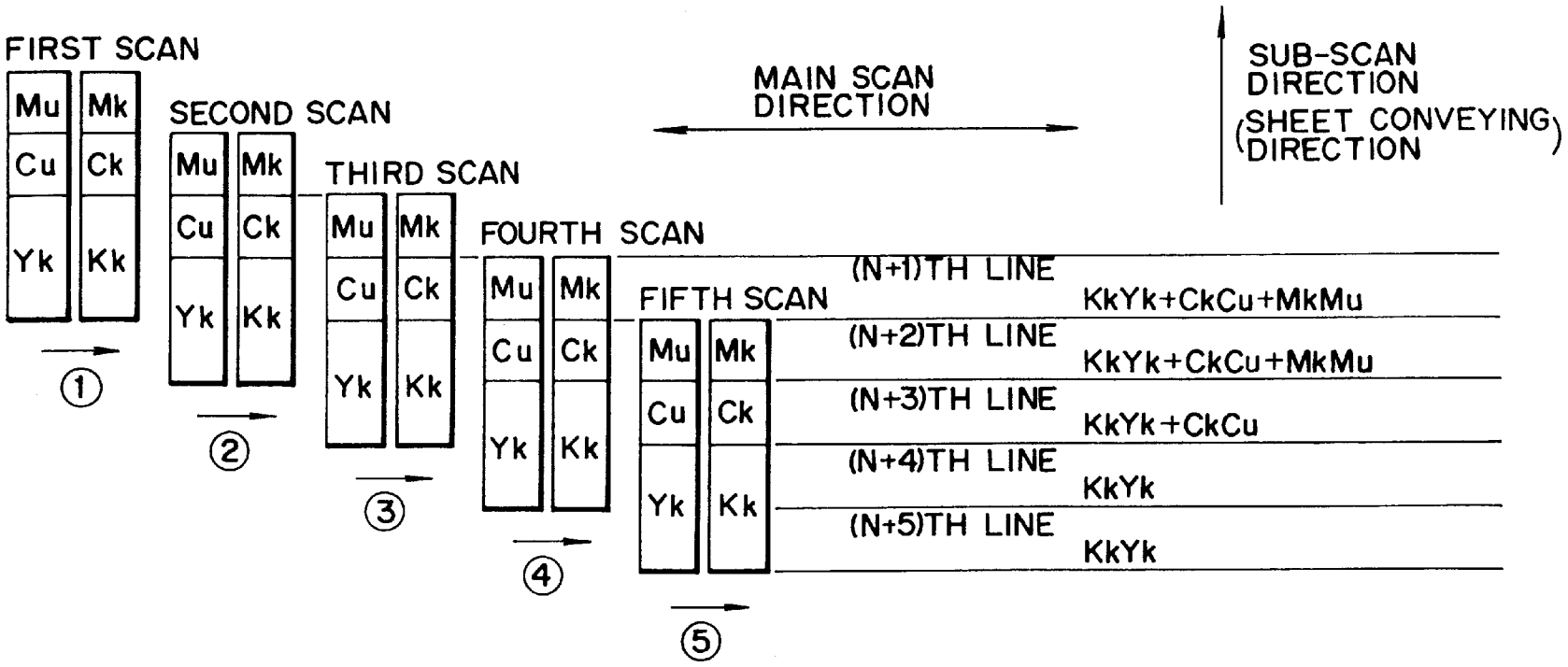
FIG. 16 is a view illustrating the formation process of an image by use of the ink jet recording units having the discharge port array shown in FIG. 14B.

FIG. 16 is a schematic view showing the image formation process by use of the recording head arranged as shown in FIG. 14B.

Now, giving attention to the Nth+one line, it is understandable that a recording for dark black Kk and dark yellow Yk and an LF are executed by a second scan; a recording for dark cyan Ck and light cyan Cu and an LF are executed by a third scan; and a recording for dark magenta Mk and light magenta Mu and an LF are executed by a fourth scan, thus completing the recording of the Nth+one line. The amount of LF after each of the recording scans is equivalent to the width of the 32 discharge port array portion, and the image recording for the 32 discharge port array portion is executed by the three-time recording scans.

In this respect, the recording in dark yellow and dark black is executed every other scans, and a recording of 64-discharge port portion is executed at a time, which is twice as much compared to the one for magenta and cyan.

Also, by arranging the structure like this, it is possible to obtain an advantage that when recording letters in black or a monochrome image, the recording speed can be enhanced by varying the amount of LF to a portion equivalent to a 64-dot width.

Figure 14C:
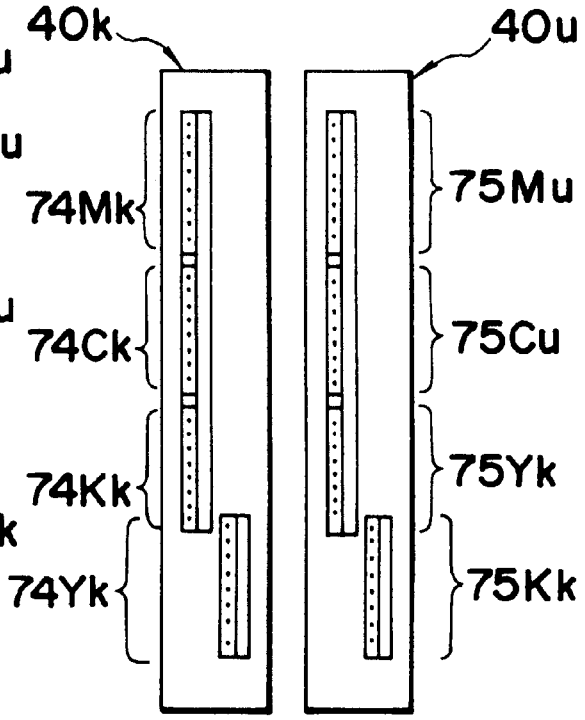

FIG. 14C is a view showing an example of still another structure of the ink jet units.

In the example shown in FIG. 14C, two ink jet units are used, having ink discharge port arrays for yellow, magenta, cyan, and black, each for the dark ink use and for the light ink use, respectively. However, for yellow and black, both ink jet units use dark ink.

In FIG. 14C, the reference numerals 74Yk, 74Kk, 74Mk, and 74Ck of the ink jet unit 40*k* designate the discharge port arrays to discharge the dark ink of yellow, black, magenta and cyan, respectively.

The reference numerals 75Mu and 75Cu of the ink jet unit 40*u* designate the discharge port arrays to discharge the light ink of magenta and cyan, respectively; and 75Kk and 75Yk, the discharge port arrays to discharge the dark ink of black and yellow, respectively.

In the same way as the structure described earlier, this structure is arranged so that only the dark ink is used for yellow because, having a high brightness, yellow does not make the graininess of its dots conspicuous in the bright image portion, and also for black because it is applied only to the high density portion of an image, making its graininess not conspicuous, either.

For the structure shown in FIG. 14C, the dark and light distribution table shown in FIG. 10A is applicable to yellow and black, and the one shown in FIG. 10B, to magenta and cyan.

The discharge port array for each color has 32 discharge ports at a pitch of 360 dots per inch (360 dpi), and there is a space equivalent to an eight-dot portion provided by the walls of the liquid chamber for each of the colors between each of the discharge port arrays for the respective colors. The discharge port arrays for black and yellow use the two ink jet units, thus having the number of its discharge ports two times the one for other colors. Therefore, a recording for a 64-dot portion is possible at a time. Also, in order to avoid any creation of blank between the yellow and black discharge port arrays for each of the ink jet units, the discharge port arrays for yellow and black are displaced in the unit configuration.

Figure 17:
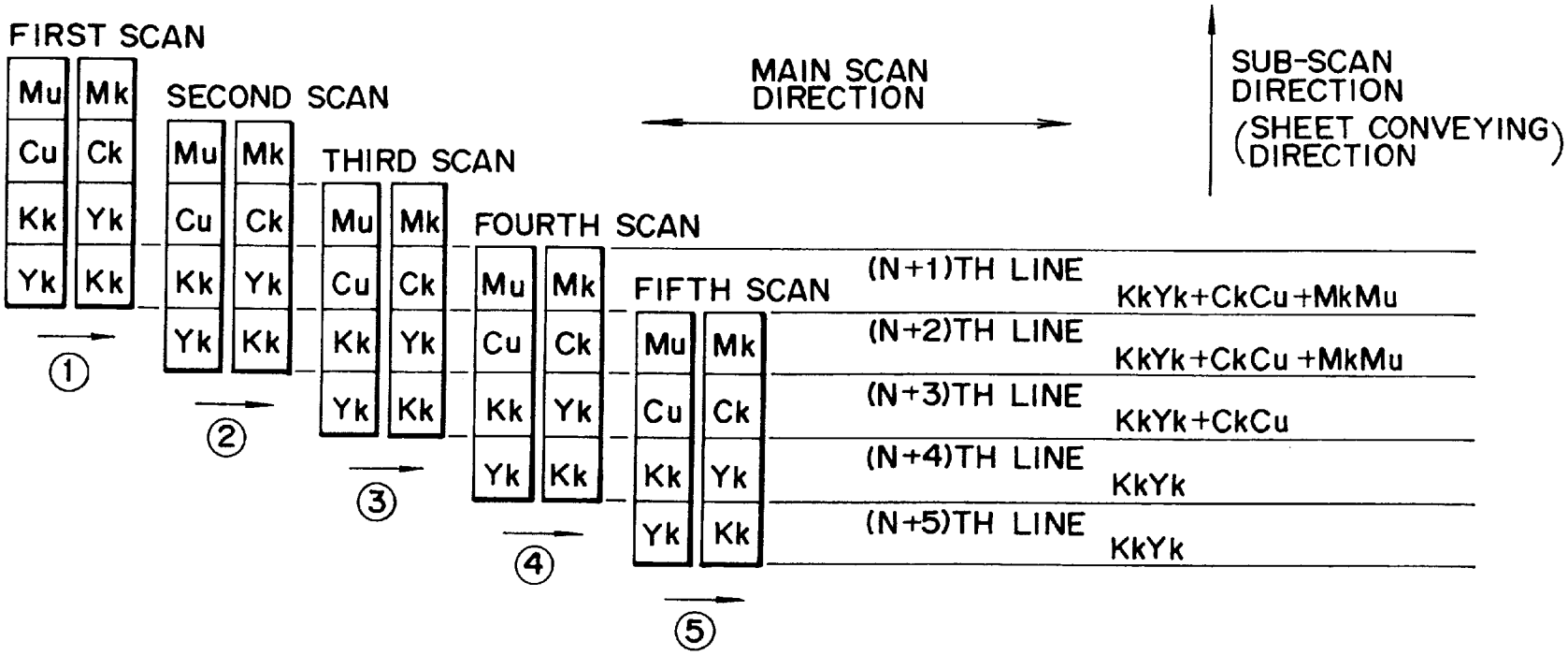
FIG. 17 is a view illustrating the formation process of an image by use of the ink jet recording units having the discharge port array shown in FIG. 14C.

FIG. 17 is a schematic view showing the image formation process by use of the ink jet recording units structured as shown in FIG. 14C.

Now, giving attention to the Nth+one line, it is understandable that a recording for dark black Kk and dark yellow Yk and an LF are executed by a second scan; a recording for dark cyan Ck and light cyan Cu and an LF are executed by a third scan; and a recording for dark magenta Mk and light magenta Mu and an LF are executed by a fourth scan to complete an image by a three-time recording scans. The amount of LF after each of the recording scans is equivalent to a portion of the 32-discharge port width, and the image of 32-discharge port array portion is recorded by three-time recording scans.

The recordings in dark yellow and dark black are executed every other scans, the second and fourth scans, according to the example shown in FIG. 17. Compared to magenta and cyan, a recording for a 64-dot portion, which is twice as much, is executed at a time by use of the discharge port arrays in the two ink jet units.

With this structure, the amount of LF can be varied to a portion equivalent to a 64-dot width when recording letters in black or a monochrome image, making it possible to enhance the recording speed.

In any one of the above-mentioned structural examples shown in FIGS. 14A, 14B, and 14C, the recording in all the colors is not executed at a time in its process. Therefore, it is possible to obtain an excellent image having a lesser image deterioration due to ink blur or the like. Further, in an actual ink jet units, there are spaces between each of the discharge port arrays for the respective colors. As a result, unlike the description made in each of FIGS. 14A, 14B and 14C, the positions in which the recording scans for each of the colors are joined are not identical in the recordings of the respective colors. The positions differ from each other. As a result, it is possible to obtain an effect to reduce the creation of the joint streaks due to the recording scans.

With the ink jet units having ink discharge ports to discharge ink of different colors from the one and the same discharge port formation surface, which is arranged by the provision of divided liquid chambers as in the present embodiment, the number of ink jet units (recording heads) as well as the number of ink cartridges can be reduced, thus making it possible to miniaturize the apparatus.

Also, the ink jet units used for the present embodiment enables the discharge port arrays for different colors to be fabricated on one and the same discharge port surface in a good precision at a low cost. Therefore, a higher precision and more complicated correction control, which are required for the manufacture of a conventional apparatus, are no longer needed, thus making the provision of a low price possible.

In this respect, it is preferable for the ink jet units used for the present embodiment to arrange the discharge port arrays for each of the colors on one and the same straight line in order to reduce the steps required for the correction of the ink discharge timing. However, the arrangement is not necessarily limited to the present embodiment. It may be possible to arrange them horizontally or in cross and counter-cross wise.

Also, in the present embodiment, a plurality of discharge ports to discharge each of color ink or ink each having different densities, which are provided for the ink jet units 40, are called "discharge port array". However, the term "discharge port array" is defined for the sake of expression, and it may be possible to call the collection of plural discharge ports a "discharge port group".

Also, as described in the present embodiment, it is possible to enhance the recording speed by varying the number of discharge ports per color as required.

Further, the ink cartridges according to the present embodiment are also mounted on the carriage as in the case of the ink jet units, but it may be possible to form them integrally with the ink jet units or arrange them so that the cartridges are not mounted on the carriage but to supply ink to the ink jet units through ink supply tubes. Also, it is preferable for the miniaturization of the apparatus to use the cartridges having a plurality of color ink by dividing its interior as in the present embodiment, but it may be possible to use ink cartridges each for a single color without dividing the interior of the cartridge.

Second Embodiment

Now, the description will be made of a second embodiment according to the present invention.

The controlling structure and image signal processing for the color ink jet recording apparatus according to the present embodiment are the same as those described in the foregoing embodiment. Here, the description thereof will be omitted.

Printer Unit

Figure 18:
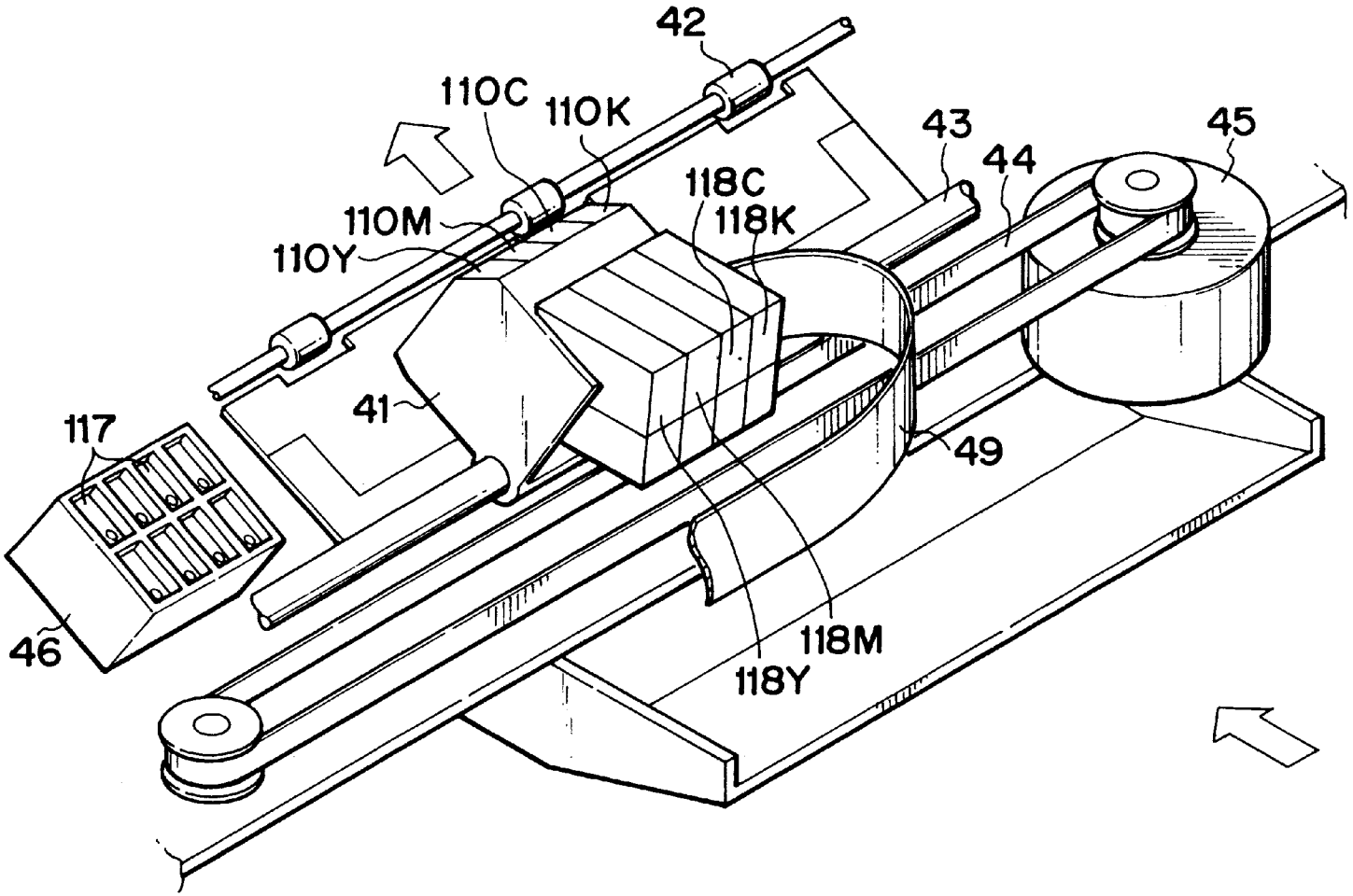
FIG. 18 is a perspective view showing the principal structure of a color ink jet recording apparatus according to an embodiment of the present invention.

FIG. 18 is a perspective view showing the principal structure of a color ink jet recording apparatus according to the present embodiment. For the same elements as those shown in FIG. 11, the same reference marks are provided, and the description thereof will be omitted. The same is applicable to FIG. 19 and FIG. 20 which will be shown below.

In the present structure, ink discharge port arrays are arranged for ink jet units 110 for each of colors to discharge the dark ink and light ink, respectively. Each of the ink jet units 110K, 110C, 110M, and 110Y are arranged on a carriage 41 at intervals of a given distance in the recording scan direction.

Ink Jet Units

Figure 19:
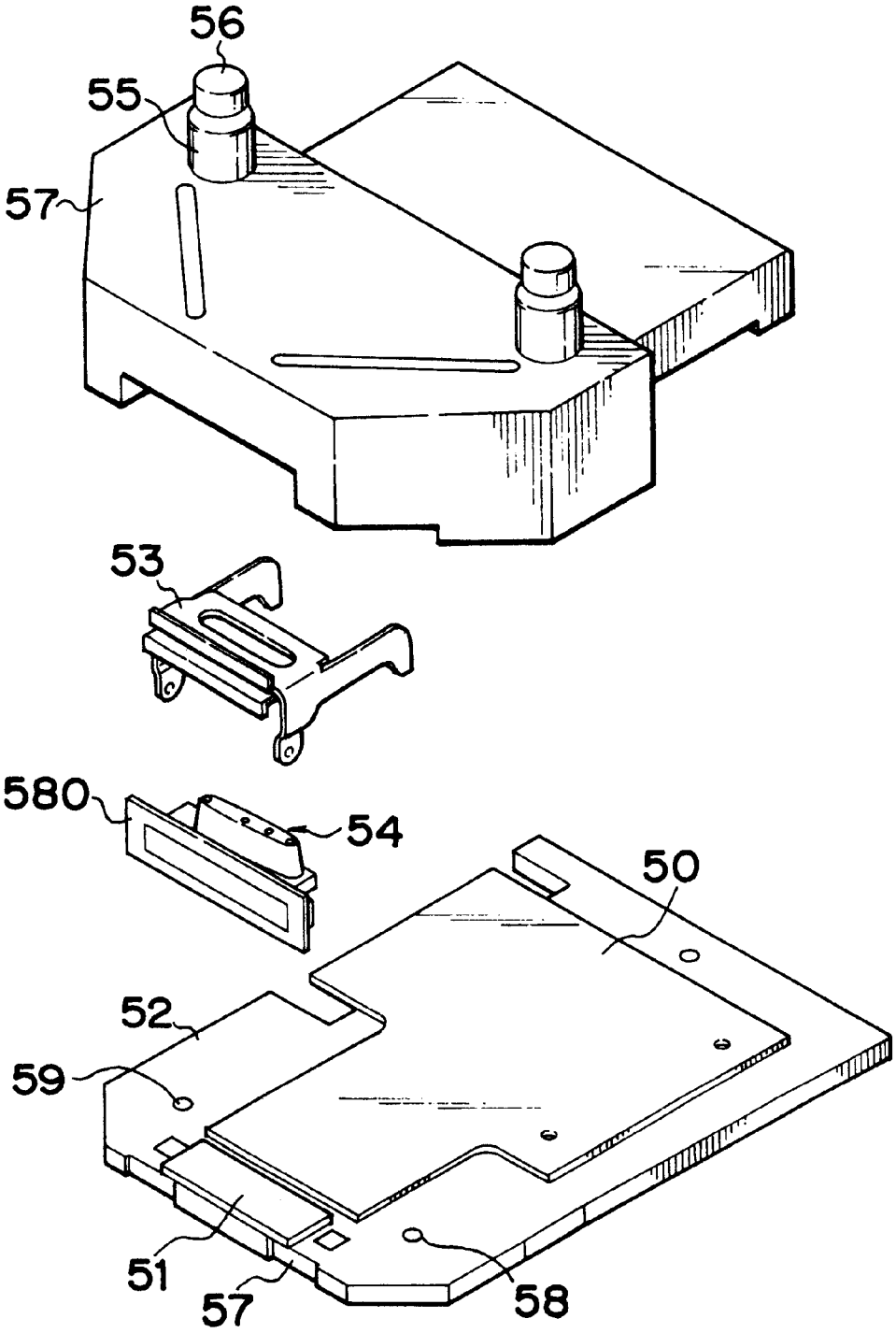
FIG. 19 is an exploded perspective view showing the structure of the ink jet units in the ink jet recording apparatus shown in FIG. 18.

FIG. 19 is an exploded perspective view showing the structure of the ink jet units 110K, 110C, 110M, and 110Y, which is almost the same as the structure shown in FIG. 12 with the exception of the grooved ceiling board 54.

Figure 20:
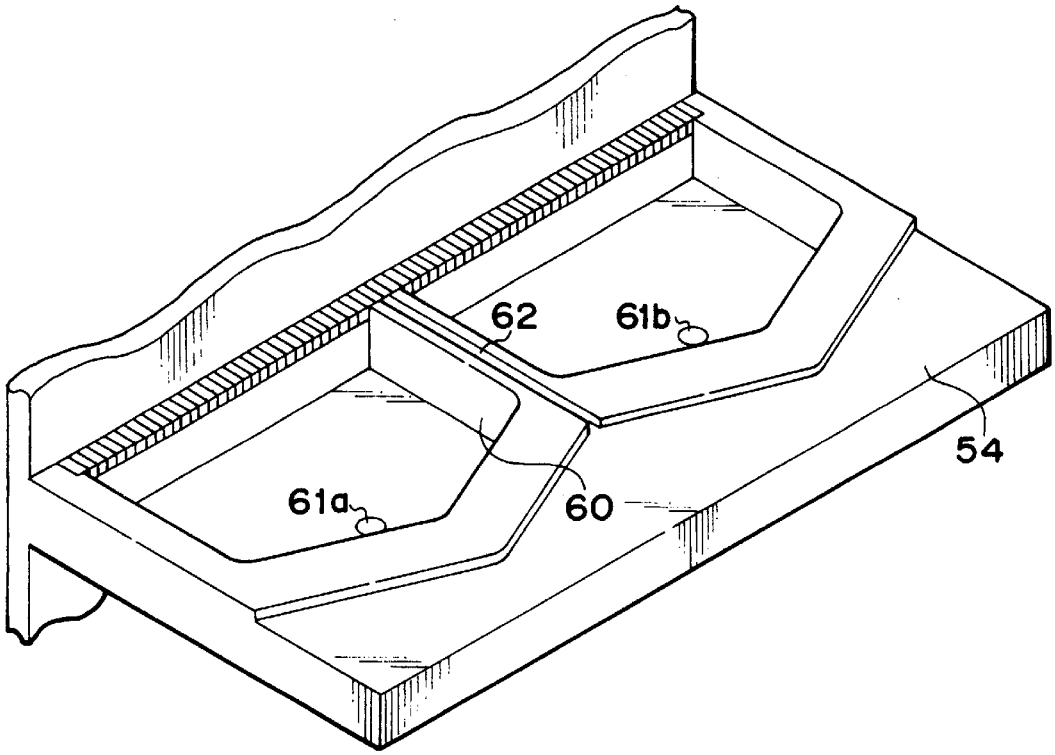
FIG. 20 is a perspective view showing the grooved ceiling board of the ink jet recording apparatus according to an embodiment of the present invention.

FIG. 20 is a perspective view showing the grooved ceiling board 54 of the ink jet units used for the present embodiment observed from the heater board 121 side. In the present embodiment, two common liquid chambers are provided for the dark ink use and the light ink use, and each of the liquid chamber is partitioned by walls 60. In each of the liquid chambers, supply inlets 61*a* and 61*b* are provided to supply the dark and light ink, respectively.

Figure 21:
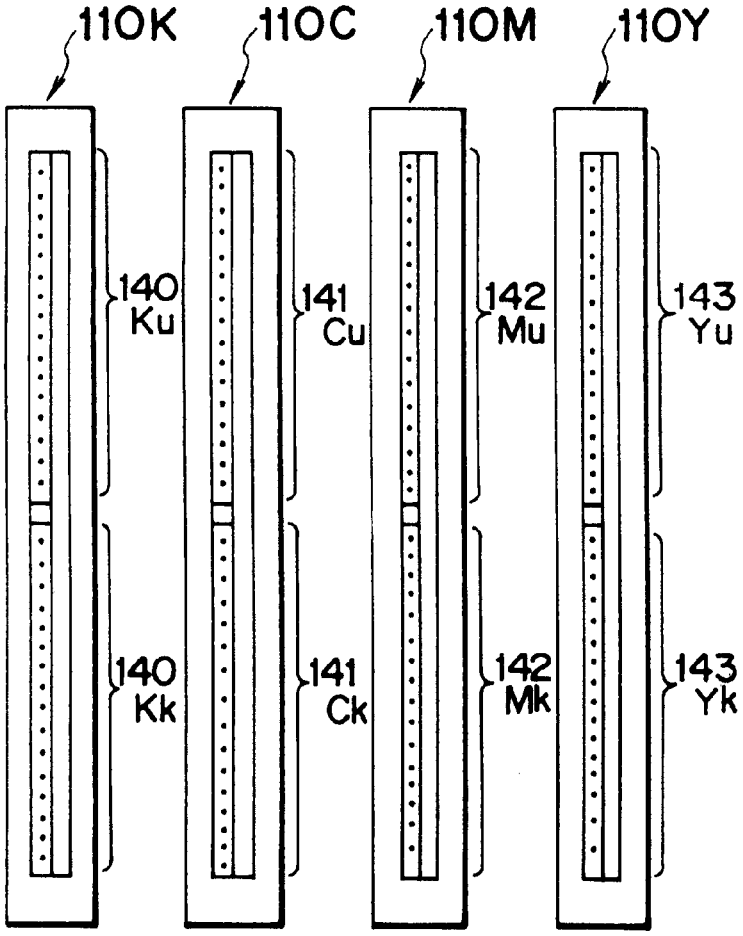
FIG. 21 and FIG. 23 are views schematically showing an example of discharge port arrays each for dark ink and light ink arranged in one and the same ink jet unit.

FIG. 21 is a view showing the ink jet discharge arrays of the above-mentioned ink jet units observed from a recording material side. In the present embodiment, one and the same ink jet unit has the ink discharge port arrays each for the dark ink use and light ink use, and such an ink jet unit is used for each of ink, yellow, magenta, cyan, and black, respectively.

In FIG. 21, the reference numerals 143Yu, 142Mu, 141Cu, and 140Ku designate the discharge port arrays to discharge the light ink, and 143Yk, 142Mk, 141Ck, and 140Kk, the discharge port arrays to discharge the dark ink.

Each of the discharge port arrays corresponding to each of the dark and light ink has 64 discharge ports at a pitch of 360 dots per inch (360 dpi), and there are spaces each equivalent to a portion of eight-discharge ports provided by the walls of the common liquid chambers between each of the colors.

Figure 25:
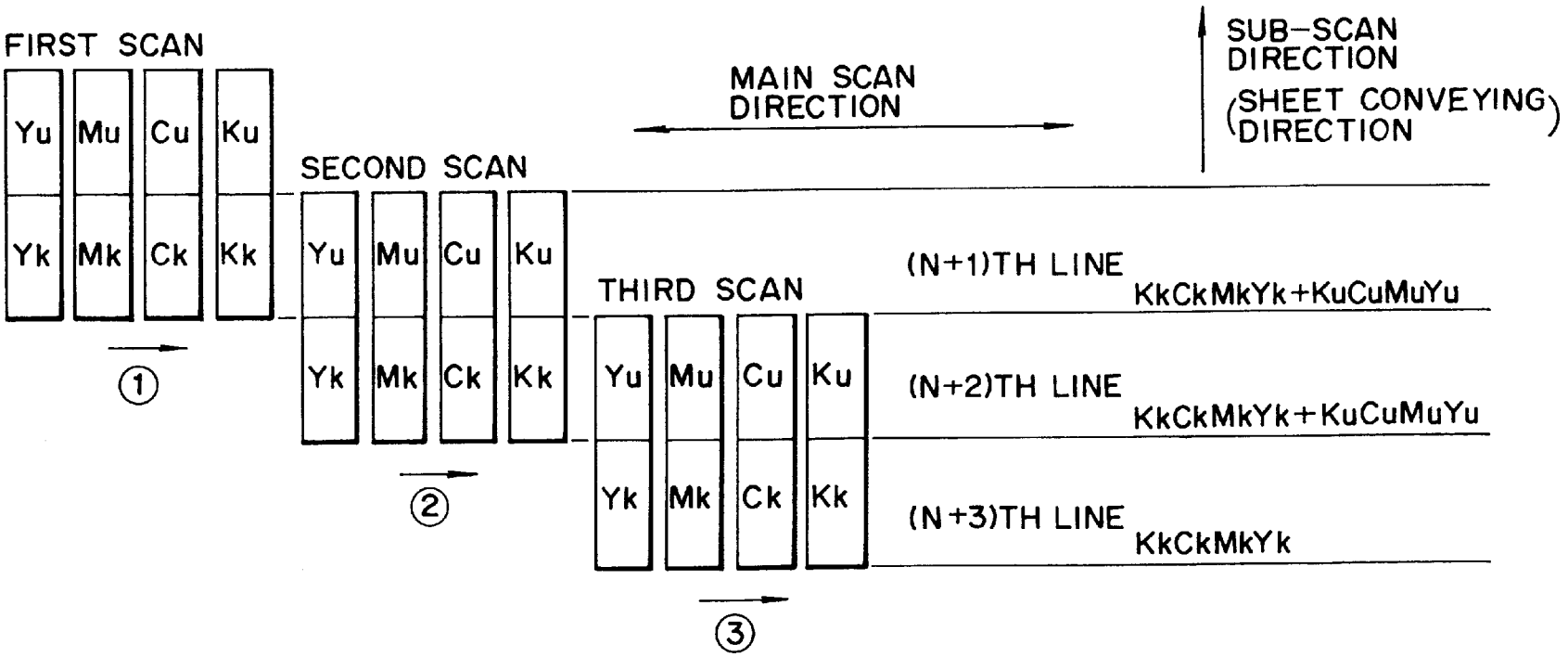
FIG. 25 is a view illustrating the formation process of an image by use of the ink jet units having the ink jet discharge port arrays shown in FIG. 21.

FIG. 25 is a schematic view showing the image formation process by use of the ink jet units shown in FIG. 21.

Now, giving attention to the recording operation of the Nth+one line, it is understandable that a recording for dark black, dark cyan, dark magenta, and dark yellow and an LF are executed by a first scan; and a recording of light black, light cyan, light magenta, and light yellow and an LF are executed by a second scan. The recording on the Nth+one line is completed by two-time recording scans just by the first and second scans, and at this juncture, the amount of LF after each of the recording scans is equivalent to a 64-discharge port portion; thus recording the image equivalent to a portion of the 64-discharge port array by the two-time recording scans.

Figure 22:
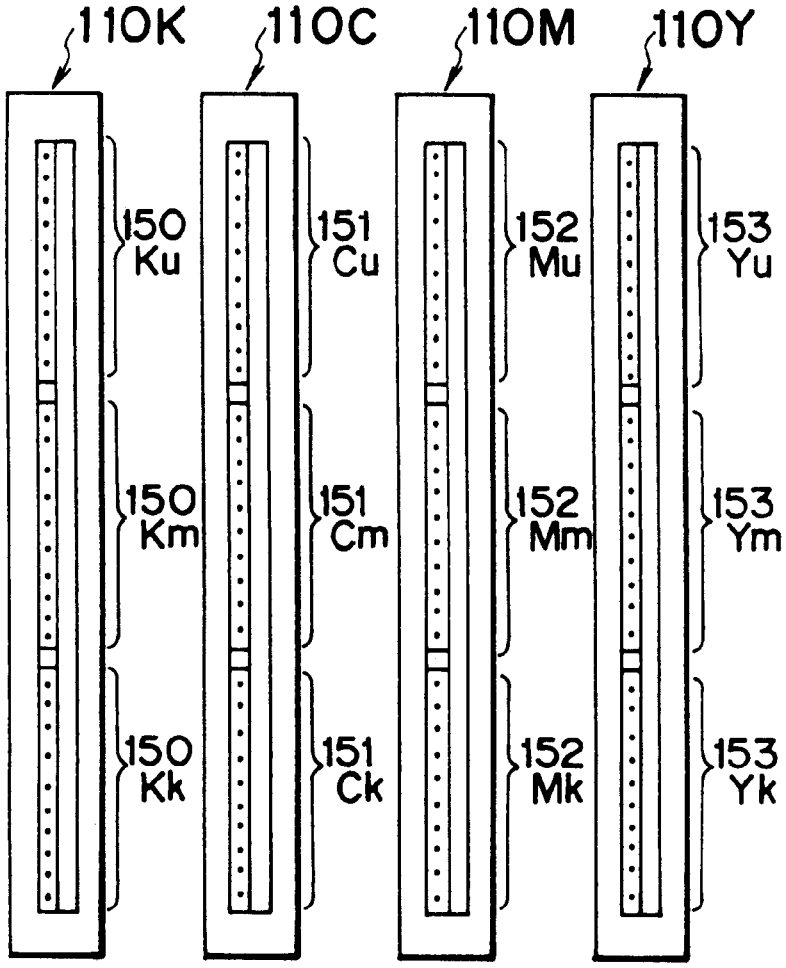
FIG. 22 is a view schematically showing an example of discharge port arrays each for dark ink, light ink, and medium ink arranged in one and the same ink jet unit.

FIG. 22 is a schematic view showing another structural example of the ink jet units.

In the present example, one and the same ink jet unit has ink discharge port arrays for dark ink use, medium ink use, and light ink use, respectively, and such an ink jet unit is used for each of ink, yellow, magenta, cyan, and black, respectively. For this structure, the dark and light distribution table shown in FIG. 10C is applicable.

In FIG. 22, the reference numerals 153Yu, 152Mu, 151Cu, and 150Ku designate the discharge port arrays to discharge the light ink; 153Ym, 152Mm, 151Cm, and 150Km, the discharge port arrays to discharge the medium ink; and 153Yk, 152Mk, 151Ck, and 150Kk, the discharge port arrays to discharge the dark ink.

Each of the discharge port arrays corresponding to ink having each of the densities has 32 discharge ports at a pitch of 360 dots per inch (360 dpi), and there is a space equivalent to a portion of eight dots provided by the walls of the common liquid chambers between each of the colors.

In the present example, a recording for dark black, dark cyan, dark magenta, and dark yellow, and an LF are executed by a first scan; a recording for medium black, medium cyan, medium magenta, and medium yellow, and an LF are executed by a second scan; and a recording of light black, light cyan, light magenta, and light yellow, and an LF are executed by a third scan, thus completing an image by three-time recording scans. The amount of LF after each of the recording scans is equivalent to a 32-discharge port portion, and the image for a potion of the 32-discharge port arrays is recorded by the three-time recording scans.

As in the present structure, if ink having the medium density is used in addition to the dark and light ink, the graininess becomes less conspicuous in all the tonal areas. Further, it becomes possible to switch over ink having each of the densities smoothly, thus preventing the false contours to be created to enable a smoother tonality to be reproduced.

Figure 23:
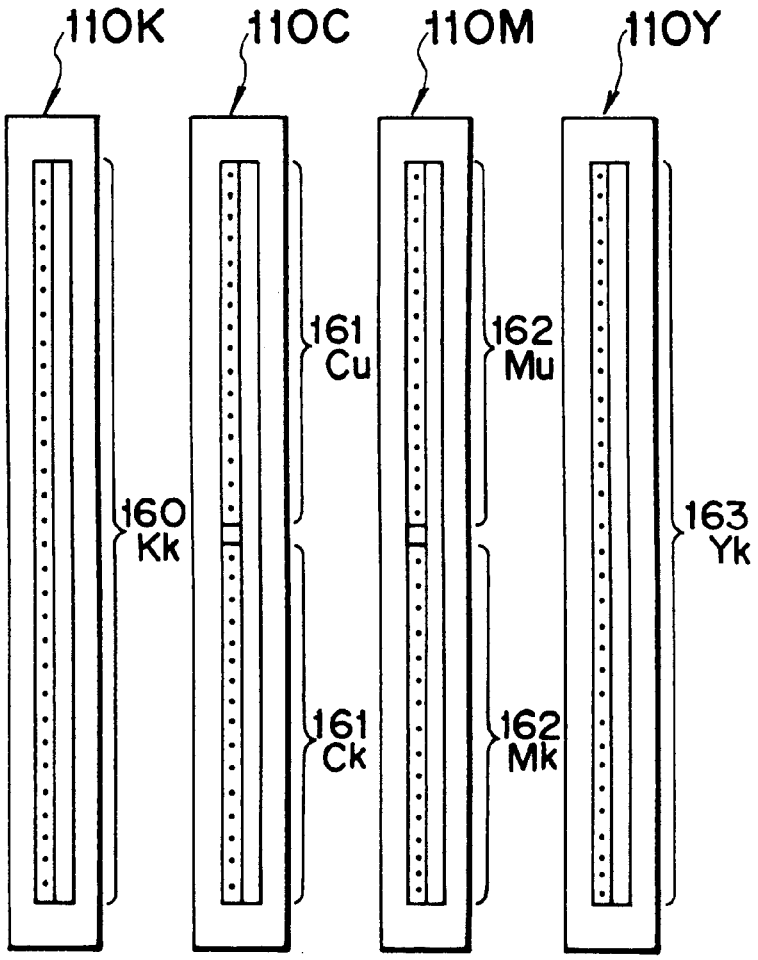

FIG. 23 is a schematic view showing still another structural example of the ink jet units.

In the present example, there are used in combination one and the same ink jet unit having ink discharge arrays each for the dark ink use and the light ink use, and the ink jet unit having ink discharge port arrays each for a monochromic color.

In FIG. 23, the reference numerals 162Mu and 161Cu designate the discharge port arrays to discharge the light ink, and 163Yk, 162Mk, 161Ck, and 160Kk, the discharge port arrays to discharge the dark ink. The number of discharge ports in the discharge port arrays 160Kk and 163Yk are two times the number of discharge ports for the other colors.

Since an yellow image has a high brightness, and no dot graininess is conspicuous in the bright image part, and also, a black image is used only for a part having a high density, and its graininess is not conspicuous, either, only the ink each having high densities are used for black and yellow. For the present structure, the dark and light distribution table shown in FIG. 10A is applicable to yellow and black, and the one shown in FIG. 10B is applicable to magenta and cyan.

Figure 26:
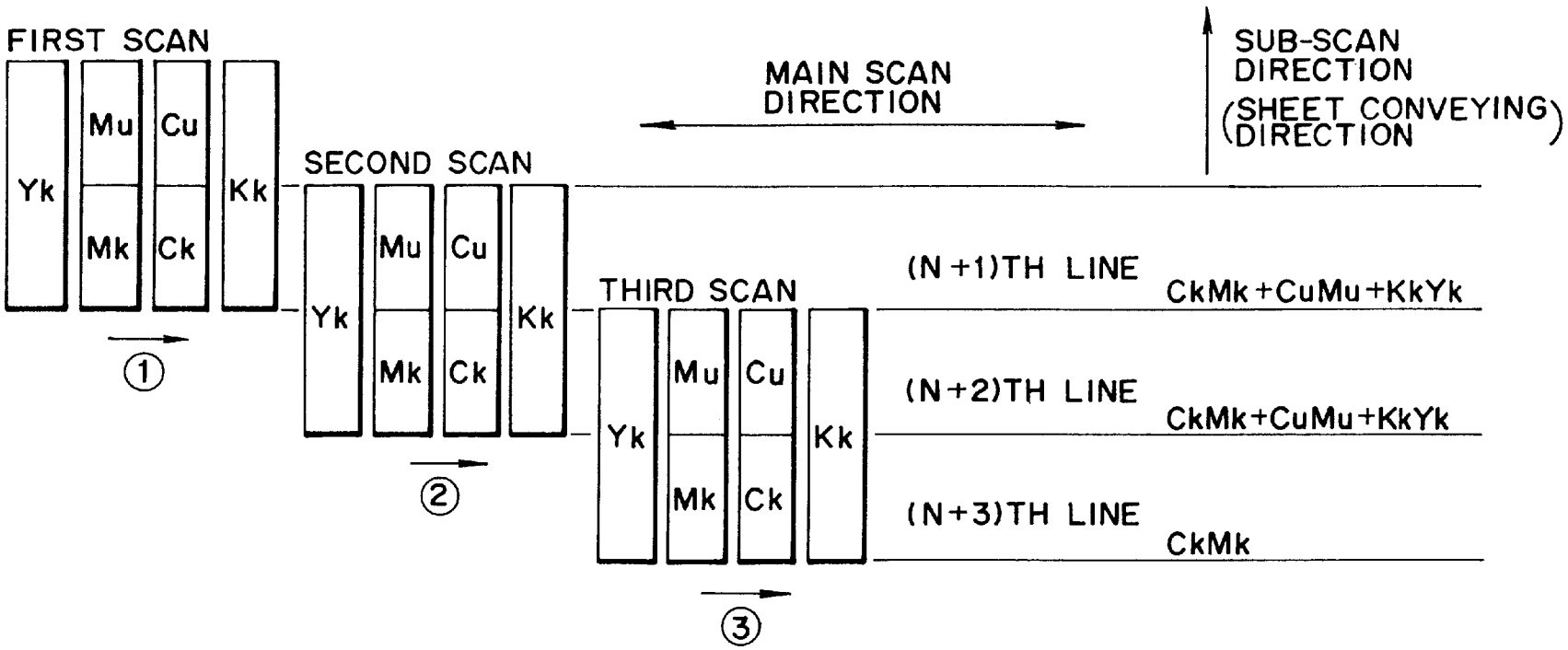
FIG. 26 is a view illustrating the formation process of an image by use of the ink jet units having the ink jet discharge port arrays shown in FIG. 23.

FIG. 26 is a schematic view showing the image formation process by use of the ink jet units shown in FIG. 23.

In FIG. 26, giving attention to the recording on the Nth+one line, it is understandable that a recording for dark black, dark cyan, dark magenta, and dark yellow and an LF are executed by a second scan, and a recording for light cyan, and light magenta, and an LF are executed by a third scan to complete an image by two-time recording scans by the above-mentioned second and third scans. The amount of LF after each of the recording scans is equivalent to a portion of 64-discharge port arrays, and the image for the portion of the 64-discharge port arrays is recorded by the two-time recording scans.

In FIG. 26, the dark yellow and dark black are recorded only by the second scan, which is executed after every one scan, and compared to magenta and cyan, a recording for a portion of 128-discharge arrays, which is twice as much, is executed at a time.

With the present structure, it is possible to enhance the recording speed by varying the amount of LF to a portion equivalent to a 128-dot width when recording only letters in black or a monochrome image as in the embodiment described earlier.

Figure 24:
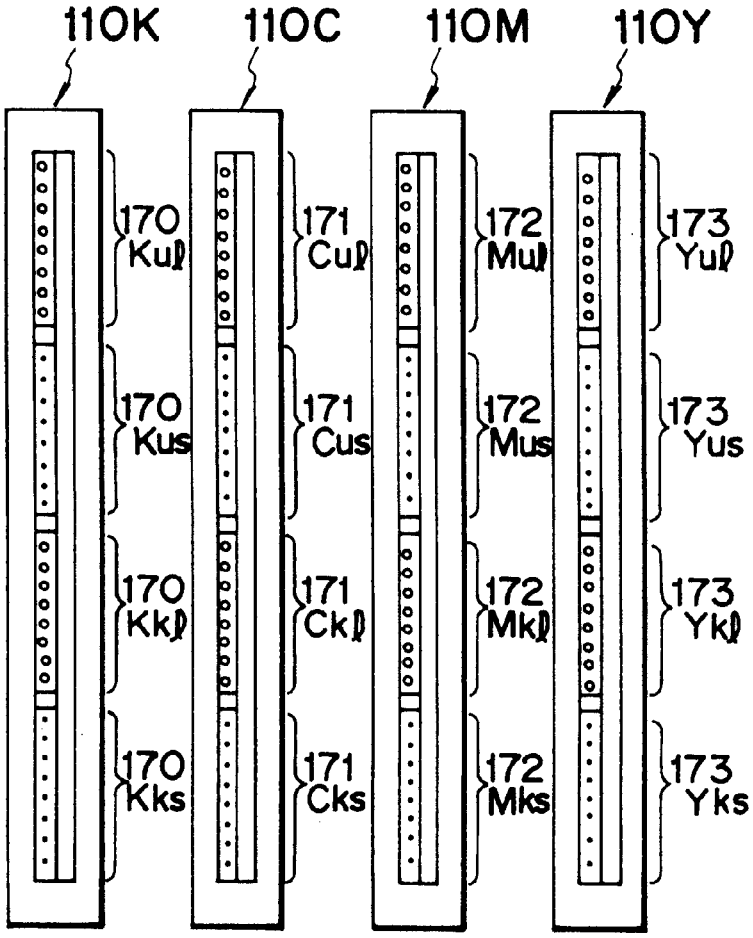
FIG. 24 is a view schematically showing the discharge port arrays for discharging ink each having different densities, and having different discharge amount per density, which are arranged in the one and same ink jet unit, respectively.

FIG. 24 is a schematic view showing a further structural example of the ink jet units.

In the present example, one and the same ink jet unit has the ink discharge port arrays each for the dark ink use and the light ink use as well as each having a different amount of ink discharge, and such a unit is used, respectively, for ink of each color having each density.

In FIG. 24, the reference numerals 173Yus, 172Mus, 171Cus, and 170Kus designate the discharge port arrays to discharge small droplets each having a small amount of discharge for the light ink of the respective colors, and 173Yul, 172Mul, 171Cul, and 170Kul, the discharge port arrays to discharge large droplet having comparatively small amount of discharge for the respective colors.

The reference numerals 173Yks, 172Mks, 171Cks, and 170Kks designate the discharge port arrays to discharge small droplets having a small amount of discharge for each of the colors of dark ink, and 173Ykl, 172Mkl, 171Ckl, and 170Kkl, the discharge port arrays to discharge large ink droplets having a comparatively large amount of discharge for each of the colors of dark ink.

The amount of a small ink droplet is approximately 20 pl, and the amount of a large ink droplet is approximately 40 pl.

Figure 27:
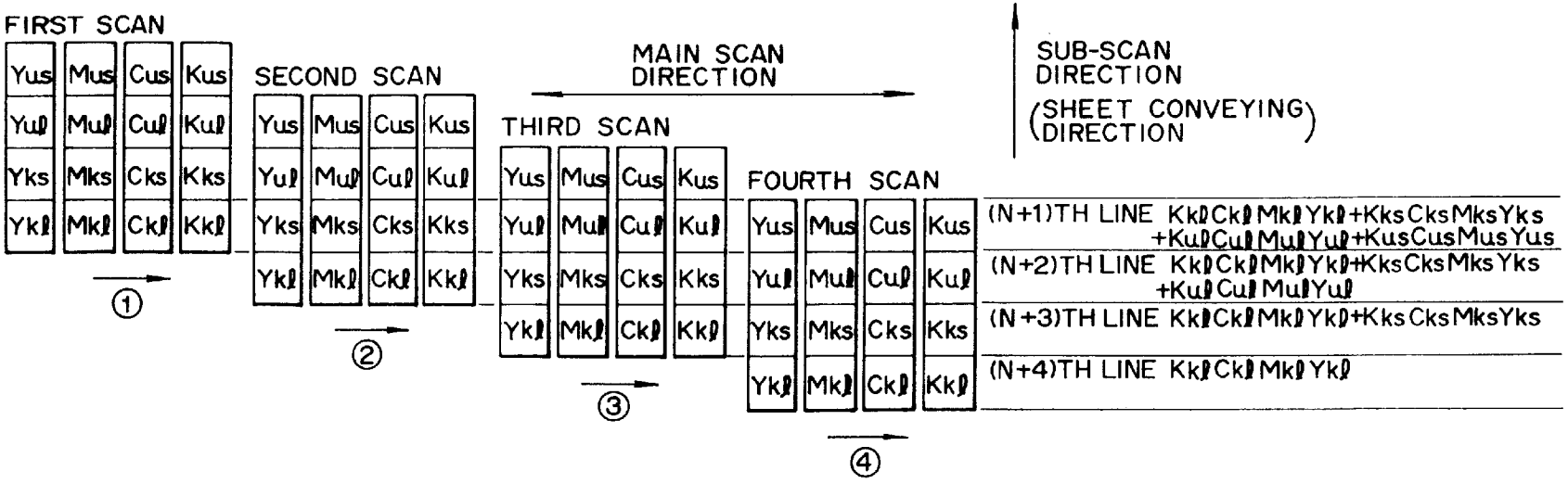
FIG. 27 is a view illustrating the formation process of an image by use of the ink jet recording units having the arrangement of ink discharge ports shown in FIG. 24.

FIG. 27 is a schematic view showing the image formation process by use of the ink jet units shown in FIG. 24.

Now, giving attention to the recording operation on the Nth+one line, it is understandable that a recording by the small droplets of dark black, dark cyan, dark magenta, and dark yellow, and an LF are executed by a first scan; a recording by the large droplets of dark black, dark cyan, dark magenta, and dark yellow and an LF are executed by a second scan; a recording by the small droplets of light black, light cyan, light magenta, and light yellow and an LF are executed by a third scan; and a recording by a large droplets of light black, light cyan, light magenta, and light yellow and an. LF are executed by a fourth scan. The above-mentioned four-time recording scans, the Nth+one line are completely recorded. The amount of LF after each of the recording scans is equivalent to a portion of 32-discharge port arrays, and the image for the portion of 32-discharge port arrays is recorded by four-time recording scans.

As in the present structure, if the discharges of ink droplets having different diameters, large and small, are combined, in addition to the dark and light ink, for recording, the graininess becomes less conspicuous in all the tonal areas. Further, it becomes possible to switch over ink each having different densities smoothly, thus preventing the false contours from being created to enable a smooth tonality to be reproduced.

In each of the above-mentioned structures, all the colors are not recorded at a time as in the foregoing embodiments, thus making it possible to obtain an excellent image having a lesser deterioration of image due to ink blur and the like. Further, in the actual ink jet units, although a complicated control is needed for the adjustment of the LF amount, the positions where the recording scans are joined between each of the colors are not identical. Unlike the descriptions in conjunction with FIGS. 21 to 24, the positions become different. As a result, it is possible to obtain an effect to reduce the creation of the joint streaks due to the recording scans.

Also, with the structure described in the present example, ink of the same color series can be grouped in one ink jet unit, making it possible to share the ink cartridge as well as to reduce the possibility of the creation of color mixture which tends to occur when a discharge recovery is executed. Particularly, by arranging the discharge port arrays for the ink having a low density (light ink) at the upper side, and those for the ink having a high density (dark ink) at the lower side, it is possible to prevent the ink mixture from taking place between different colors even if the dropping flow of ink occurs in operating the discharge recovery by suction.

As in the foregoing embodiment, the present example uses the ink jet units provided integrally with the ink discharge ports to discharge ink of different colors on one and the same discharge port formation surface by dividing the common liquid chamber; hence making it possible to reduce the number of ink jet units (recording heads) as well as the number of ink cartridges, and then, to miniaturize the apparatus. Also, the ink jet units used for the present embodiment enable the discharge port arrays for different colors to be formed on one and the same discharge port surface in a good precision at a low cost. Therefore, a higher precision and a more complicated correction control, which are required for the conventional apparatus, are no longer needed; hence making the provision of a low price possible.

In this respect, it is preferable for the ink jet units used for the present embodiment to arrange the discharge port arrays for each of the colors on one and the same straight line in order to reduce the steps required for the correction of the ink discharge timing. However, the arrangement is not necessarily limited to the present embodiment. It may be possible to arrange them horizontally or in cross and counter-cross wise.

Also, as described in the example of a variation, it is possible to enhance the recording speed by varying the number of discharge ports as required.

Further, the ink cartridges according to the example of this variation can be mounted on a carriage as in the ink jet units, but it may be possible to integrate the ink cartridges with the ink jet units or to supply ink to the ink jet units through ink tubes from the ink tank retaining each ink which is not mounted on the carriage. Also, as in the present embodiment, it is preferable to use the cartridge containing ink of plural colors by dividing its interior in order to miniaturize the apparatus, but it may be possible to use ink cartridges for each of single colors without dividing its interior.

Third Embodiment

Now, the description will be made of a third embodiment according to the present invention. In this respect, the description of any structure of a recording apparatus, which is the same as the structure described in the foregoing embodiment, will be omitted.

Figure 28:
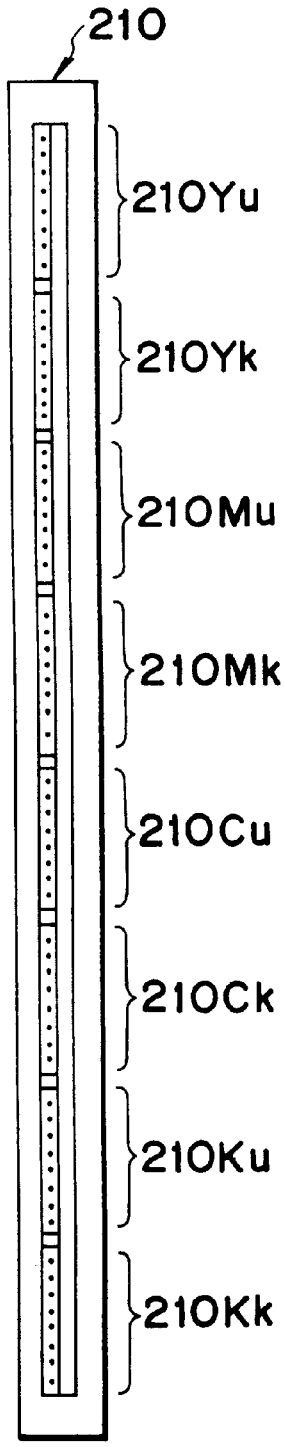
FIG. 28 is a view showing the ink jet unit having the ink jet discharge port array for all the ink colors used for recording in one and the same ink jet unit according to an embodiment of the present invention.

FIG. 28 is a schematic view of an ink jet unit according to another example of variation of the first embodiment observed from a recording material side.

The ink jet unit according to the present example uses one and the same ink jet unit in which the ink jet discharge port arrays are integrally arranged for all the ink colors to be used for recording. In the ink jet unit 210, a reference numeral 210Yu designates a discharge port array to discharge a color ink of light yellow; 210Mu, a discharge port array to discharge a color ink of light magenta; 210Cu, a discharge port array to discharge a color ink of light cyan; 210Ku, a discharge port array to discharge a color ink of light black; 210Yk designates a discharge port array to discharge a color ink of dark yellow; 210Mk, a discharge port array to discharge a color ink of dark magenta; 210Ck, a discharge port array to discharge a color ink of dark cyan; 210Kk, a discharge port array to discharge a color ink of dark black. The discharge port array for each of color ink has 32 discharge ports at a pitch of 360 dots per inch (360 dpi), and spaces each equivalent to a portion of eight dots are provided by the walls of the common liquid chambers between the discharge port arrays for the respective colors.

A recording in dark black and an LF are executed by a first scan; in light black and an LF by the next second scan; in dark cyan and an LF by a third scan; in light cyan and an LF by a fourth scan; in dark magenta and an LF by a fifth scan; in light magenta and an LF in a sixth scan; in dark yellow and an LF by a seventh scan; and in light yellow and an LF in a eighth scan. By eight-time recording scans, the recording is completed for a portion equivalent to the discharge port array in each line. The amount of LF after each of the recording scans is equivalent to a portion of 32-discharge port arrays, and the image is recorded for a portion of 32-discharge arrays by eight-time recording scans.

In the present structure, too, the recording for all the colors is not executed at a time as in the foregoing embodiments, thus making it possible to obtain an excellent image having a lesser deterioration of image due to ink blur or the like. Further, in the actual ink jet unit, there are spaces between each of the colors, and the positions where the recording scans for each of the colors are joined are not identical. Unlike the description in conjunction with FIG. 28, the position in one color differs from the other. As a result, it becomes possible to obtain an effect to reduce the creation of the joint streaks by the recording scans.

The ink jet unit according to the present embodiment enables the ink discharge port arrays for all the colors to be formed on one and the same discharge port formation surface in a good precision there is no problem of any registration deviation between each of the colors.

Also, it is preferable to arrange the discharge port arrays for all the colors on a straight line as in the present embodiment because this arrangement does not require any correction of discharge timing between the respective colors. However, the arrangement is not necessarily limited to the present embodiment. It may be made horizontally or cross and counter-cross wise.

Also, if the each of the discharge port arrays is arranged in cross and counter-cross wise, there is no need for the provision of spaces between each of the colors; making it possible to dispense with any complicated control for sheet feeding.

Also, the recording speed can be enhanced by varying the number of discharge ports as required.

As in the foregoing embodiment, the present embodiment uses the ink jet unit provided integrally with the ink discharge ports to discharge ink of different colors on one and the same discharge port formation surface by dividing the common liquid chamber; hence making it possible to reduce the number of ink jet units (recording heads) as well as the number of ink cartridges, and then, to miniaturize the apparatus. Also, a higher precision and a more complicated correction control, which are required for the conventional apparatus, are no longer needed; hence making the provision of a low price possible.

Further, although it is preferable to mount on a carriage like the ink jet unit, but it may be possible to integrate the ink cartridge with the ink jet unit or to supply ink to the ink jet unit through ink tubes from the ink cartridge which is not mounted on the carriage. Also, it is preferable to use the cartridge containing ink of plural colors by dividing its interior in order to miniaturize the apparatus, but it may be possible to use ink cartridges for each of single colors without dividing its interior.

Fourth Embodiment

Now, with reference to the accompanying drawings, the description will be made of a fourth embodiment according to the present invention.

Figure 29:
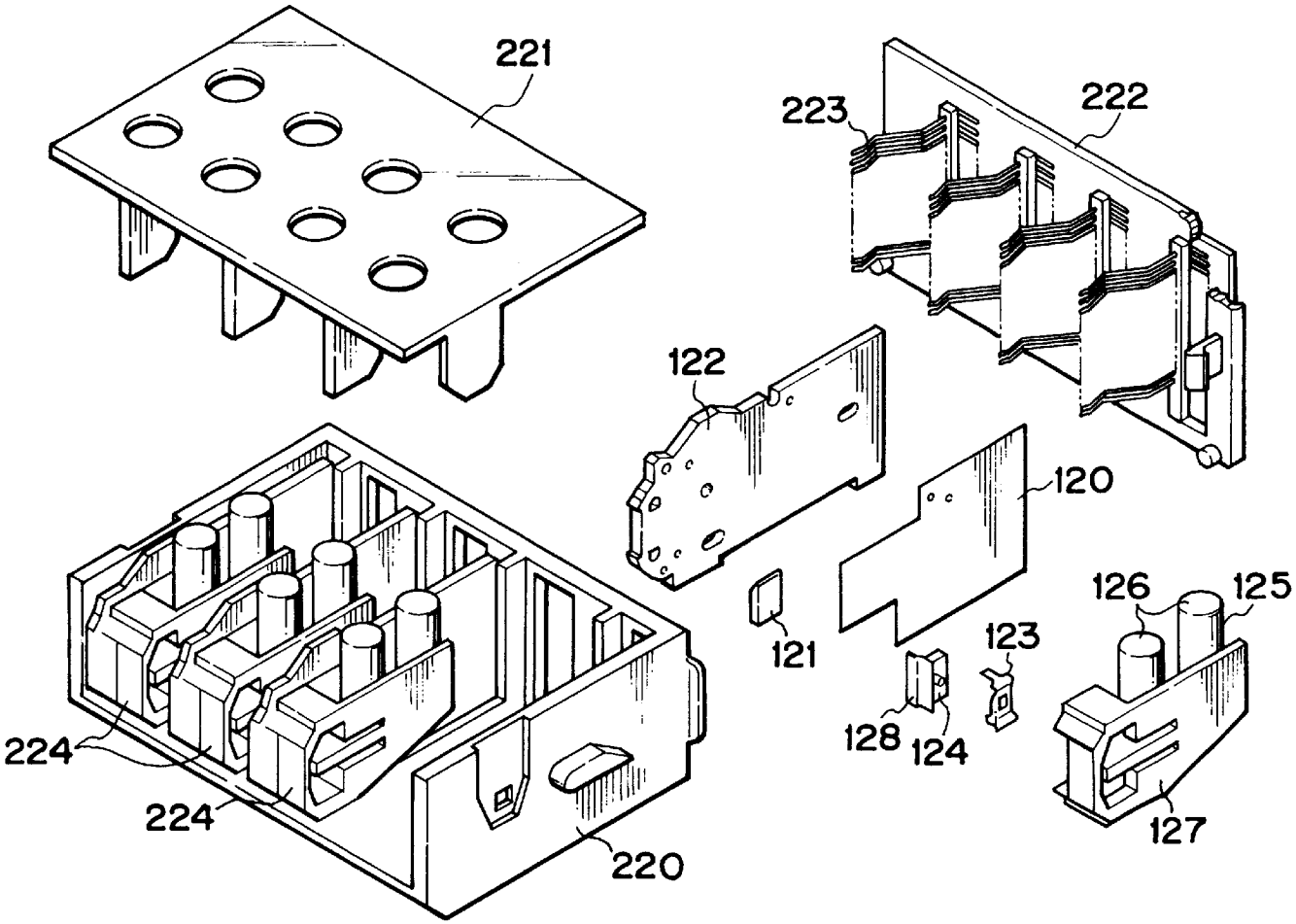
FIG. 29 is an exploded perspective view showing the integrated structure of an ink jet cartridge in which a plurality of ink jet units are integrally assembled according to an embodiment of the present invention.

FIG. 29 illustrates the structure of an integrated type ink jet cartridge in which the ink jet units 224 for four colors—yellow, magenta, cyan, and black—are integrally assembled by a frame 220.

Since the structure of the ink jet units 224 has been described in detail in the foregoing embodiments, the description thereof will be omitted here.

The four ink jet units 224 are installed in the frame 220 at given intervals, and fixed therein in a state that its registration in the direction of the discharge port arrays is already adjusted. A reference numeral 221 designates the frame cover, and 222, a connector which connects the pads provided for the wiring base board 120 of the four ink jet units 224 and electrical signals transmitted from the apparatus main body. The wiring base board 120 and the connector 222 are coupled by electrodes 223.

Figure 30:
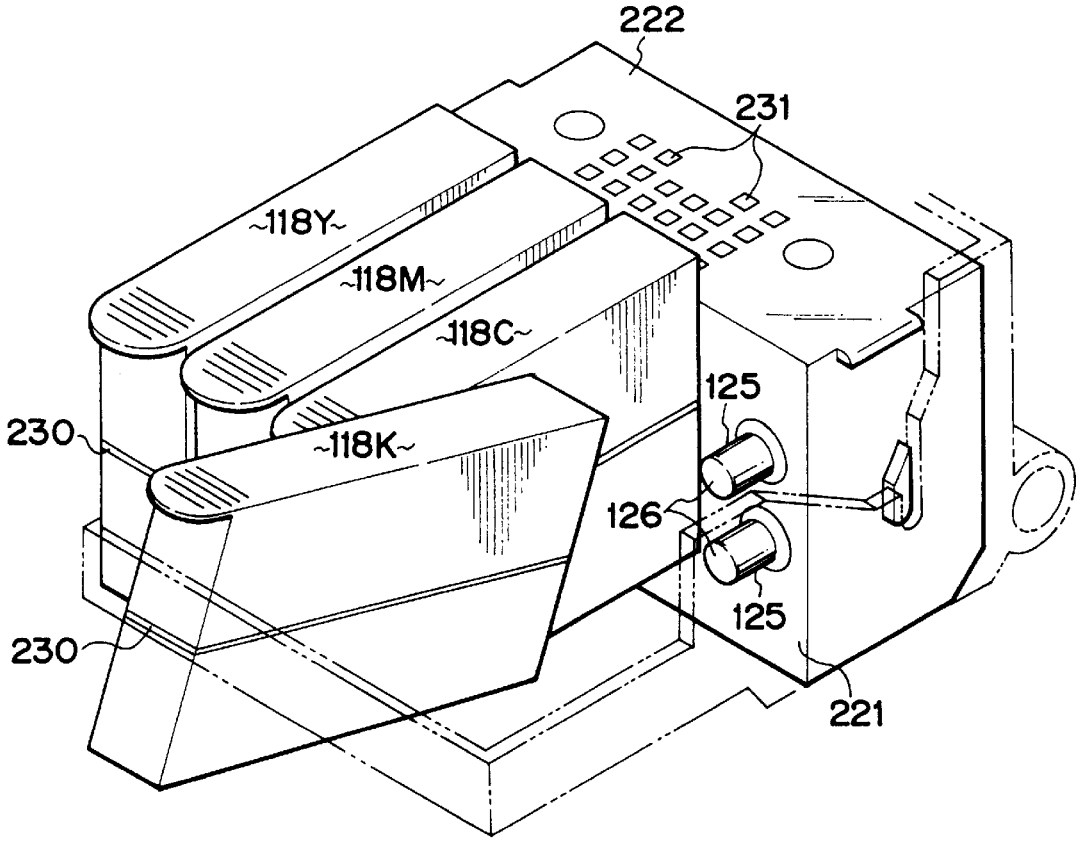
FIG. 30 is a view showing the state that an integrated ink jet cartridge is mounted on a carriage according to an embodiment of the present invention.

FIG. 30 shows a state that the above-mentioned integrated type ink cartridge 222 is mounted on a carriage.

Each of the ink tanks 118 is partitioned into two chambers, upper and lower, by a partition 230. In the upper chamber, light ink is filled while in the lower chamber, dark ink is filled. Then, on the carriage, the ink jet cartridge 222 and the four ink tanks 118 each containing yellow, magenta, cyan, and black, respectively, abut upon each other for coupling, so that ink is supplied from the ink tanks 118 to the corresponding ink discharge port arrays.

In the present structure, too, the recording for all the colors is not executed at a time as in the foregoing embodiments, thus making it possible to obtain an excellent image having a lesser deterioration of image due to ink blur or the like. Further, in the actual ink jet unit, there are spaces between each of the colors, and the positions where the recording scans for each of the colors are joined are not identical in recording in the respective colors, and the positions become different. As a result, it becomes possible to obtain an effect to reduce the creation of the joint streaks by the recording scans.

It is made possible for the integrated type ink jet units according to the present embodiment to arrange in a good precision a plurality of ink discharge port arrays formed on one and the same discharge port formation surface in a good precision for assembling an integrated cartridge. Therefore, the problem of the registration deviation between each of the ink jet units can be solved in order to reduce the load to the correction control. Also, the electrical connection can be shared by each of the ink jet units to reduce the number of connecting points with the apparatus main body.

Also, it is preferable to arrange the discharge port arrays for all the colors on a straight line as in the present embodiment because this arrangement does not require any correction of discharge timing between the respective colors. However, the arrangement is not necessarily limited to the present embodiment. It may be made horizontally or cross and counter-cross wise.

Also, the recording speed can be enhanced by varying the number of discharge ports as required.

Further, although it is preferable to mount on a carriage like the ink jet units, but it may be possible to integrate the ink cartridge with the ink jet unit or to supply ink to the ink jet units through ink tubes from the ink cartridge which is not mounted on the carriage. Also, it is preferable to use the cartridge containing ink of plural colors by dividing its interior in order to miniaturize the apparatus, but it may be possible to use ink cartridges for each of single colors without dividing its interior.

In addition, as in the foregoing embodiments, the present embodiment enables the apparatus to be miniaturized. Also, any higher apparatus precision and complicated correction control, which are required for the conventional apparatus, are no longer needed, hence making the provision of a low price possible.

Fifth Embodiment

Now, a fifth embodiment according to the present invention will be described.

In the present embodiment, a recording is executed by arranging the pixel positions to be recording by each scan so that a pixel group comprising one vertical pixel and one horizontal pixel becomes complementary by several times of scanning.

Figure 31:
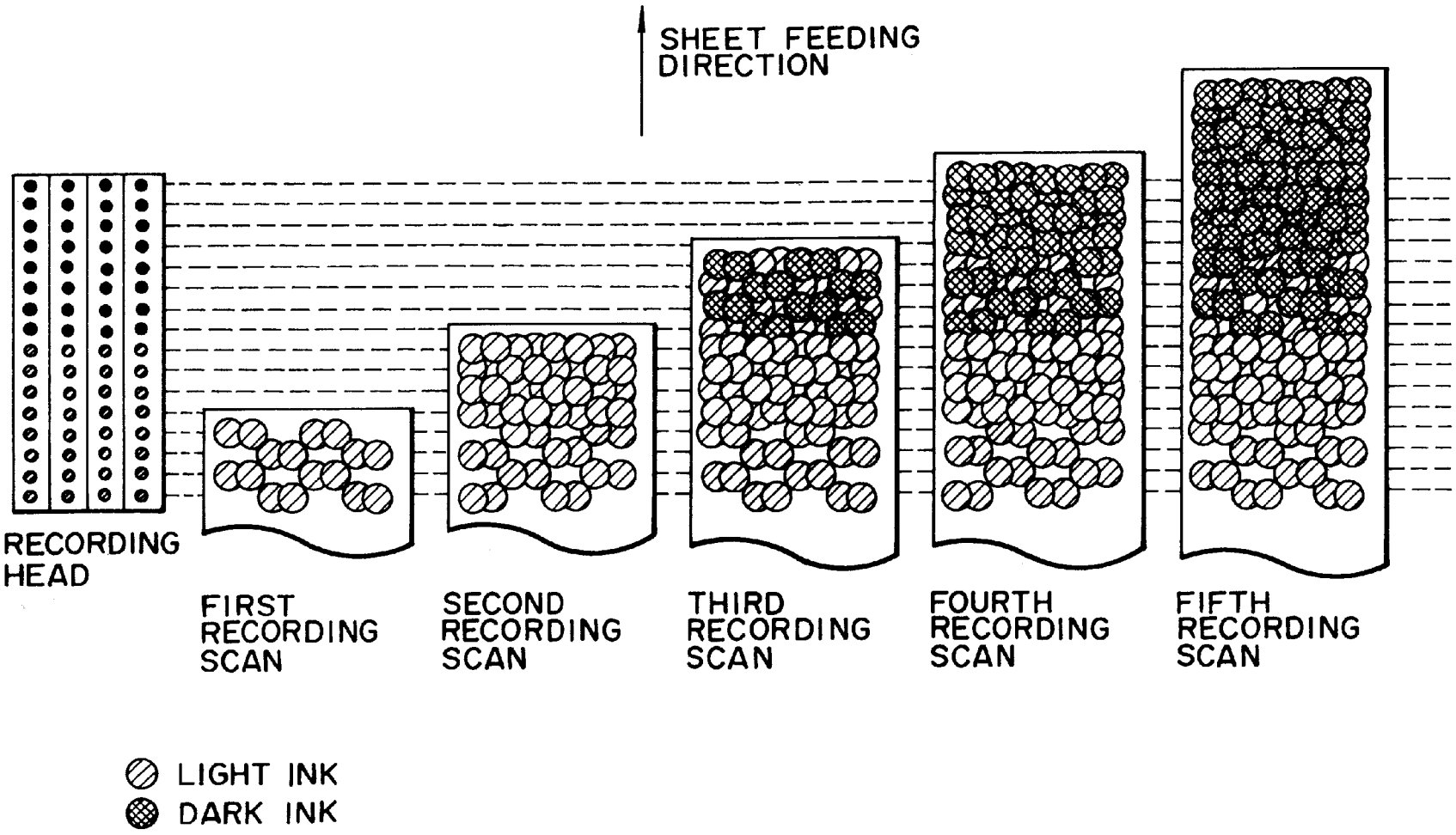
FIG. 31 is a view illustrating a state of recording according to an embodiment of the present invention.

Hereinafter, with reference to FIG. 31, the description will be made of such a recording according to the present embodiment. Here, a recording head having eight discharge ports each arranged vertically to discharge dark ink and light ink is exemplified for the description of the present embodiment. In a first recording scan, four discharge ports, in the lower half for the light ink port ion, are used among the entire 16-ink discharge port array. At this juncture, the pixel arrangement to be recorded is such that a pixel group of 1×2 pixels is arranged alternately in a cross and counter-cross form. Thus the above-mentioned discharge ports record a half of the entire pixels which can be recorded (that is, to record the pixels by thinning them to a half). After the completion of the first recording scan, a recording sheet is fed in the direction indicated by an arrow to a portion equivalent to a four-pixel width, and at the same time, the recording head unit is returned to the start position of recording by its backward operation. In the next second recording scan, a recording is executed by use of all the eight discharge ports for light ink. At this juncture, the pixels to be recorded is the area of the four-pixel width which is not recorded by the first recording scan, and the following portion in which a pixel group of 1×2 pixels is arranged in the cross and counter-cross form among the image area of the four-pixel width which follows the recorded area. This portion is in a complementary position in the area where it is superposed with the first recording scan.

The recording sheet is again fed for a portion equivalent to a four-pixel width while the recording head is returned to the start position of recording. Then a third recording scan is executed. The discharging ports used here are the entire eight discharge ports for the light ink, and the four discharge ports in the lower half of the discharge port array for the dark ink. The pixel arrangement to be recorded at this juncture are the pixel group of 1×2 pixels arranged alternately in the same manner as in the first recording scan. Thus the above-mentioned discharge ports record a half of the enter pixels by thinning them accordingly.

In the next fourth recording scan, the entire discharge ports of the recording head unit are used to record the pixels alternately arranged with 1×2 pixels by thinning reversely to the third recording scan. Then, with this recording scan, the recording required for the first pixel recording is completed. Thereafter, the recording is repeated in the same manner to compete an image.

With the divided recording method as described above, it is possible to provide an excellent image because, with the application of this method, the density unevenness due to the variation of the discharge characteristics as well as the black and white streaks due to the fluctuated feed of a recording sheet can be reduced.

In the above-mentioned embodiment, a thinned pattern in which 1×2 pixels are arranged alternately is used, but the pattern is not limited to this embodiment. It may be possible to record by use of a pattern in which the entire pixels are thinned in a cross and counter-cross form.

Further, the structure of the recording head unit is not limited to the present embodiment. Any one of the structures described in the above-mentioned embodiments may be applicable.

In this respect, all the above-mentioned embodiments can be an effective means not only for the color image recording, but also for the recording of a monochromic image such as a gray scale recording.

According to the embodiment described above, it is possible to obtain the following effects in addition to the above-mentioned various effects:

It is easy to make the registration adjustment between the dots to be recorded in each of the colors or the dark and light dots to be recorded because the discharge ports to discharge different kinds of ink, that is, in yellow, magenta, cyan, and black, or the discharge ports to discharge the same kind but dark and light ink, can be arranged on one and the same ink jet unit.

Also, in a structure in which the discharge ports to discharge each of the dark and light ink are arranged in one and the same ink jet unit as described above, the frequency of use of the dark and light ink of the same color series is substantially equal, thus making it possible to exchange the ink jet unit which is integrally formed with an ink tank without wasting ink so much.

A sixth embodiment and those given thereafter will enable the color unevenness, density unevenness, and streaks to be reduced sufficiently by utilization of the arrangement relationship of each of the ink discharge port arrays shown in each of the foregoing embodiments.

Therefore, in the embodiments given below, it is possible to use the ink jet unit which demonstrates the effects brought about by the integration of each of the ink discharge port arrays as in each of the foregoing embodiments or to use the structure which is the same as those described in the foregoing embodiments in the arrangement relationship of each of the ink discharge port arrays but each of them is not integrated.

In this respect, it is possible in the embodiments given below to assume that the apparatus structure and control structure are the same as those described in the first embodiment or in the examples of its variations.

Sixth Embodiment

Hereinafter a sixth embodiment according to the present invention will be described.

Figure 32:
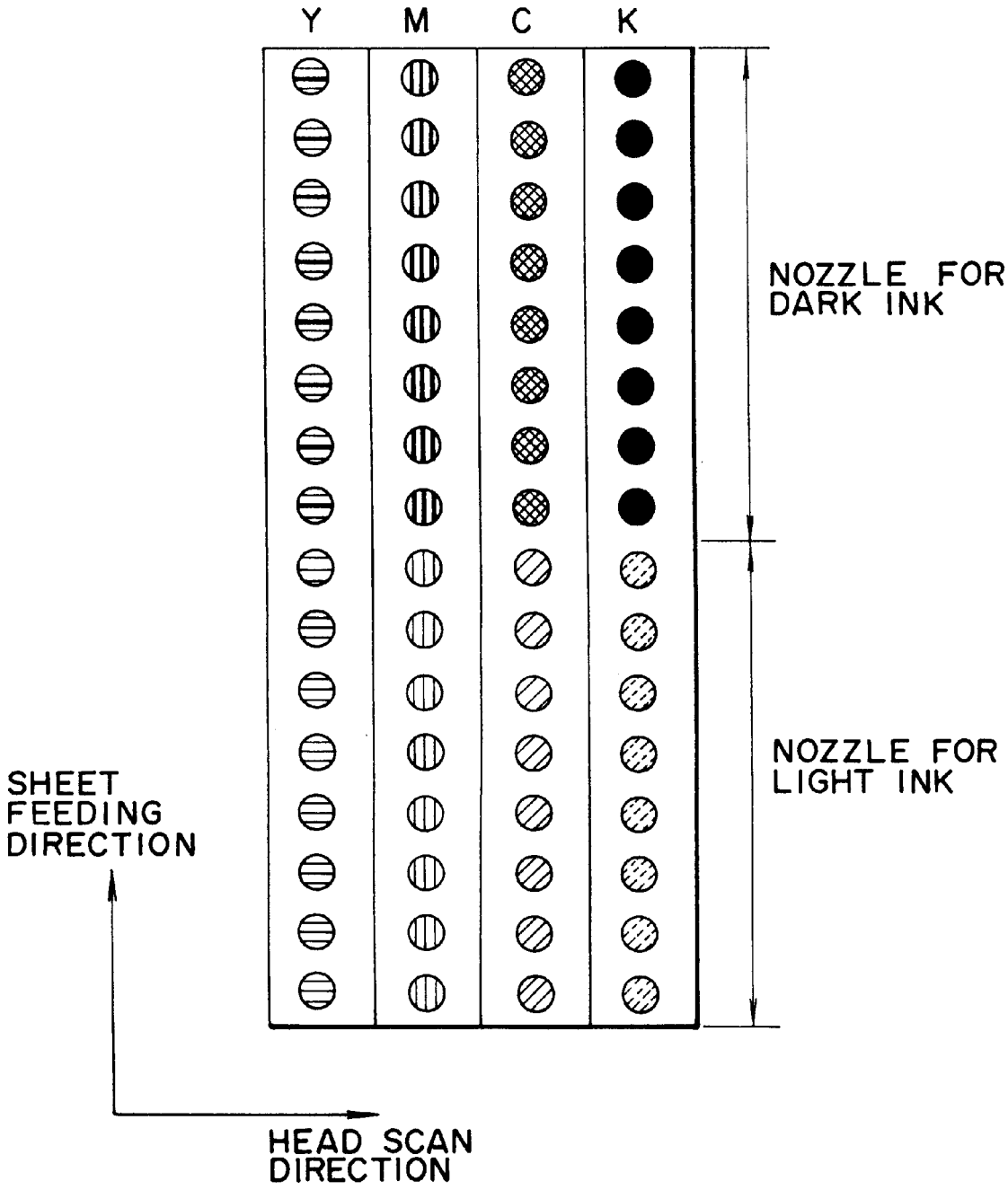
FIG. 32 is a schematic front view showing the structure of a recording head according to an embodiment of the present invention.

FIG. 32 is a schematic view showing the structure of an ink jet unit (hereinafter may be referred to as recording head) used for the present embodiment according to the present invention.

In the present embodiment, the independent recording head for each of four colors, black (K), cyan (C), magenta (M), and yellow (Y), has a total of 16 discharge ports, eight discharge ports each for the dark ink and light ink, respectively. The arrangement of the discharge ports for each of ink for this recording head is the same as the discharge port arrangement shown in FIG. 21. It may be possible to integrate each of the discharge port arrays.

In the directions indicated by arrows in FIG. 32, the recording scan and sheet feeding are executed. The sheet feed is an amount equivalent to a portion of four-discharge port width per recording scan. According to the structure of the present embodiment, the recording sheet is fed in the direction from the light ink recording area to the dark ink recording area. Therefore, the recording is always executed in such an order that the dark ink image is recorded after the completion of the recording of the light ink image. If the structure is arranged in this way so that the discharge port arrays are arranged in one line in the sheet feeding direction for each of the dark and light ink, there is no possibility that the order in which each of the dark and light ink is impacted is not reversed in the bidirectional recording, forward and backward paths. As a result, it is possible to prevent the dark and light unevenness from being created in advance due to the order of impacting ink each having different densities.

Figure 1:
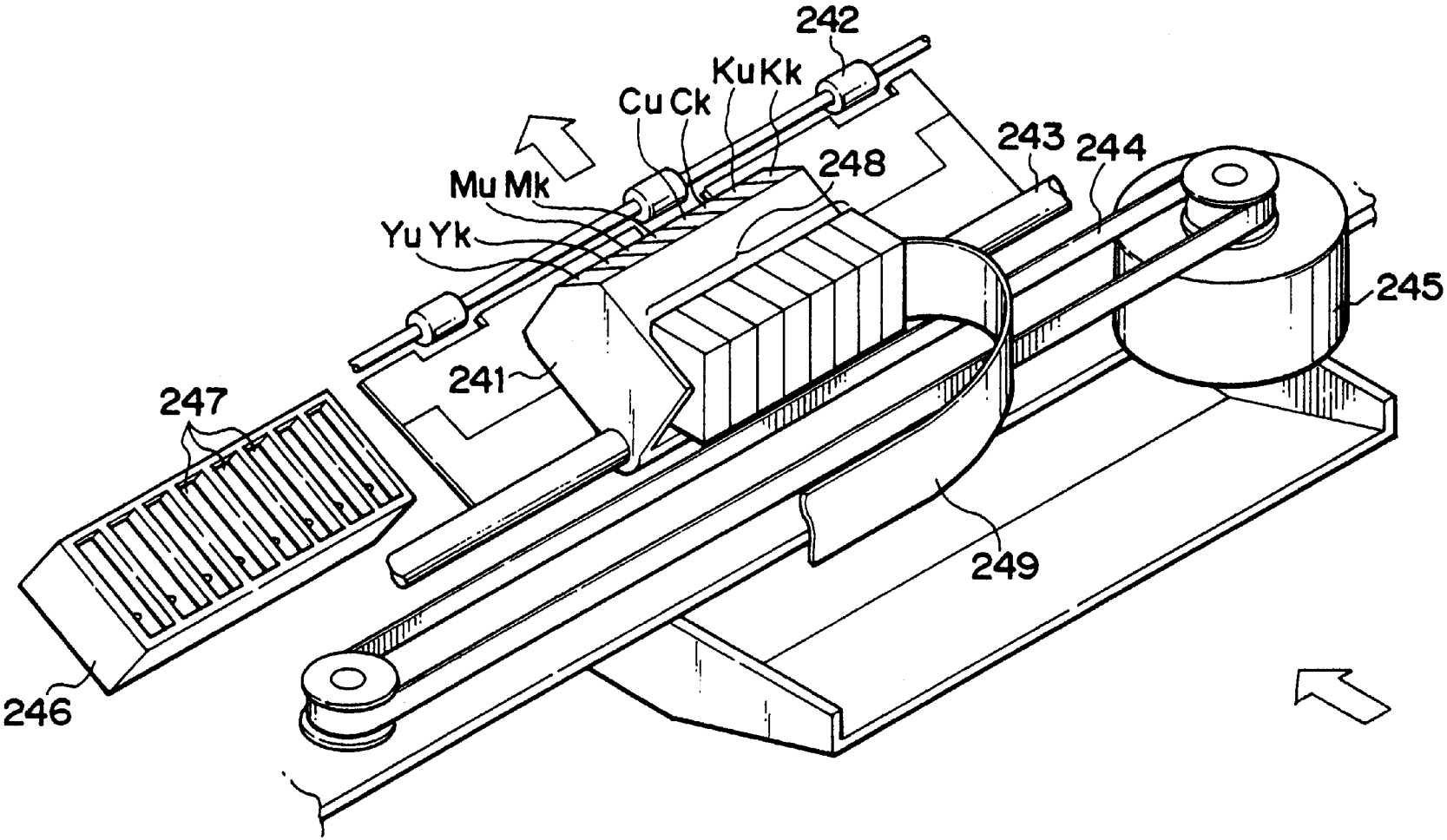
FIG. 1 is a perspective view showing the principal structure of a color ink jet recording apparatus which uses a plurality of inks each having different densities.
Figure 2C:
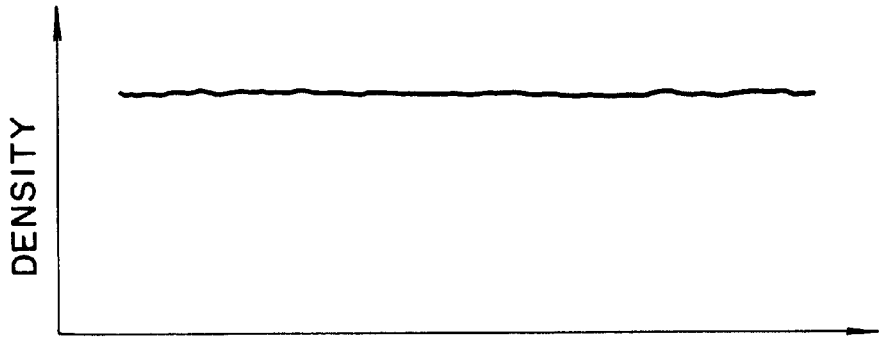
FIGS. 2A to 3C are views illustrating the major cause of the density unevenness created by a multihead.
Figure 2B:
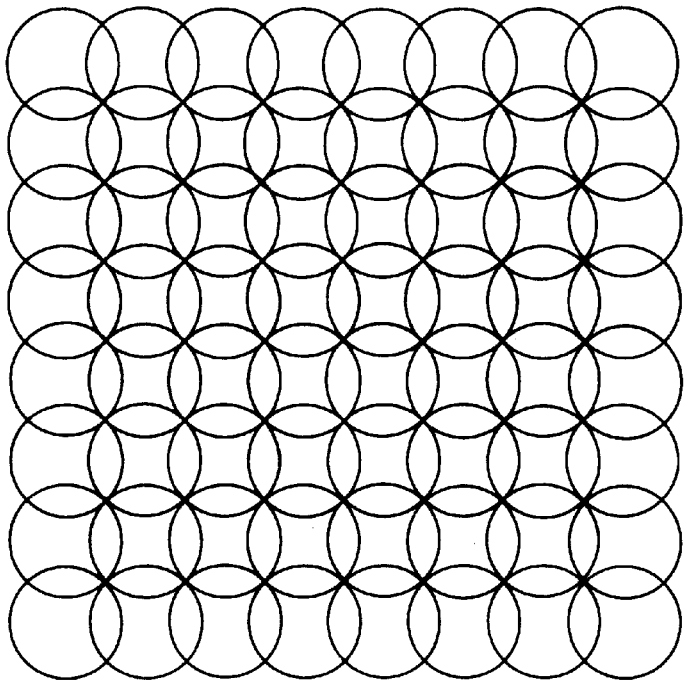
Figure 2A:
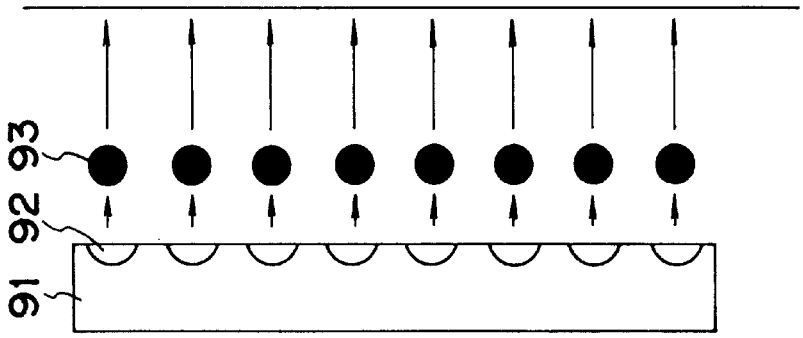
Figure 3C:
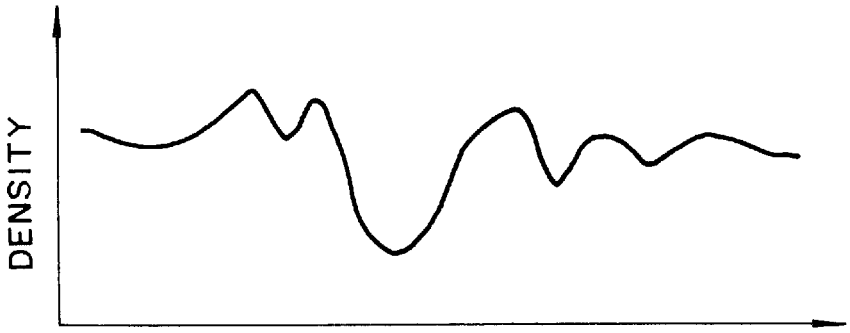
Figure 3B:
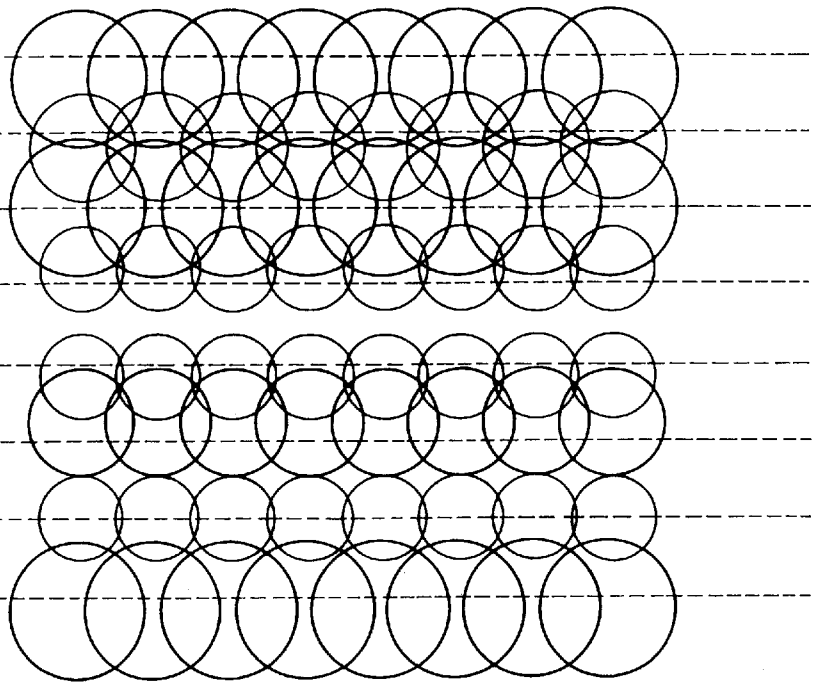
Figure 3A:
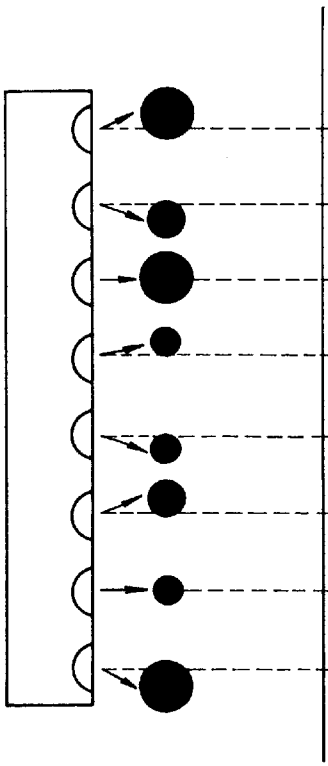
Figure 4C:
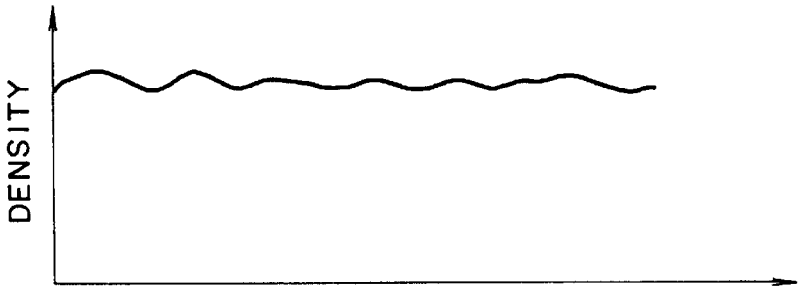
FIGS. 4A to 4C are views illustrating a method for moderating the density unevenness created by a multihead.
Figure 4B:
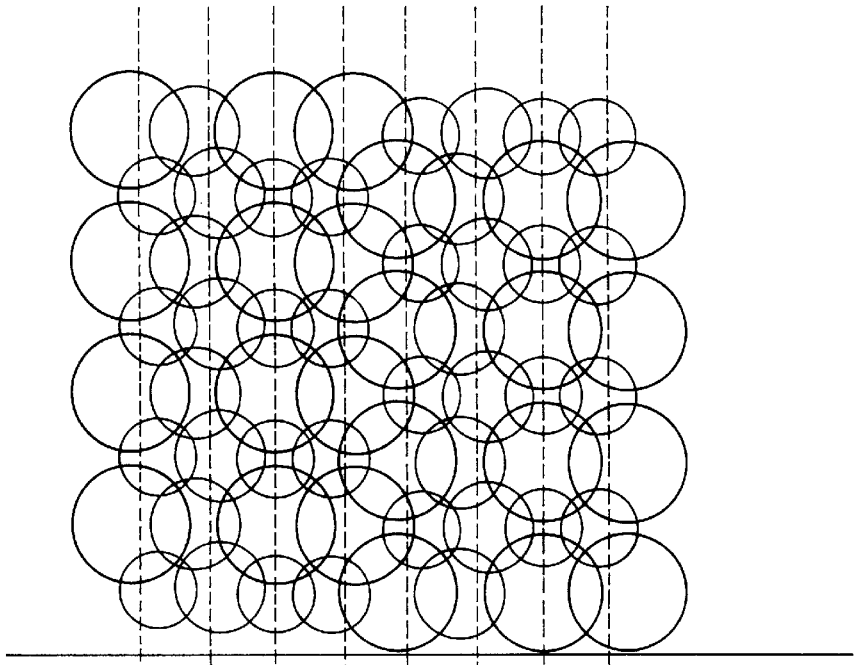
Figure 4A:
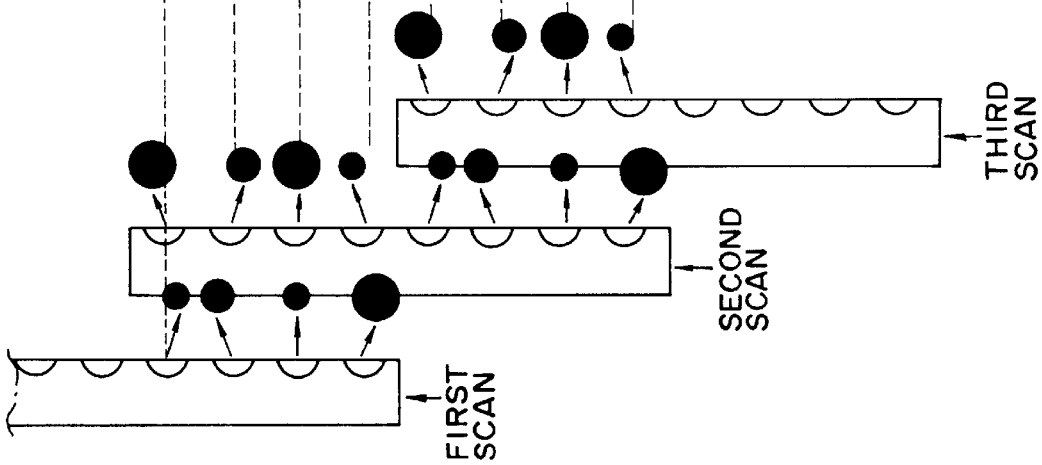
Figure 5A:
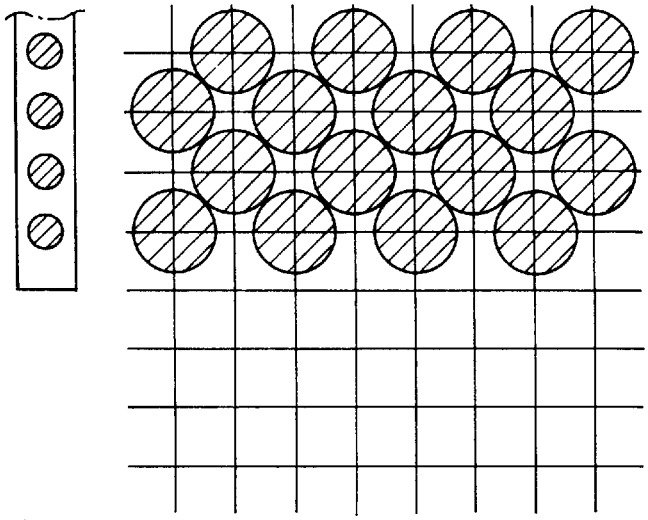
FIGS. 5A to 5C are views schematically showing the arrangement of discharge ports and the arrangement of recording dots by such discharge ports for the illustration of a divided recording method.
Figure 5B:
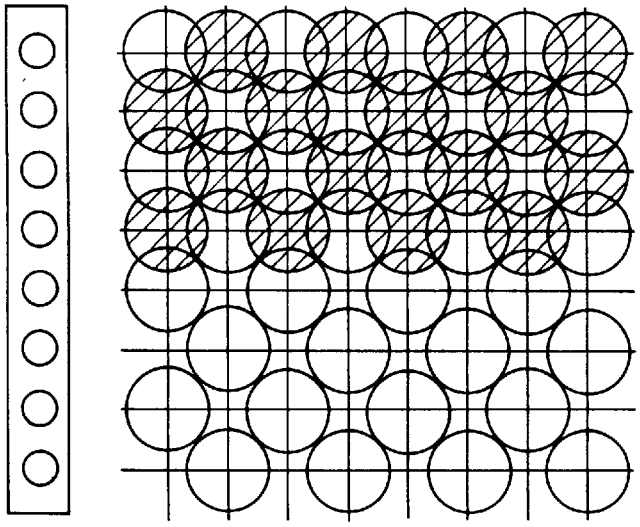
Figure 5C:
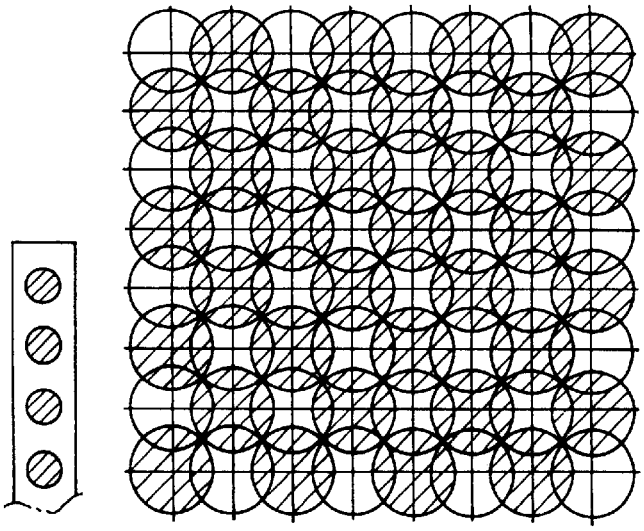
Figure 6:
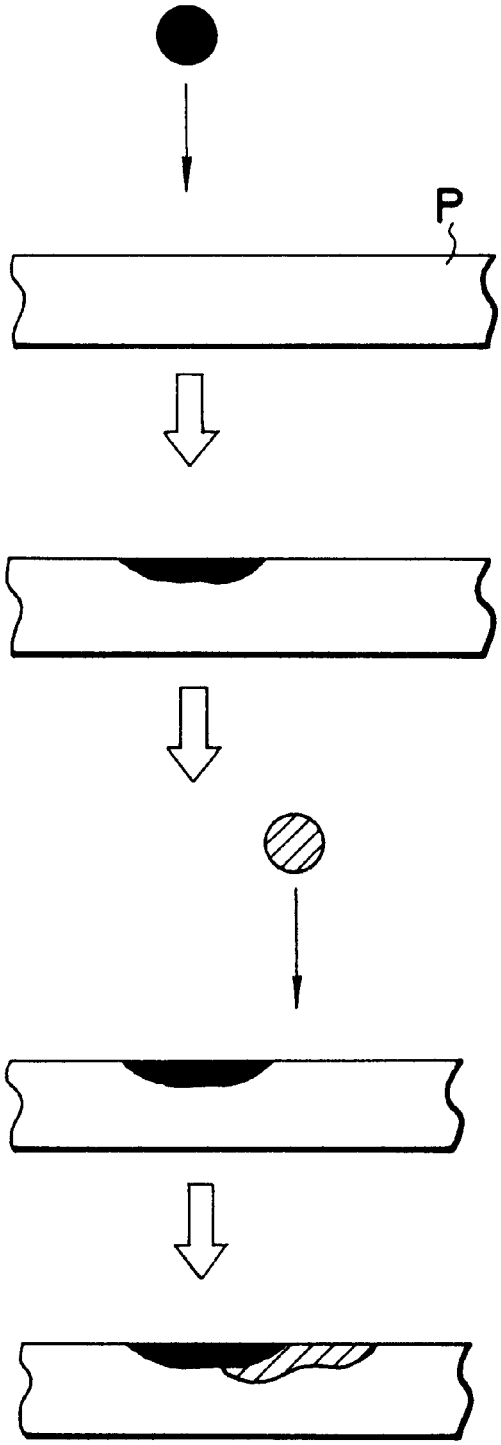
FIG. 6 is a view illustrating the cause of the color unevenness created in a recorded image.
Figure 7:
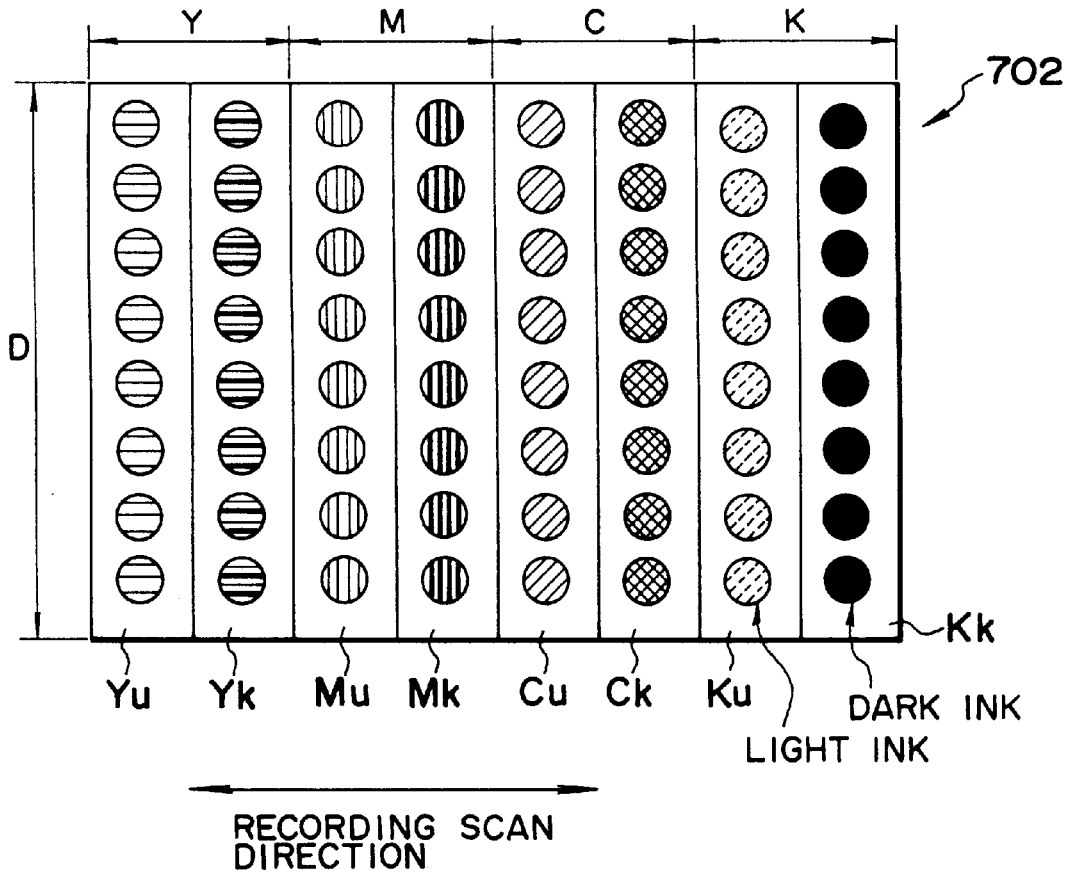
FIG. 7 is a schematic front view showing the conventional example of a recording head.

In the present embodiment, it is characterized in that a divided recording is executed further by use of the recording head which discharges ink each having different densities with respect to each of plural kinds of ink having different colors. Therefore, the effects of the divided recording can be demonstrated even in the structure in all the kinds of ink discharge port arrays are arranged in the direction of the recording scan as shown in FIG. 7. Nevertheless, it is often encountered that the unfavorable color unevenness cannot be completely eliminated by the provision of such a structure as this.

Figure 33B:
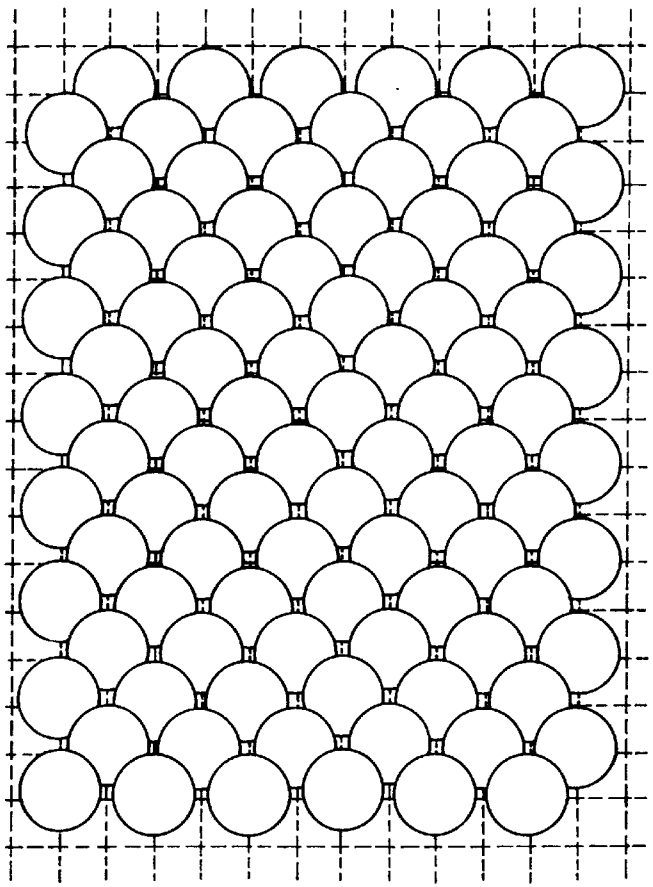
FIGS. 33A and 33B are schematic views illustrating a state of ink dot permeation in executing a divided recording method.
Figure 33A:
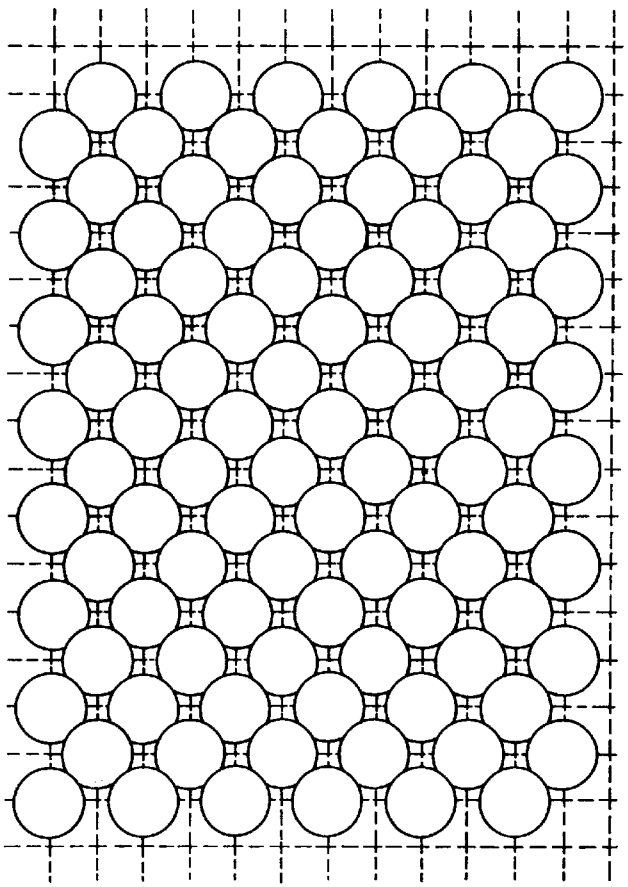

In conjunction with FIG. 33A and FIG. 33B, the description will be made of the reason why such a problem is encountered.

Usually, the amount of an ink droplet is designed so that the dot area formed by the ink droplet impacting upon the surface of a recording sheet spreads slightly wider than the area given to each pixel on the surface of the recording sheet.

This is a precaution to avoid any white portion of the sheet to appear when the dot area on the surface of the sheet is smaller than the area-where the printing ratio is 100%. Thus, when the divided recording method is applied, more than a 50% of the area of the recording medium (recording sheet) is covered as shown in FIG. 33A, although in this method, approximately 50% is recorded out of the pixel numbers to be recorded. In addition, the dark and light ink, and, further, two or more colors of dark and light ink are recorded on one and the same pixel for the mixed color recording. Hence the amount of ink to be impacted per pixel is increased to as much as four times, and as shown in FIG. 33B, the permeating area becomes almost 100%. As a result, even if the ink dots are recorded on the thinned pixel, such a part has already been occupied by first dots. Therefore, the density of color of the latter ink does not become so high. Consequently, even when a bidirectional recording is executed by the application of the divided recording method, the tonality and density in the scanning direction on the surface of the sheet by the first scan become the priority color in the recording area as a whole. In this way, the image area where the forward recording is the first recording, and the image area where the backward recording is the first recording appear alternately as color unevenness, hence often degrading the image quality significantly.

Figure 34:
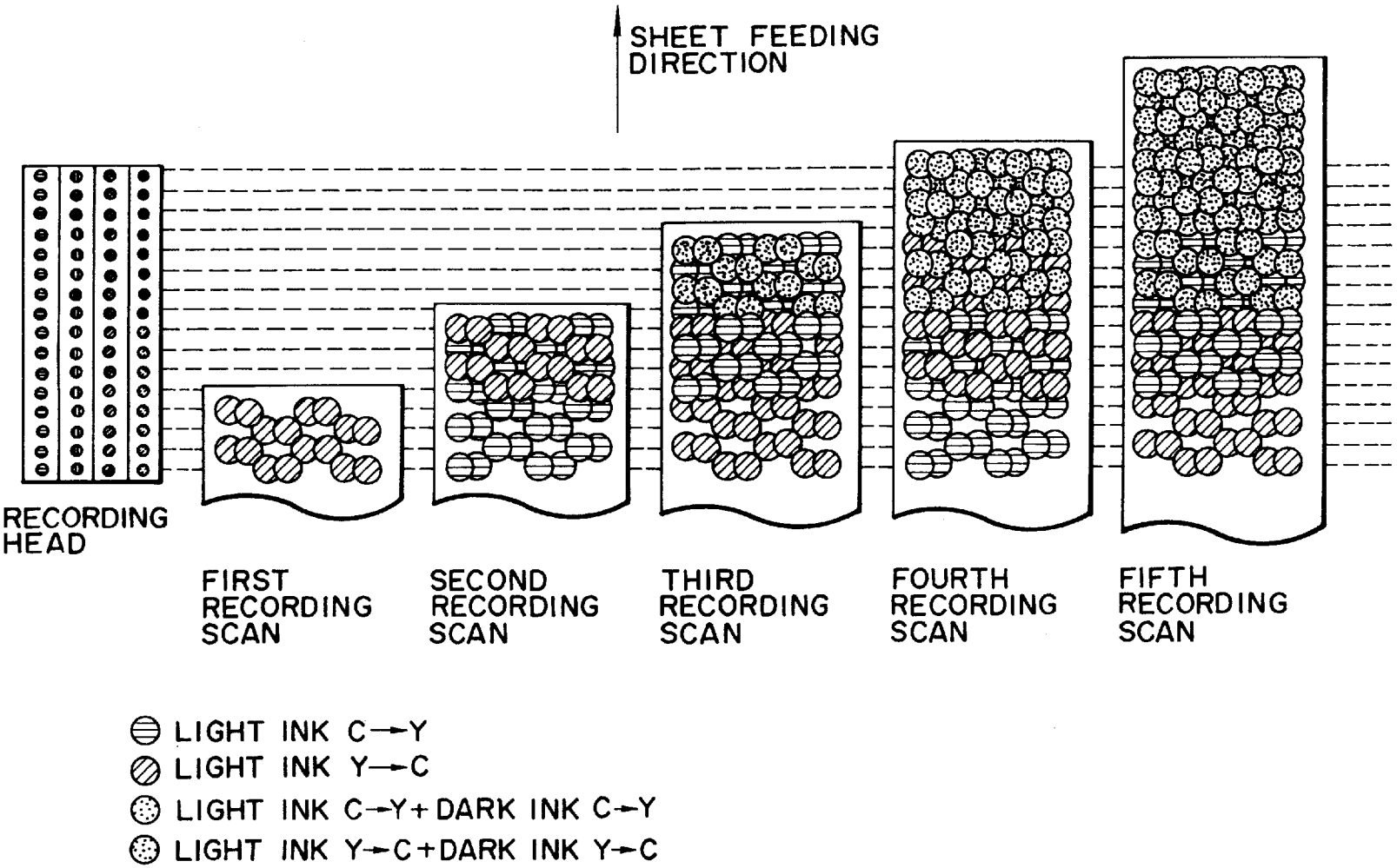
FIG. 34 is a view illustrating a state of recording according to an embodiment of the present invention.

FIG. 34 shows the state that a uniformly green image is recorded in the present embodiment.

The uniformly green image referred to in this respect is an image which is recorded in cyan and yellow both having-the dark and light ink. According to the distribution table shown in FIG. 10B, the image density signal inputted for this image indicates a duty between 128 and 255. However, in the following detailed descriptions including the present embodiment, it is assumed that the above-mentioned four kinds of ink are recorded on all the pixels for the sake of explanation. In the present embodiment, the pixel positions to be recorded by each of the recording scans are arranged so that the pixel group of one vertical pixel x two horizontal pixels are arranged alternately in a cross and counter-cross form. In this way, it is possible to reduce the permeation to the outside of the pixels to be recorded by each of the recording scans more than the alternate arrangement of one pixel unit sown in FIGS. 33A and 33B. Therefore, the color unevenness becomes difficult to occur even by the order of impacting already described.

Now, in conjunction with FIG. 34, the simple description will be made of each of the recording scans.

In a first recording scan, the four discharge ports in the lower half to discharge the light ink having a low image density among all the 16 discharge ports in the recording head. The pixel arrangement to be recorded at this juncture is the pixel group of 1×2 pixels which is arranged alternatly, and with the above-mentioned discharge ports, a half of the entire recordable pixels is recorded. In the first recording scan, since the recording is executed by the recording head which scans in the forward direction, the ink is impacted on each of the recording pixels in order of cyan and yellow when the uniformly green image is recorded. Therefore, the pixels recorded by the first recording scan bring about a green image having the stronger cyanic coloring. After the completion of the first recording scan, the recording sheet is fed in the direction indicated by an arrow in FIG. 34 for a portion equivalent to four-pixel width.

In the next second recording scan, a recording is executed in the backward direction of the recording scan by use of all the eight discharge ports on the discharge port array to discharge the light ink. The pixels to be recorded at this juncture are of the area of four-pixel width which is not recorded in the first scan, and the part where the pixel group of 1×2 pixels arranged also alternately in the image area of the four-pixel width which follows it immediately. In the second recording scan, the recording is executed in the backward scan. Therefore, ink is impacted on the recording pixels in order of yellow and cyan. Thus the pixels recorded by the second recording scan bring about a green image having a stronger yellowish coloring. Nevertheless, the ink used for the first and second recording scans are those having the light density. The difference in the coloring due to the order of ink impacting is not so conspicuous.

Again in the forward recording scan, a third recording scan is executed after the recording sheet is fed for a portion equivalent to four-pixel width. The discharge ports to be used here are all the eight discharge ports on the discharge port array to discharge the light ink, and the four discharge ports on the lower half of the discharge ports to discharge the dark ink. Since this recording scan is again in the forward direction, ink is impacted in order of cyan and yellow in the area of the second and third image areas, which is recorded by the light ink; thus obtaining a green image having a strong cyanic coloring. In contrast, in the first image area, the light ink printing is already completed, and the priority color has already been set. Hence, even if the dark ink is impacted in order of cyan and yellow, it does not result in setting the priority color, but only in making the green density more conspicuous as a whole.

Now, in a fourth recording scan after another sheet feeding, the recording is executed in the first image area by use of the entire discharge ports for the first time. Since this recording scan is again on the backward path, ink is impacted in order of yellow and cyan. As described for the third recording scan, the light ink has been impacted already on the first image area and the second image area. This recording is made on them. Therefore, there is almost no influence made by the impacting order of the dark ink. Only the green density in both image areas is enhanced as a whole. Then, with this recording scan, the recording on the first image area is completed. In the third and fourth image areas, the priority color has already been set for the recorded pixels by the impacting order of ink as in the recording scans up to now.

Thereafter, in the same manner as above, the sheet feeding for a portion equivalent to four-discharge port array, scan, and reciprocal recording are repeated in each of the recording scans by use of the entire 16 discharge ports in the discharge port array of the recording head; thus completing a recording.

According to the method as has been described above, a light ink image is completed by the first two-time recording scans by the use of the recording head shown in FIG. 32 in the entire image areas which are in series each by four-pixel width, and then, the dark ink image is completed by the following two-time recording scans. Therefore, even with the recording method which uses plural dark and light ink having different densities, it is possible for the present embodiment to remove the causes themselves which allow the dark and light unevenness to appear in the conventional examples.

On the other hand, in order to suppress another harmful appearance, a color unevenness, caused by the impacting order of ink, a structure is arranged so that the dots having different tonality are recorded in the forward and backward paths. In the present embodiment, the divided recordings are executed, and at the same time, the pixels to be recorded are arranged in a unit of 1×2 pixels; hence making it possible to suppress more the ink permeation to the other areas as compared with the event described in conjunction with FIGS. 33A and 33B. As a result, the ratio of the area occupied by the dots recorded in the forward path and the ratio of the area occupied by the dots recorded in the backward path are substantially identical; thus enabling an image of a better quality to be obtained.

Now, based on such a concept as this, it is conceivable that the color unevenness, and dark and light unevenness encountered in the recording head in the conventional example (FIG. 7) should be eliminated at a time if only the pixel arrangement, which is defined as the size of a unit of 1×2 pixels in the present embodiment, is further expanded. Actually, such an arrangement can make the tonality in each of the image areas even as a whole. On the other hand, however, if the unit of the pixel arrangement is too large, such a unit itself is visually sensed as a roughness appearing on the image; resulting in the recorded image short of smoothness. Also, ink of 400% or more at the maximum is impacted on the same pixel at the same time. Consequently, in the area where the recording density is high, different colors themselves tend to permeate at the boundary between them, thus often resulting in an unfavorable image.

In the present embodiment, the two harmful events, the dark and light unevenness, and the color unevenness, which tend to occur in the bidirectional recording, that is, recording is executed both in the forward path and backward path, are solved by the structural application of the discharge port arrays for each of ink colors with respect to the former event, and by the application of the divided recording and structural arrangement of the pixels with respect to the latter. Then, particularly in the descriptions so far, the head structure is arranged so that the recording in the dark ink is executed subsequent to the recording in the light ink. However, the impacting order of dark and light ink itself is not limited to this arrangement. In other words, it may be possible to obtain the effects of the present invention by making an arrangement so that the positions of the light ink nozzles and the dark ink nozzles are inverted.

Here, the description will be made briefly of the image comparison in recording by use of the structure of the recording head which has been described in conjunction with FIG. 32, and by the inverted arrangement of this structure as well as the reversed impacting order of the dark and light ink.

When a recording is made in the light ink first, there appears a phenomenon that the dark ink impacted subsequent to it tends to be permeated around beneath the light ink already recorded, and in each of the pixels, large dots having a low density are obtainable. On the contrary, if a recording in the dark ink is made first, the dots having the priority color determined by the very first recording scan are set with a high density, thus setting the priority color fairly strongly. In this case, as far as the color unevenness is concerned, the structure in which the light ink image is completed earlier makes it more difficult for the color unevenness to appear than the structure in which a recording in the dark ink is executed first. This may be due to the fact that the impacting order of ink using the light ink results in a lesser difference in coloring than the imapacting order using the dark ink. Furthermore, each of the dots expands greatly in uniform in this case, thus making it possible to obtain a smoother image as a whole. In the present embodiment, therefore, the recording head having the arrangement that the light ink is used earlier is considered more suitable for recording a color image.

On the other hand, when a recording in the dark ink is executed earlier, it is clear that the color unevenness is less conspicuous. Also, as the dark ink is not mitigated by the light ink which is subsequently recorded, the density of the pixels themselves and the resultant resolution become high, thus enabling the provision of a clear image having a high resolution. Therefore, the head recording in the dark ink earlier can be a structure which is more suitable for the letters, images, and others to be recorded in black with a high density.

Figure 35:
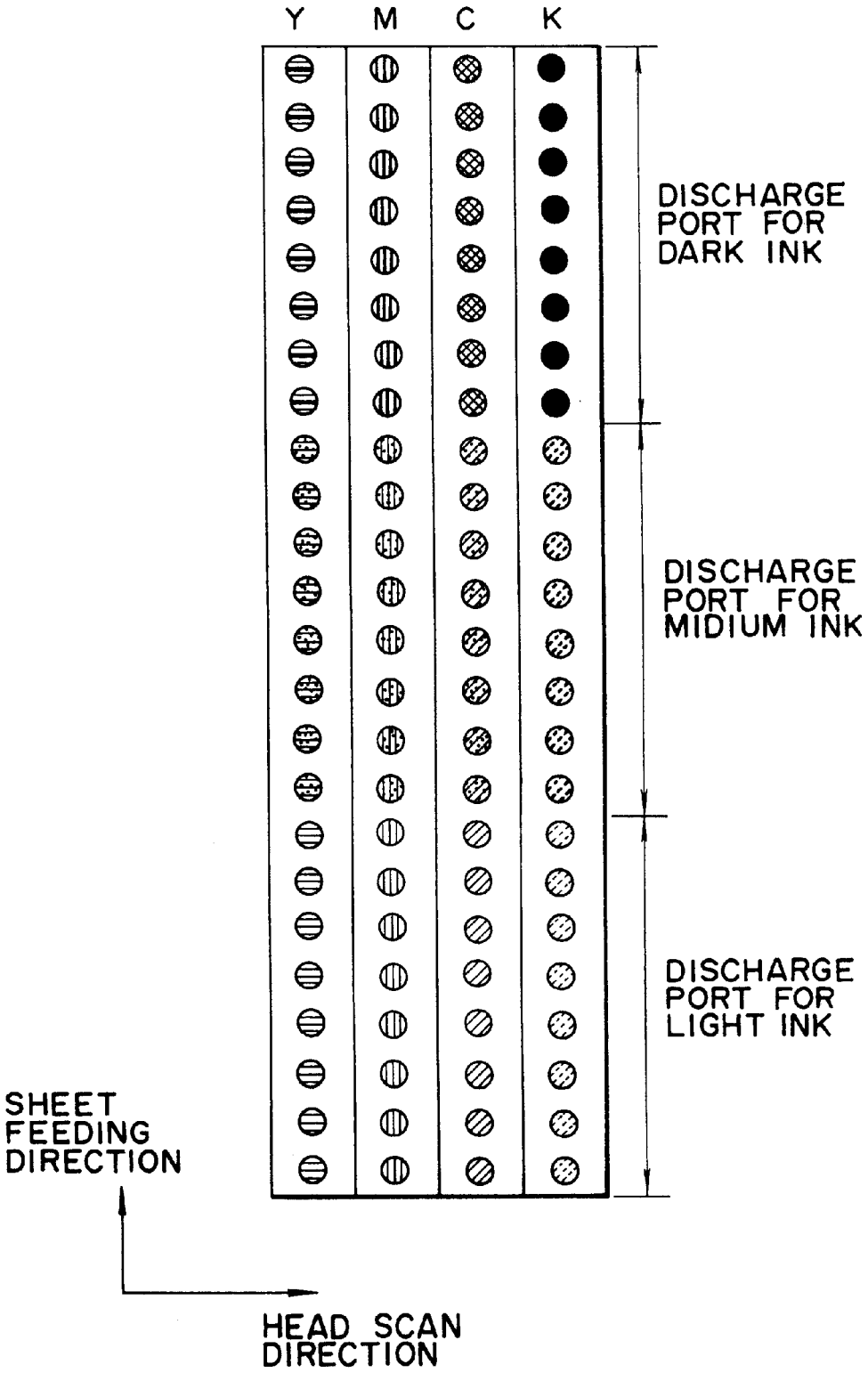
FIG. 35 is a schematic front view showing a variation of the recording head according to an embodiment of the present invention.

Further, in the present embodiment, the description has been made of ink having two kinds of densities, the dark and light ink for each of the colors, but it may be possible to provide the density three or more levels in order to obtain an image of a better quality. In this case, it will suffice if only the ink discharge port arrays for ink having different densities are arranged in the sheet feeding direction as shown in FIG. 35.

As has been described above, according to the present embodiment, a color ink jet recording apparatus having a recording head to discharge the dark and light ink can eliminate the color unevenness, and dark and light unevenness due to the impacting order of ink even in executing the bidirectional recording by arranging ink of each color in the scanning direction of the recording head, and the dark and light ink discharge ports in the sheet feeding direction; enabling an excellent image to be obtained in this way.

Seventh Embodiment

Now, the description will be made of a seventh embodiment according to the present invention. Whereas the dark and light unevenness is solved by the arrangement of the head structure, and the color unevenness, by the application of the divided recording method in the above-mentioned sixth embodiment, the dark and light unevenness is solved by the application of the divided recording method, and the color unevenness, by the arrangement of the head structure.

Figure 36:
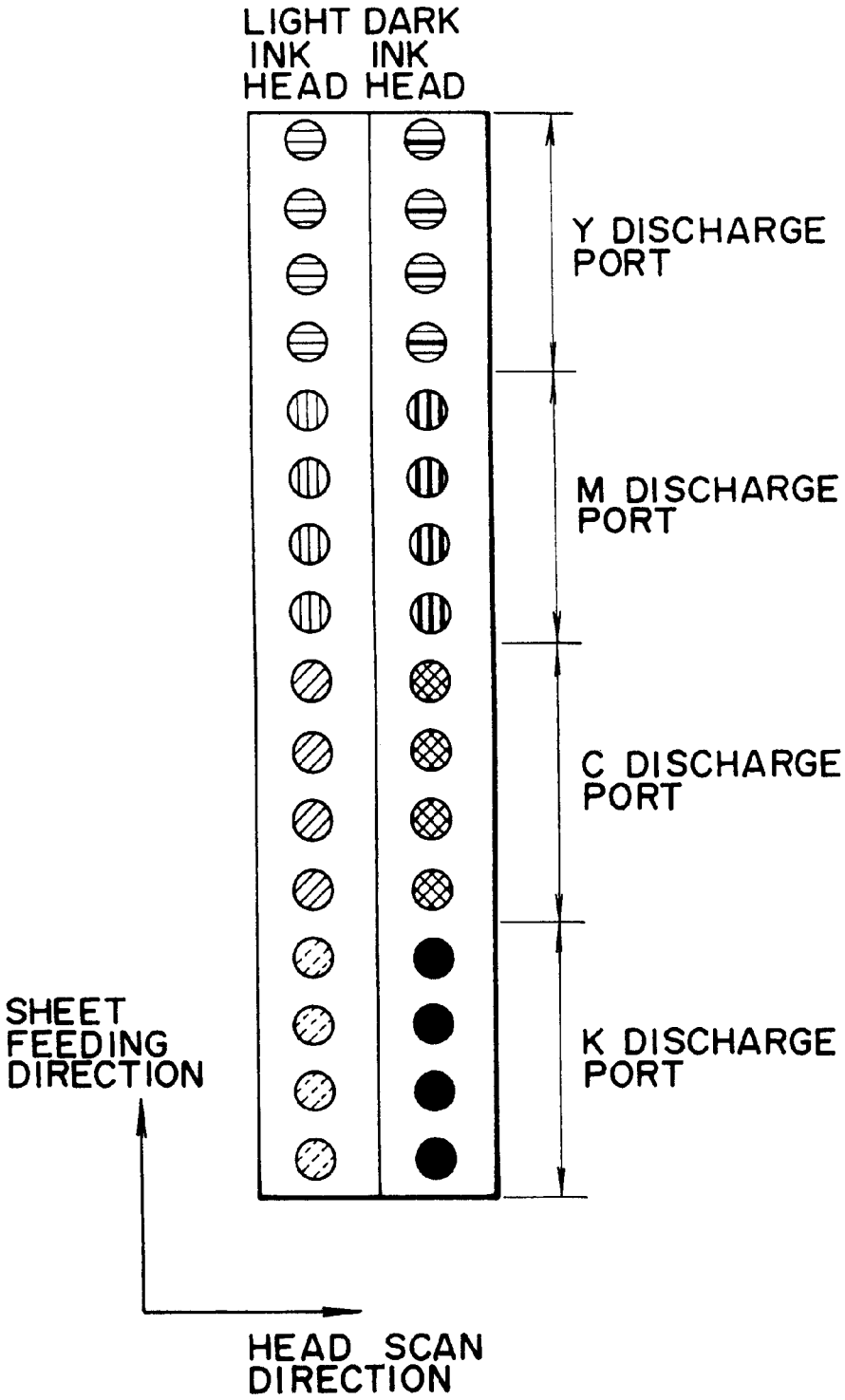
FIG. 36 is a schematic front view showing a variation of the recording head according to an embodiment of the present invention.

FIG. 36 shows the structure of the recording head according to the present embodiment. As in the example shown in the above-mentioned sixth embodiment, this example of a variation also used a recording head having 16 discharge ports arranged in a line. Here, however, the dark ink head and the light ink head are independent from each other and are arranged in parallel in the direction of recording scan. In each of the discharge port arrays, four discharge ports are arranged for each of the colors toward the sheet feeding direction.

In the present embodiment, the order of the recording colors is set: black, cyan, magenta, and yellow. As in the sixth embodiment, however, the arrangement order in the sheet feeding direction is not necessarily limited to only one. Also, in the present example, there are only four discharge ports for each color and each density. Therefore, the amount of sheet feed is equivalent to a two-pixel width in order to execute the divided recording.

Figure 37:
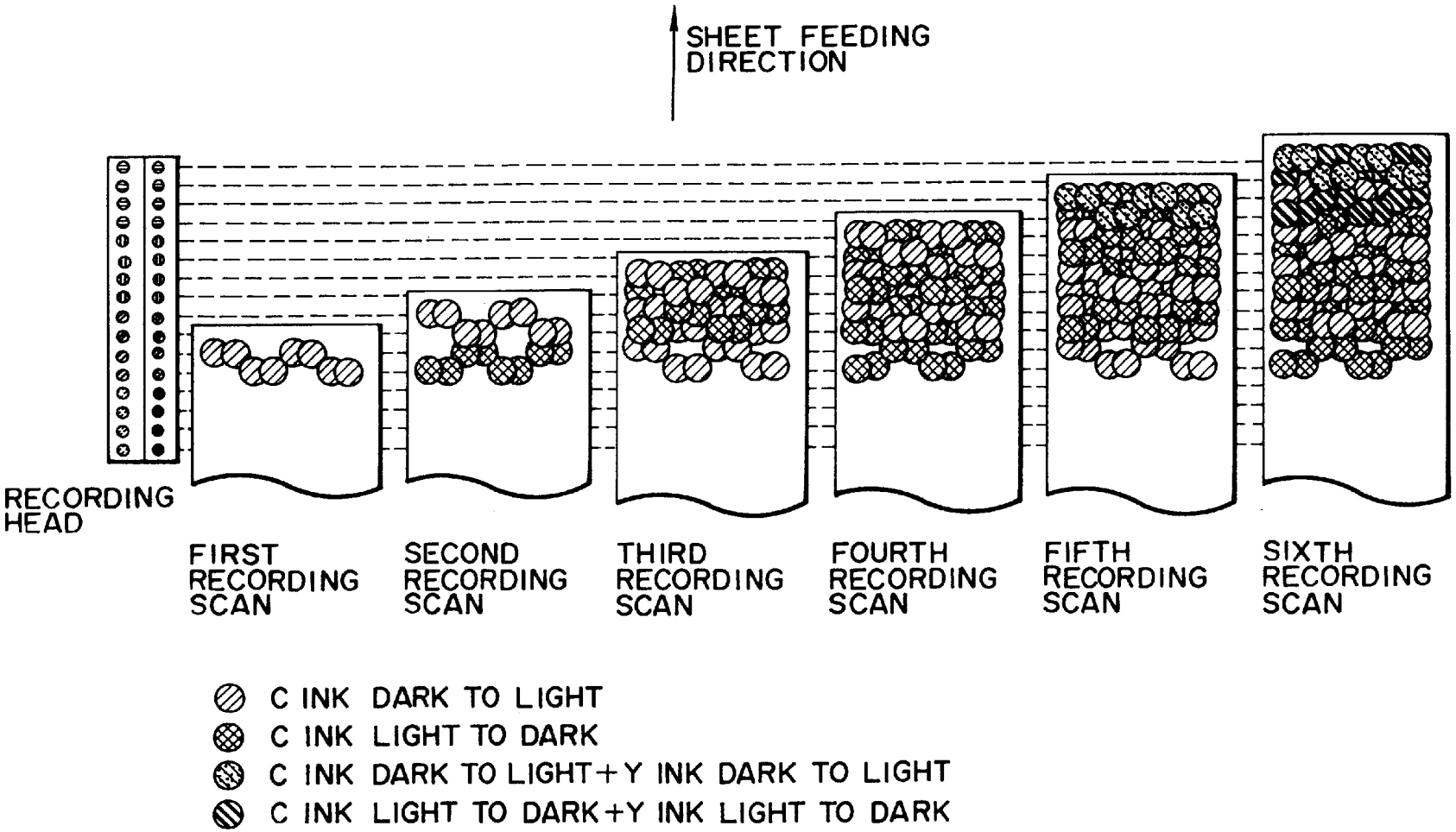
FIG. 37 is a view schematically illustrating the state of recording by the recording head schematically shown in FIG. 35.

FIG. 37 shows the process of a recording in the present embodiment. Here, as in the sixth embodiment, a case where a uniformly green image is recorded in cyan and yellow is also exemplified.

When starting the recording, the leading end of the recording sheet.is set at the position of the black discharge ports if any black data are present. However, in a green image which will be described in the present embodiment, there is no need for any recording in black ink. Therefore, the recording sheet is fed to the position of the cyan discharge ports as shown in FIG. 37. At this juncture, although a total of four discharge ports exists for cyan discharge, the recording sheet is set at the position of two discharge ports in the lower half of the cyan ink discharge ports in a first recording scan.

Since the first recording scan is in the forward path, the dark cyan ink and light cyan ink are impacted on the recording pixels in that order. The dark ink being impacted first, the recorded pixels are such that around the cyan pixels having a high density and clear dot contour, large cyanic dots having a low density surround weakly. After then, the recording sheet is fed for a portion equivalent to a two-pixel width, and next, the second recording scan follows. In this respect, the pixel arrangement to be recorded at a time in each of the recording scans uses the pixel group of 1×2 pixels arranged alternately as in the sixth embodiment.

Since the second recording scan is in the backward path, the light cyan ink and the dark cyan ink are impacted on each of the pixels in that order. The dark ink dots recorded subsequent to the light ink having already been impacted are permeated largely around the light ink dots; thus the pixels becoming even having the density which is lower than the density of the dots obtainable in the recording scan in the forward path. The cyan recording is completed by the two-time recording scans so far. In the first image area, there are mixed the high density cyanic dots and the low density cyanic dots approximately in halves. Also, in the second image area following the first one, a half of cyanic dots are recorded in the backward path at that time.

Next, in the third and fourth recording scans, the, first image area is positioned facing the magenta discharge port array. Therefore, no actual recording is executed. However, in the second image area and on to follow this, the cyanic dots are recorded one after another in each of the image areas facing the cyan discharge port array. The first image area where the cyanic dots are recorded will be recorded next in the fifth recording scan when this area is positioned facing the yellow discharge port array. The yellow ink is impacted on the dots already recorded in the cyan ink in order of dark and light ink. If the ink should be impacted on a white sheet in that order, the recorded pixels become highly densified yellowish pixels. However, in this case, the recording is executed on the pixels in which the cyan ink has already been absorbed. Therefore, the yellow ink is largely permeated around beneath the cyan ink. Here, no difference arrears in the dot configurations and in its darkness and lightness.

As described above, in the recording scans being reciprocally repeated one after another, the recording is executed only when each of the image areas is positioned facing the cyan discharge port array, and positioned facing the yellow discharge port array after two scans. Here, the recording in yellow is executed only after all the recording areas are completely recorded in cyan. Therefore, the harmful color unevenness occurring in the reciprocal recording, which has been described in conjunction with a conventional example, is eliminated by the arrangement of the recording head structure in the present embodiment.

As has been described above, in the ink jet recording apparatus having the dark and light ink heads, the color unevenness and dark and light unevenness due to the impacting order of ink in the bidirectional recording can be eliminated according to the present embodiment by arranging the dark and light ink discharge ports in the direction of recording scan, and also, the discharging ports to discharge the respective color ink in the sheet feeding direction.

In this respect, the order of ink color arrangement in the sheet feeding direction is not limited to the one described in the present embodiment, too. It may be possible to obtain the same effect of the present invention in any arrangement. Particularly, in the present embodiment, the black ink is brought to the top order with an intention to maximize the density and resolution of black ink among four colors to be used. Making the density and resolution of the black ink higher leads to the provision of clearer letters and images in black.

Eighth Embodiment

Now, an eighth embodiment will be described as a variation of the sixth embodiment.

In the above-mentioned sixth and seventh embodiments, a plurality of recording heads are used so that each of the heads corresponds to each color or density. In the present embodiment, however, only one recording head is employed. In other words, as shown in the first embodiment, the ink discharge ports for all the densities and colors are arranged in advance in the recording head, and then, the structure is arranged to integrate them as a body.

Figure 38:
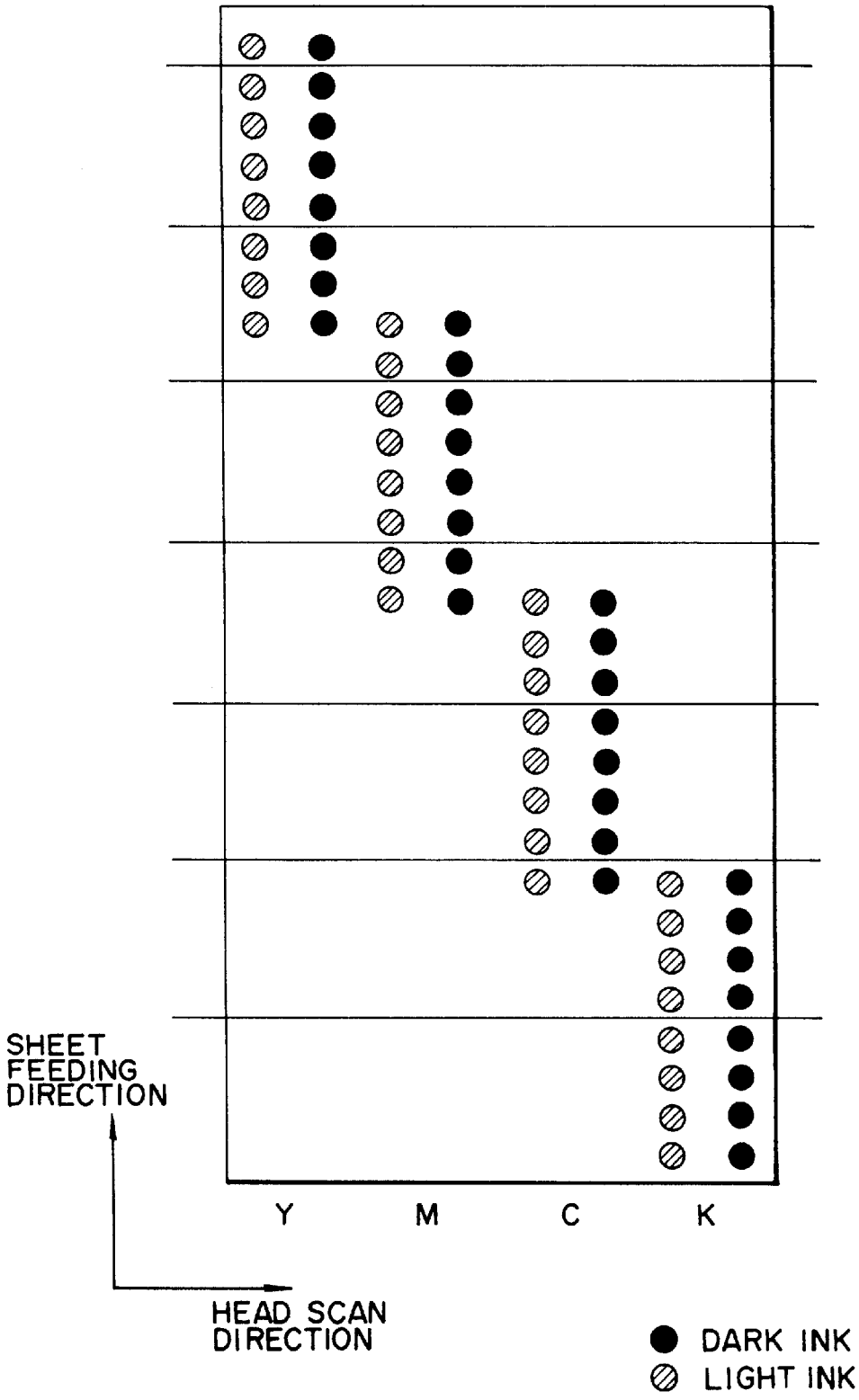
FIG. 38 is a schematic front view showing a recording head according to an embodiment of the present invention.

FIG. 38 is a schematic view showing the structure of a recording head to be used for the present embodiment.

A recording in a color is completed by a total of 16 discharge ports, eight discharge ports each for discharging the dark ink and light ink for each of the color ink. The discharge port group for each color is arrange in order of black (K), cyan (C), magenta (M), and yellow (Y), but in this case, the adjacent discharge port groups for the respective colors are arranged to superpose them in a portion of one discharge port each other.

In FIG. 38, the horizontal solid lines on the head represent a state of sheet feeding to indicate the positions where the leading pixels of the recording sheet arrive at by the sheet feeding scans one after another per four-pixel width. As clear from FIG. 38, the leading pixels are being positioned according to color in the different parts of the eight discharge ports arranged for each of the colors, if the structural arrangement of the discharge ports is employed as in the present embodiment. In other words, the leading pixels can be positioned at the joint section of the divided recording in black, but these pixels are not positioned at such a joint section in cyan, magenta, and yellow.

Figure 39:
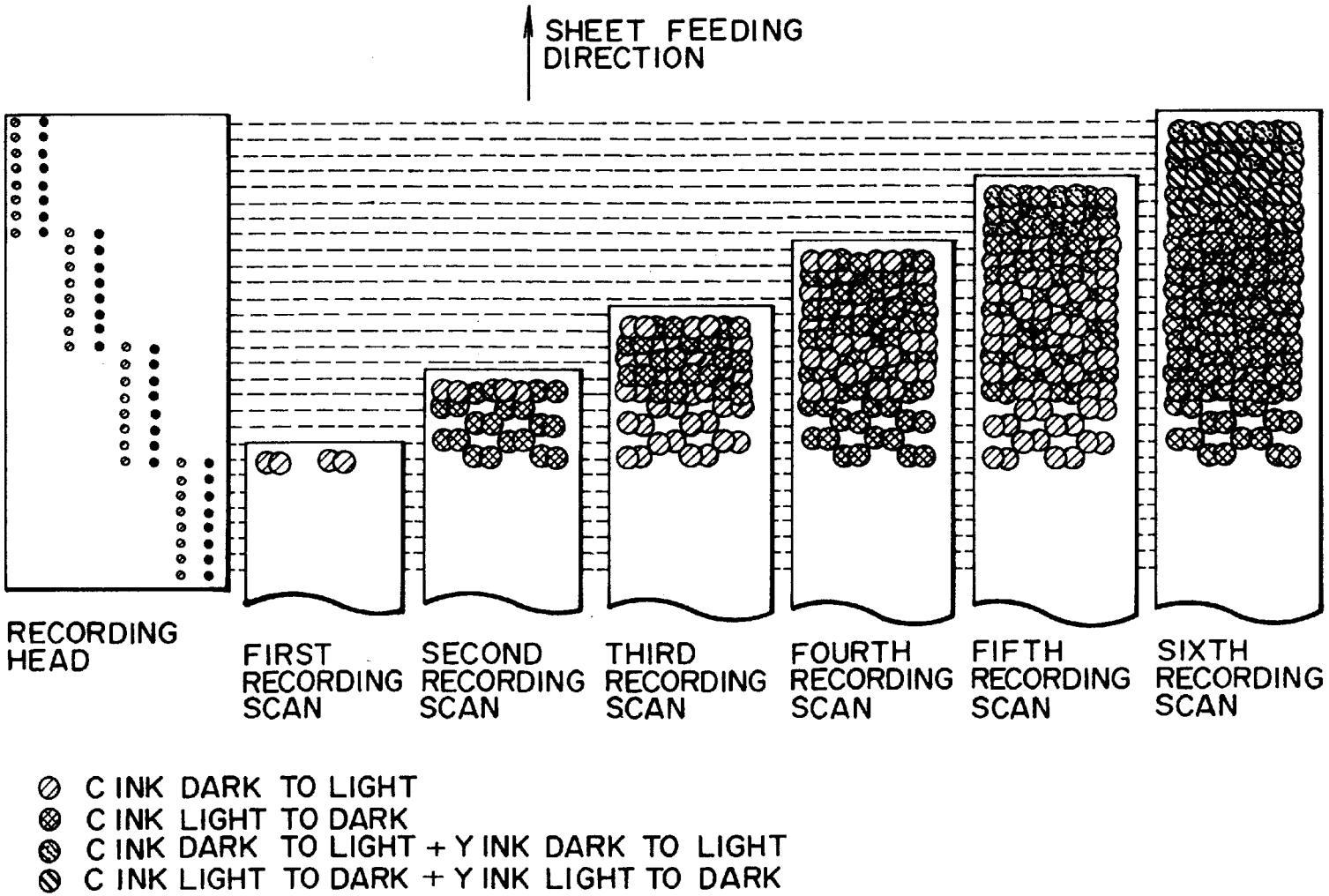
FIG. 39 is a view illustrating the state of recording by the recording head shown in FIG. 38.

FIG. 39 shows the recording process according to the present embodiment. As in each of the above-mentioned embodiments, FIG. 39 illustrates a state that a uniformly green image is being recorded. In this example, too, the ink discharge ports for ink of different colors are arranged in the sheet feeding direction as in the foregoing seventh embodiment. Thus in each of the reciprocal recording scans, only the image area which is brought to the position of the cyan or yellow discharge ports is recorded. The image area referred to here is a four-pixel area which the recording head for each color records at the same time, that is, an area between the joint sections for each of the colors. In the present example, therefore, the image areas are structured by each of the colors, which differ from each other unlike the image area in the foregoing embodiments.

Figure 40:
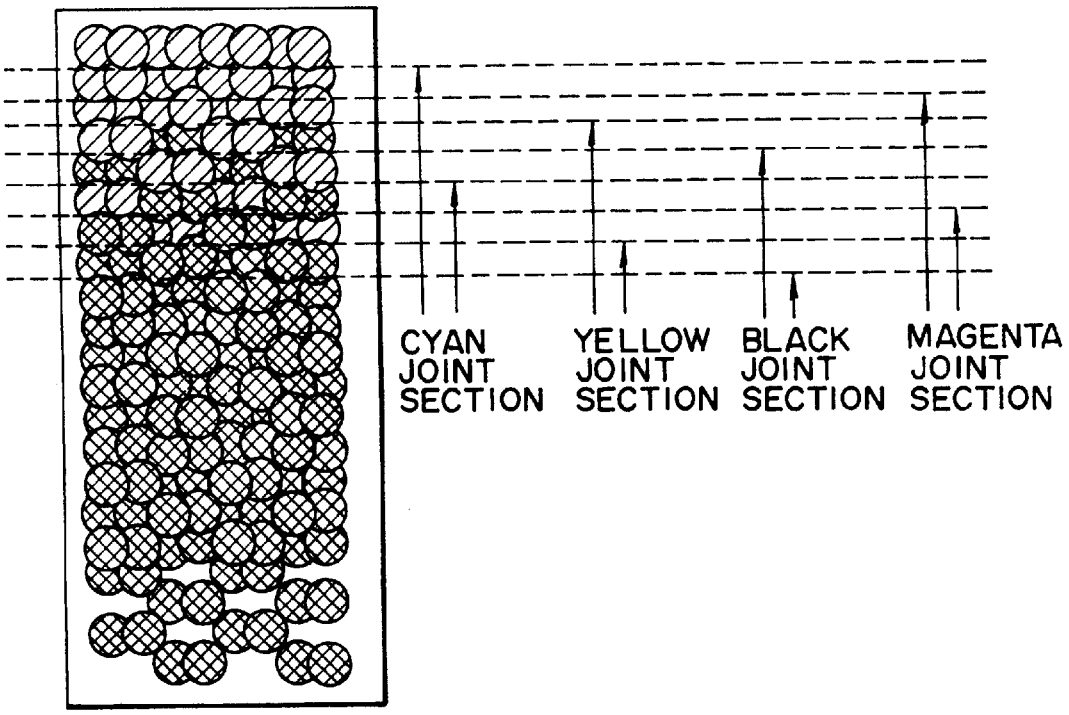
FIG. 40 is a view illustrating the position in which each color is joined in recording shown in FIG. 38.

FIG. 40 illustrates the joint section (image area) between the recorded image and the respective colors after the sixth recording scan shown in FIG. 39. Here, it is shown that the respective joint section (image area) appears in the positions in which the respective colors are displaced by one pixel each. By arranging to enable the joint section to appear at a different position per color like this, it becomes possible to correct further the fluctuation in the amount of sheet feeding executed per recording scan, in addition to the effects of the present invention obtainable in the above-mentioned sixth and seventh embodiments.

Now, in the present example, the positions of the discharge ports in the recording head are arranged to superpose one discharge port with each other for each of the colors in order to make the joint sections different per color, but the structural arrangement of the discharge ports to differentiate the joint sections is not necessarily limited to this arrangement. For example, it may be possible to obtain the same effect by arranging the discharge ports for each color by parting them one pixel each on the contrary. In this case, the causes of the color unevenness due to the bidirectional recording can be removed completely. Also, in order to make the partitions more reliable between each of the common liquid chambers in the recording head, it is preferable to arrange the discharge port arrays with a certain distance between them with a view to facilitating the recording head fabrication.

Further, it may be possible to arrange the joint section for each color in various positions if the number of discharge ports which participate in recording is increased, and the amount of sheet feeding becomes greater accordingly.

Further, as in the above-mentioned seventh embodiment, the order of ink color arrangement in the sheet feeding direction is not necessarily limited to the one described herein. It may be possible to obtain the same effect by any arrangement.

In the sixth, seventh, and eighth embodiment described above, the description has been made of the case where the recording is executed by dividing the image area into two for the formation of an image, but it may be possible to divide it into more numbers as means to make the effects of the present invention more effective. To make the number of divided recordings more is to apply more discharging ports to one image area, and also, to reduce the absolute amount of ink to be impacted in the same image area per recording scan. As a result, while the image can be recorded more smoothly, it is possible to anticipate the effects produced favorably on the elimination of the color unevenness and dark and light unevenness due to the ink permeation as has been described.

FIGS. 41A to 41D are views illustrating the ink suction operation by an ink jet recording apparatus to which the present invention is applicable, and is a cross-sectional view schematically showing the cap unit shown in FIG. 18.

Figure 41A:
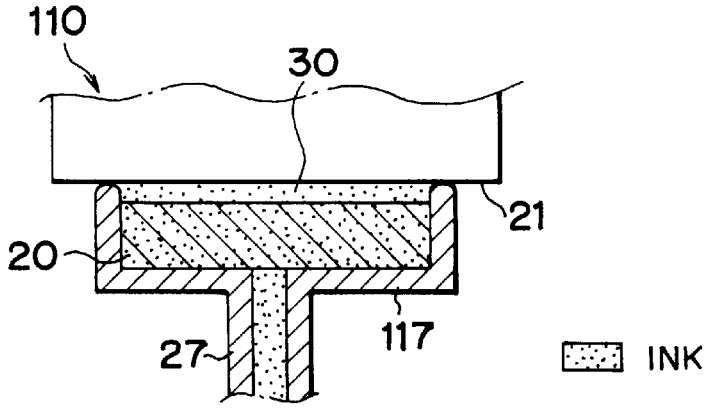
FIGS. 41A to 41D are views illustrating the detaching operation of a cap according to an embodiment of the present invention.

In FIGS. 41A to 41D, in the interior of each capping 117, a porous ink absorbent 20 is provided. As shown in FIG. 41A, this ink absorbent 20 is arranged so that it is positioned in the vicinity of the discharge port formation surface 21 at the time of capping. In this respect, a portion 30 indicated by the highly densified slant lines in FIGS. 41A to 41D designates ink absorbed (sucked) from the discharge ports.

FIG. 41A illustrates a state that a suction pump is operated while the cap 117 abuts closely on the discharge port surface 21 to generate a negative pressure in the cap 117 through a tube 27; thus sucking ink from each of the discharge ports, and then, suspending the operation of the suction pump. In this state, the negative pressure in the suction pump is almost released because a certain amount of ink has been sucked. In other words, the negative pressure is reduced to the extent that the meniscus of each discharge port is not broken. If the cap 117 is parted from the discharge port surface 21 in a state that the negative pressure is still high, the atmospheric pressure is given to the interior of the cap 117 instantaneously, hence breaking the meniscus in the discharge ports by the sudden change of pressure to introduce air into the discharge ports. In some cases, this causes a defective discharge to occur.

Figure 43A:
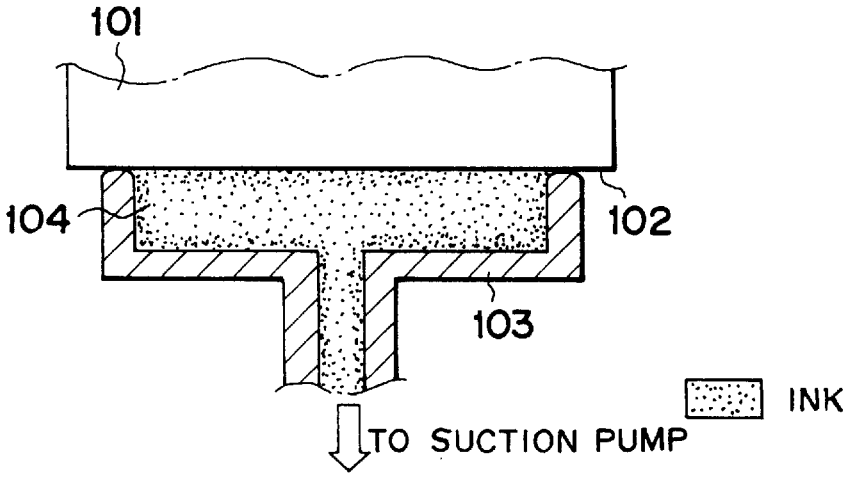
FIGS. 43A to 43C are views illustrating the detaching operation of a cap according to the prior art.
Figure 43B:
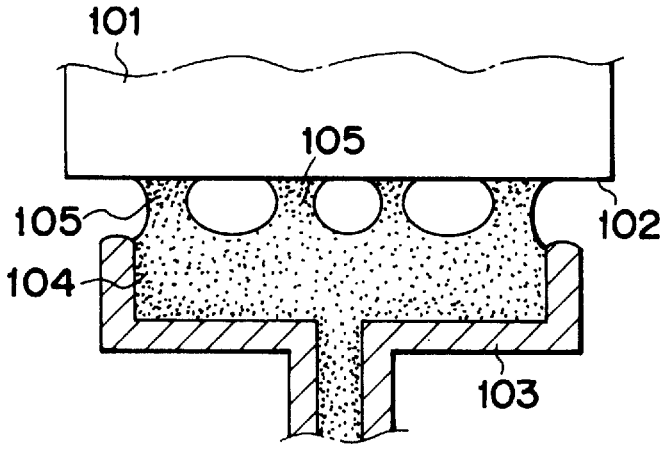
Figure 43C:
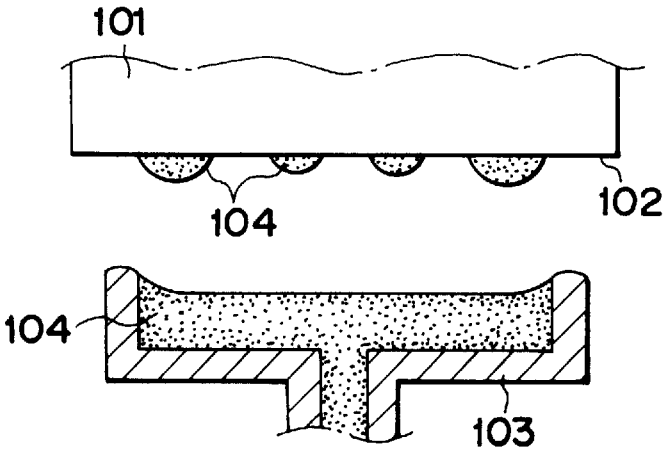

Also, as shown in FIGS. 43A to 43C, there are activated the adhesive force of ink and the suction force of ink due to the negative pressure in the discharge ports on the interface between the ink and the discharge port surface. Further, in the ink in the cap 103, the surface tension works by the condensation of ink itself. Consequently, neck-ins 105 are created between ink 104, and as the cap being parted, the cross area of each of the neck-ins 105 of the ink 104 becomes smaller, hence such portions are made weakest. At last, coupling between ink is cut off in the neck-in sections 105. Thus there are some cases that ink droplets remain on the discharge port formation surface.

In the state shown in FIG. 41A, the interior of the cap 117 is almost filled in by ink, and the ink absorbent 20 is also saturated, being in a state that it has almost no sucking capability. If the cap is parted in such a state as this, the result is that a good amount of ink remains on the discharge port formation surface 21 as in the case shown in the above-mentioned FIGS. 43A to 43C. In the present embodiment, therefore, the carriage is finely shifted in the right-hand direction in FIG. 41A in order to provide a space 31 between the cap 117 and the discharge ports. At this juncture, the fine amount of shift of the carriage is set at an appropriate amount which is more than the range allowing the cap 117 to execute the air-tight closing.

Figure 41B:
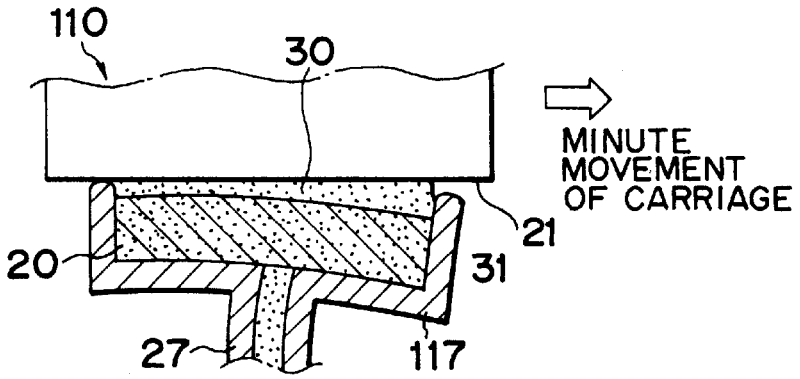
Figure 41C:
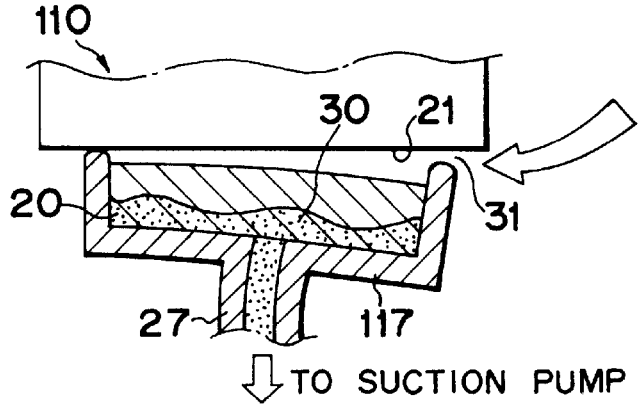
Figure 41D:
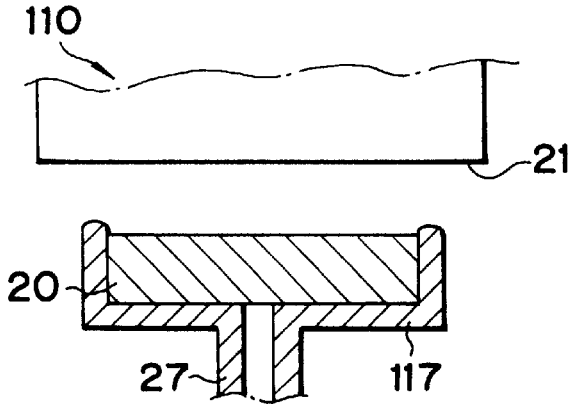
Figure 42A:
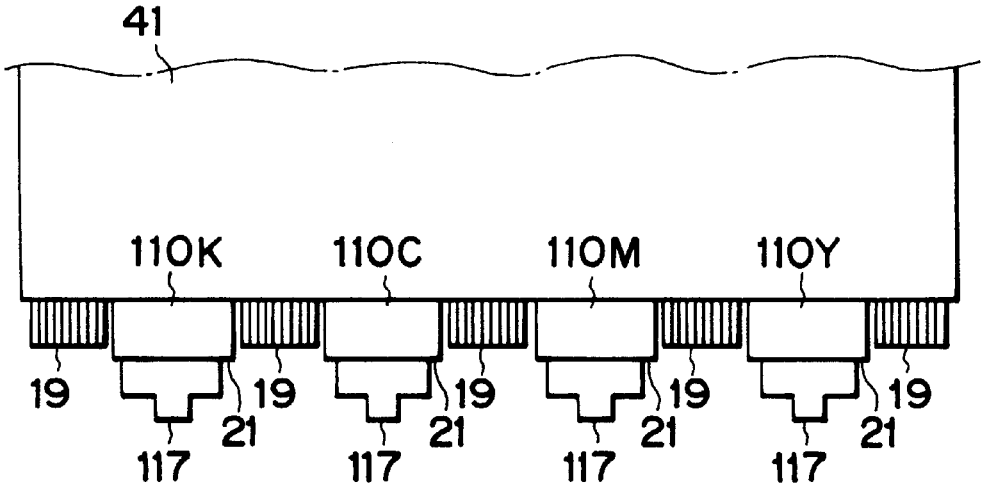
FIGS. 42A and 42B are views illustrating the detaching operation of a cap according to an embodiment of the present invention.
Figure 42B:
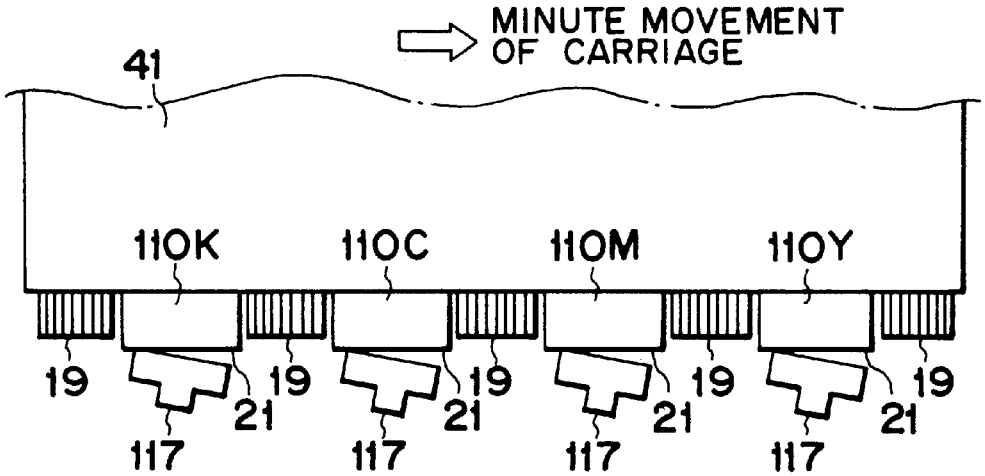

FIGS. 42A and 42B are schematic views showing the state of the carriage which finely shifted as described above. FIG. 42A shows the state before the shift. FIG. 42B shows the state after the shift. Also, FIG. 41B shows the state in the interior of the cap immediately after the carriage is finely shifted from the state shown in FIG. 41A as described above. As shown in FIG. 41B and FIG. 42B, the suction pump is again operated when the space 31 is prepared. The state of the interior of the cap at that time is shown in FIG. 41C. In other words, when the suction pump is again operated in the state shown in FIG. 41B, only the ink in the cap 117 is sucked through the tube 27 as shown in FIG. 41C because the cap is in a leaking state (released). Thus the porous ink absorbent 20 provided in the cap 117 is restored to a state capable of sucking ink. Also, in the state shown in FIG. 41C, the porous ink absorbent 20 is closely positioned to the discharge port surface 21, most of all the ink on the discharge port formation surface 21 is absorbed by the ink absorbent 20. The ink thus absorbed into the ink absorbent 20 is also sucked through the tube 27.

At this juncture, the carriage is returned to the original position. In other words, the carriage is returned to the positions shown in FIGS. 41A and 42A sot than the ink absorbent 20 which has regained its ink absorbing capability sufficiently is in the state that it approaches closely the entire area of the discharge port formation surface 21. In this way, it is possible to reduce more the ink remains on the discharge port formation surface 21.

By the recovery operation, the ink remains on the discharge port formation surface are reduced; thus making it possible to prevent the color mixture from being created.

In order to provide the space 31, the carriage is shifted in the main scanning direction in the above-mentioned embodiment, but it may be possible to shift it in the sub-scanning direction. Further, to provide the space 31, the structure may be arranged to shift the cap side vertically, horizontally, forward or backward, diagonally or the like instead of shifting the carriage.

With the structure described above, it is possible to eliminate the phenomenon that ink remains on the discharge port formation surface without providing any air releasing valve.

FIGS. 44A to 44D are schematically cross-sectional views of a cap unit for illustrating another example of suction operation.

Figure 44A:
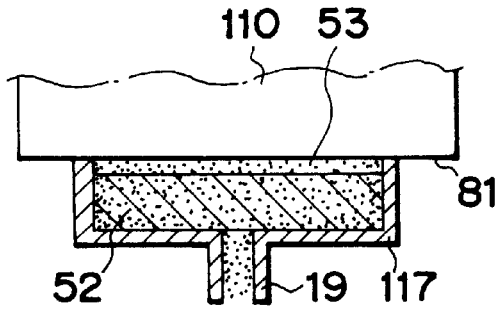
FIGS. 44A to 44D are views illustrating another example of the detaching operation of the above-mentioned cap.
Figure 44A:
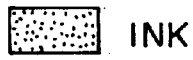

In FIGS. 44A to 44D, a porous ink absorbent 52 is arranged in the interior of each cap 117. The capacity of the ink absorbent 52 is set at a value greater than the suction amount (the amount of forcibly exhausted ink per operation) of the suction pump, or at a value greater than the volume of the ink passages in the ink jet units. Then the foregoing ink absorbent 52 is arranged so that it is positioned in the vicinity of the discharge port formation surface 81 at the time of capping as shown in FIG. 44A. In this respect, a portion at 53 in FIGS. 44A to 44D indicates the ink which has been absorbed (sucked) from the discharge ports.

Figure 44B:
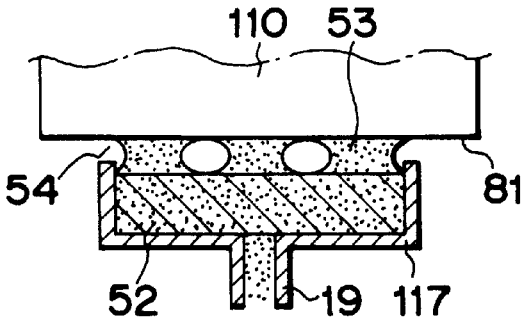

FIG. 44A illustrates a state that a suction pump is operated while the cap 117 closely abuts on the discharge port formation surface 81, and a negative pressure is created in the cap 117 through a tube 19, thus ink 52 is being sucked from each of the discharge ports. After that, at a given timing, the recording head and the cap 117 are separated as shown in FIG. 44B. Then a space 54 is formed between them. As a timing at which to separate the recording head and cap 117, the time when the negative pressure is almost released by the suction of a given amount of ink with the operation is the suction pump being suspended, or the time when a given amount of ink has been sucked even in a state that the negative pressure is still active in the cap 117, is selected among others. In this respect, the ink sucked from the recording head by the suction pump is being transferred to a waste ink, tank (not shown) through a tube or ink passages. The waste ink tank may be structured by a porous ink absorbent which absorbs and holds the waste ink.

Figure 44C:
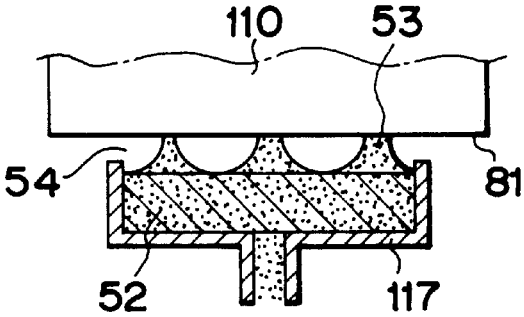
Figure 44D:
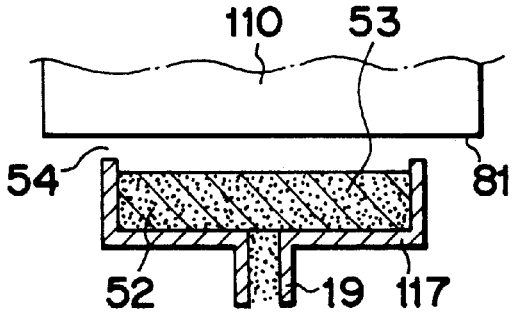
Figure 45:
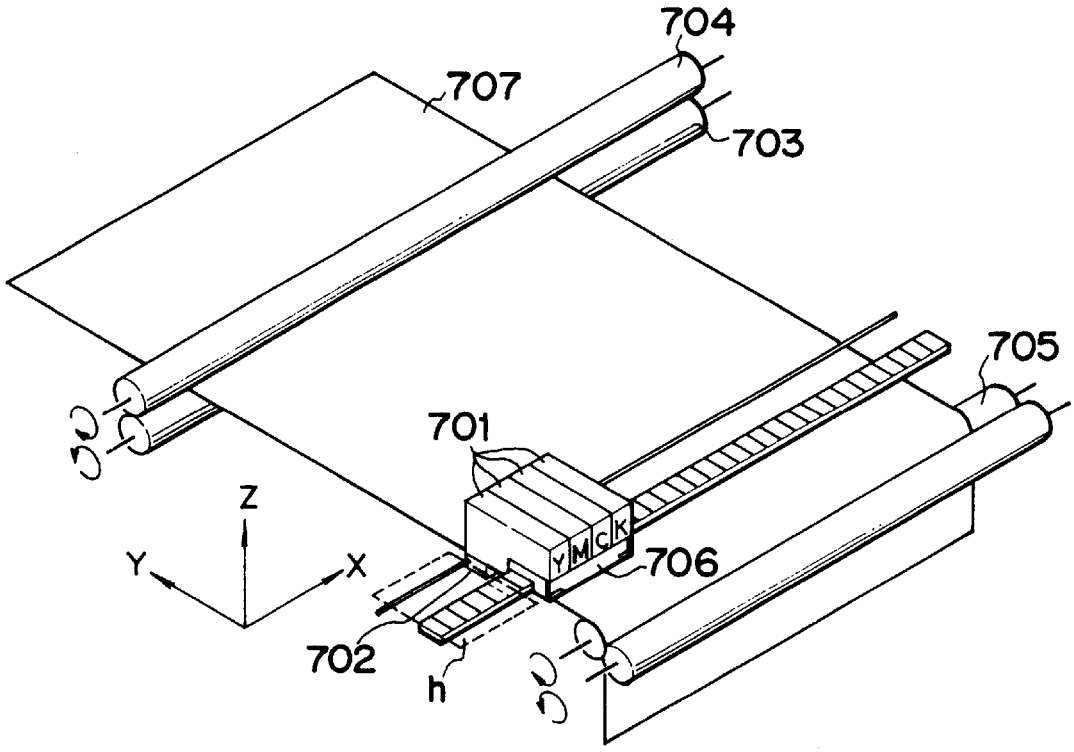
FIG. 45 is a view showing an ink jet printer to which the present invention is applicable.

In FIGS. 44A to 44D, the volume of the porous ink absorbent 52 is set, as described earlier, at a value greater than the amount of suction (the amount of forcibly exhausted ink per one operation) or at a value greater than the volume in the ink passages in the recording head. As a result, the ink 53 between the discharge port formation surface 81 and the cap 117 is carried to the aforesaid ink absorbent 52 side by the suction force exerted by the ink absorbent 52 as shown in FIG. 44C. Consequently, as shown in FIG. 44D, it is possible to complete the suction recovery operation in a state that no ink remains on the discharge port formation surface 81 of the recording head. In this way, it is possible to prevent ink of different colors from being mixed because the suction recovery operation terminates in the state that no ink remains on the discharge port formation surface 81.

Also, by filling the porous ink absorbent 52 in the cap, it is possible to provide a directionality (direction toward the suction pump side from the discharge port surface 81) for the ink flow in the cap 117 when sucked. Thus it is possible to prevent ink of different colors from being mixed, which occurs otherwise if the ink adhering to the discharge port formation surface 81 should be allowed to flow into the discharge ports.

As clear from the above-mentioned description, it is possible to provide a plurality of discharge port arrays to discharge ink each having different kinds, such as densities and colors, by integrally dividing them in the direction which differs from the traveling direction of the recording head; hence enabling the recording head itself and the mechanism required for its travel to be miniaturized.

Also, the area recordable by one scanning is divided, and further, the pixels in the divided areas are recorded by the divided recording with the plural numbers of scanning. In this case, it is possible to make the order to superpose the ink each having the different kinds as mentioned above to be equal at all times for the recording head by the arrangement of the aforesaid plural discharge port arrays for the recording head.

With the structure according to the present invention as described in the above-mentioned embodiment, it is possible to make the apparatus smaller among other, and at the same time, to record an image for which the color unevenness, and dark and light unevenness are reduced in recording it in colors.

Ninth Embodiment

Hereinafter, the description will be made of a ninth embodiment in detail.

The structure of ink jet units (recording head) used for the present embodiment is the same as the structure shown earlier in FIG. 19.

Also, the perspective view of the grooved ceiling board 54 of the ink jet units observed from the heater board 121 is the same as the view shown earlier in FIG. 20. The above-mentioned structure of the head unit has already been described. Therefore, the description thereof will be omitted.

The structures of the color ink jet recording apparatus and the image processing unit are also the same as those of the embodiment described earlier.

The printing state of the present embodiment will be shown hereunder. In the present embodiment, the divided recording method such as described earlier is not adopted. It is always set so that a recording area is recorded 100% by a dark ink having a high image density in the forward scan, and then, after its completion, the recording area is recorded 100% by a light ink having a low image density in the backward scan without executing any sheet feeding scan. In all the image areas, a printing is executed in the forward scan in the dark ink of black→cyan→magenta→yellow, and in the backward scan, the printing is completed in the light ink in order of yellow→magenta→cyan→black. In principal, therefore, no density unevenness appears due to the impacting order of ink in all the colors and densities.

Figure 46:
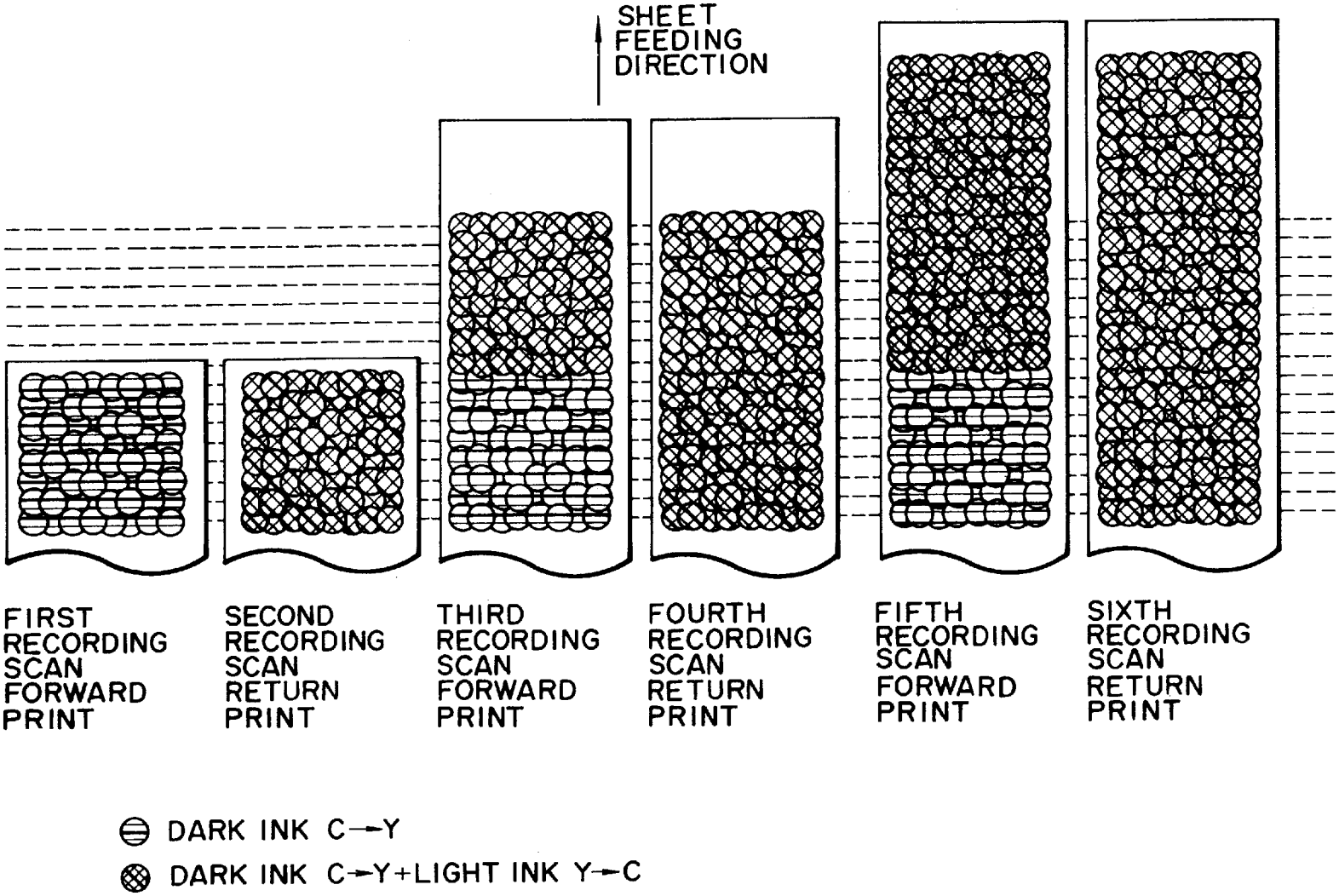
FIG. 46 and FIG. 47 are views illustrating the process of a recording according to an embodiment of the present invention.

FIG. 46 illustrates a state where a uniformly green image is being recorded in such a condition as this. The uniformly green image referred to here is an image which is recording in both dark and light ink of cyan and yellow. In FIG. 10B, the input image density signal indicates a duty from 128 to 255. However, in the following details including the present embodiment, a state is set for the sake of explanation that all the pixels are recorded by the above-mentioned four kinds of ink.

Hereinafter, in conjunction with FIG. 46, the description will be made briefly for each of the recording scans. Since a first recording scan is in the forward path, the area equivalent to the head width (eight-pixel width) is all printed by all the eight nozzles only for four dark color ink heads in the recording head shown in FIG. 7. At this juncture, in this area, ink of a high density is impacted in order of cyan and yellow. Thus a green image having a stronger cyanic coloring. Next, in a second recording scan, which is in the backward path, a recording is executed only in the light ink in order of yellow and cyan on the area already recorded in the dark ink by the first recording scan.

With the reciprocal scan described above, the recording of the image area equivalent to the head width (eight-pixel width) is completed. In this image area, the ink is impacted in order of dark ink cyan, dark ink yellow, light ink yellow, and light ink cyan. As a result, a uniform image is obtained in the priority color of the dark ink cyan in which the first recording has been made.

After a pair of reciprocal recording scans, the recording sheet is fed in the direction indicated by an arrow for a portion equivalent to a head width (eight-pixels width). Then a second image area adjacent to the above-mentioned first image area is recorded by impacting ink in the same order of dark ink cyan, dark ink yellow, light ink yellow, and light ink cyan as in the first image area thereby to obtain a uniform image in the same tonality as in the first image area also having the dark ink cyan as the priority color.

Thereafter, the recording by a pair of reciprocal scans in each image area as well as a sheet feed for an eight-nozzle width are repeated in the same manner to obtain an uniformly green image in the aforesaid image area without any density unevenness.

Here, in the present embodiment, the description has been made that the dark ink is used in the forward path and the light ink, in the backward path at all times, but in unifying the impacting order of each ink, it is still possible to obtain the same effect even if the light ink is used in the forward path and the dark ink in the backward path. In this case, each of the image areas is recorded in the same manner but by impacting the light ink cyan, light ink yellow, dark ink yellow, dark ink in that order. Then a uniformly green image is obtainable in all the image areas as in the case of the recording in the dark ink in the forward path as described earlier. However, since the light ink is used earlier for recording in this case, an image which is obtainable is lighter and smoother in the light cyan as its priority color as a whole, and also, the graininess becomes less.

In the above-mentioned two kinds of recording methods having different order of recording in the dark and light ink, there is no particular preference in order to obtain an image of a better quality, but if it is desired that the quality of character and others should be considered more important as a whole, and a sharp resolution should also be obtained, the dark ink is used for the forward path printing, and that if a smoother image should be obtained as a whole, the light ink is used for the forward path printing. In this way, an image is obtainable to match each objective can be obtained.

Now, with this in view, it may be possible to provide two recording modes in which the recording order of dark ink and light ink is arranged to differ from each other, and then, there may be provided a manual switch over mechanism or an automatic switch over mechanism functionable in response to the image to be recorded. In this case, if an automatic switch over mechanism should be employed, it is preferable to provide a mechanism capable of executing such a switch over by the application of the black printing ratio in an image to be printed or by sensing the area in which an image recording should be made.

Further, in the present embodiment, the description has been made of a case where a uniformly green image is formed, but it is possible to obtain the same effects of the present embodiment even when a monochromic color printing is executed, such as an image being formed by use of only dark and light ink in black.

According to the present embodiment as described above, it is possible to obtain an excellent uniform image without any appearance of color unevenness, and dark and light unevenness as in the conventional example by arranging the impacting order of ink for a total of eight kinds (two kinds for monochromic color) each having different colors and densities uniformly in all the image areas which are continuously arranged each by the head width (here, eight-pixel width), respectively.

Tenth Embodiment

Now, the description will be made of a tenth embodiment according to the present invention. In the present embodiment, the impacting of dark ink and light ink is regulated by the forward and backward paths, and at the same time, the divided recording method is employed therby to aim at obtaining the effects of the present invention.

The head structure used for the present embodiment is also the same as the structure shown in FIG. 7. As in the ninth embodiment, the present embodiment uses the head in which eight nozzles are arranged in one line, but, here, the divided recording method is used. Therefore, the amount of sheet feeding is half the amount provided for the first embodiment, that is, a four-pixel width.

Figure 47:
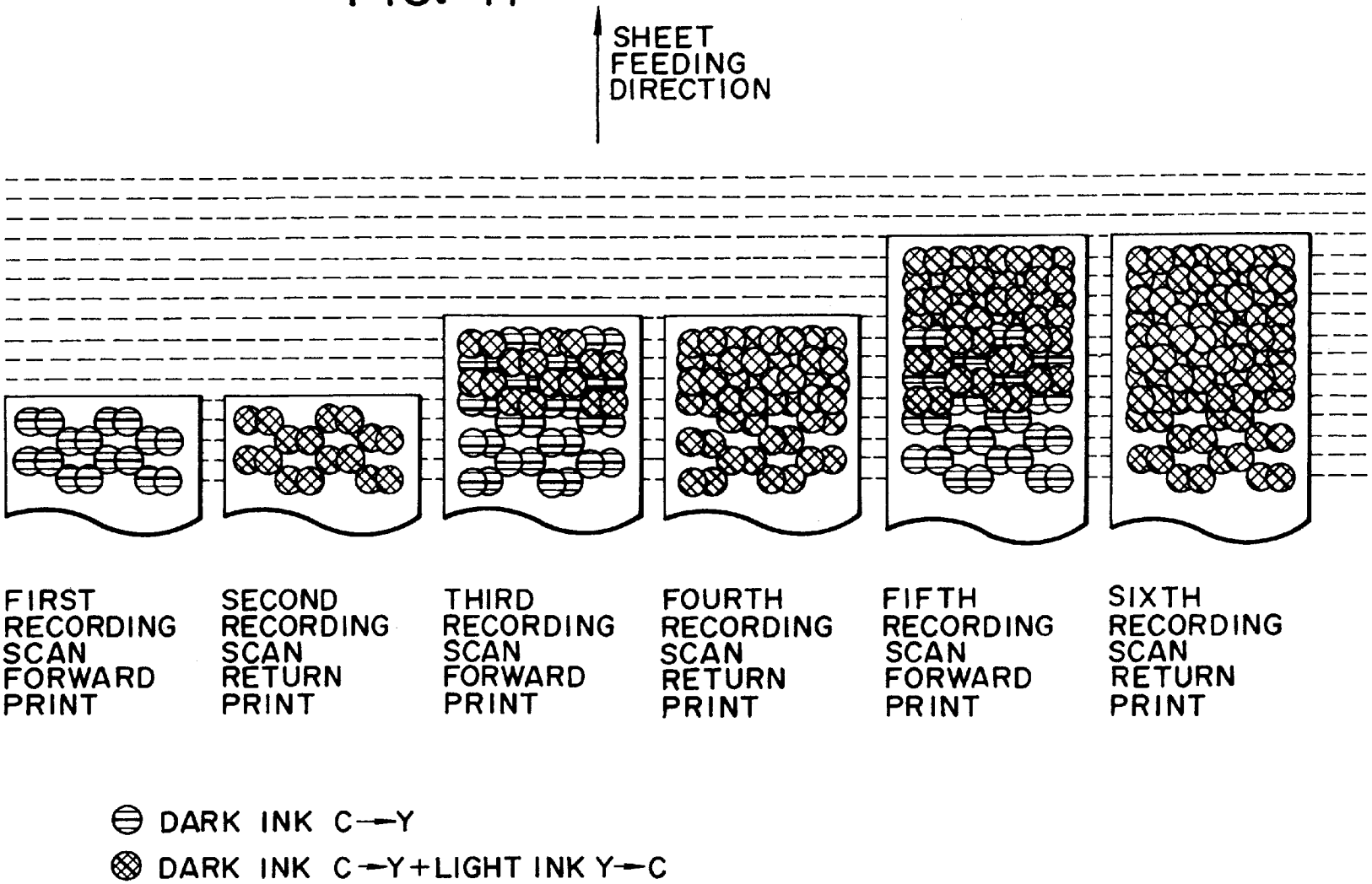

FIG. 47 illustrates the printing state of a recording executed according to the present embodiment. Here, the state that a uniformly green image is recorded in cyan and yellow is also exemplified as in the ninth embodiment.

Figure 48:
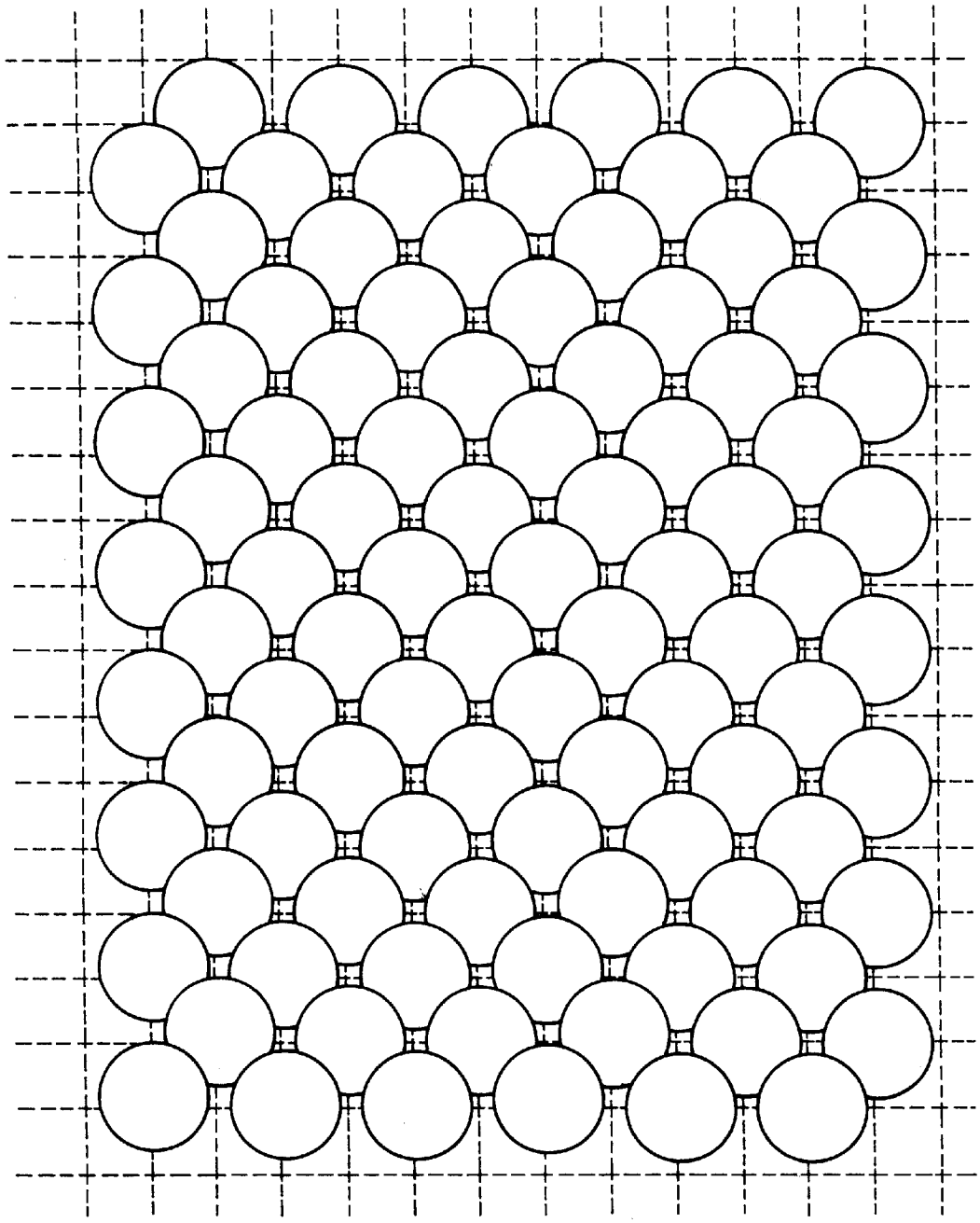
FIG. 48 is a view illustrating the state of ink permeation of recorded dots by the application of a divided recording method.

A first recording scan is in the forward direction and a 50% of all the recording pixels are recorded by use of four nozzles in the eight nozzles to discharge the dark ink for each of the colors. The image area in which the recording is executed at that time is defined as the first image area. These pixels are arranged in such a manner that the pixel group of 1×2 pixels are solidified to one, and is just arranged alternately as shown in FIG. 47. In this way, the ink permeation to the area other than the recorded pixels in each of the recording scans can be reduced more than the alternate arrangement of one pixel unit as shown in FIG. 48. As a result, the color unevenness does not occur so easily due to the impacting order of ink as already described.

In a second recording scan, no sheet feeding is executed, but for the first image area, the backward printing is executed by use of the four nozzles to discharge the light ink in the same manner as the first recording scan. The pixels to be recorded at this juncture are the same pixels which have already been recorded in the dark ink in the forward printing. In this respect, ink is impacted in order of light ink yellow and light ink cyan. On the pixels in the first image area thus recorded by the first and second scans reciprocally, ink is impacted in order of dark ink cyan→dark ink yellow→light ink yellow→light ink cyan, thus obtaining an image, for a 50% of which the dark ink cyan becomes the priority color as a whole.

Next, before a third recording scan, the sheet feeding scan is executed for half a head width (four-pixel width). Then, again in the forward path direction, a 50% recording is executed in the first image area and the second image area by use of the eight nozzles in order of dark ink cyan and dark ink yellow. At this juncture, in the first image area where the 50% recording has already been executed by the first and second recording scans, the remaining 50% pixels are recorded by the nozzles different from those used in the first recording scan.

Next, in a fourth recording scan, no sheet feeding is executed, but again in the backward path direction, the pixels which already record ed in the dark ink in the forward path are recorded in order of light ink yellow and light ink cyan.

When the fourth recording scan is completed, the recording for the first image area all completed. Now, in the first image area, the recording order of the first to fourth recording scans are reviewed. Then, for all the pixels, ink droplets are impacted on the surface of a recording sheet in order of dark ink cyan→dark ink yellow→light ink yellow→light ink cyan→dark ink cyan→dark ink yellow→light ink yellow→light ink cyan. Accordingly, even in a state that the divided recording is executed by the reciprocal printing, it is regulated in the present embodiment that the dark ink is used only in the forward path, and only the light ink, in the backward path. As a result, ink is impacted in the identical impacting order for all the pixels; hence making it possible to obtain in the entire image areas a green image in a strong cyanic coloring having the dark ink cyan as its priority color which is brought about by the ink color in which the first recording is executed.

Next, in a fifth and sixth recording scans, the recording is executed in the second and third image areas in the same manner as the third and fourth recording scans, and then, the green image having the dark ink cyan as its priority color is obtained in the second-image area, which is identical to the image obtained in the first image area.

In this way, by the recording scans executed one after another, the image area arrives at the state where it is completed. Thus the all image areas are recorded by the identical impacting order of ink, and the dark ink cyan becomes the priority color. As a result, the entire image obtainable is also uniform and smooth.

Here, in the present embodiment, too, it may be possible to invert the recording order in using the dark ink and the light ink by the forward printing and the backward printing. As in the ninth embodiment, it is possible to obtain the images each having its characteristic properties by executing a recording by use of the dark ink in the forward path and the light ink in the backward path or by use of the light ink in the forward path and the dark ink in the backward path.

Also, it may be possible to arrange the provision of recording modes in which the impacting orders of ink are arranged to differ from each other together with a structure which makes such modes appropriately switchable.

As described above, according to the present invention, it is possible to obtain an excellent image without any unevenness due to the impacting order of ink having a high image density (dark) and ink having a low image density (light).

Other Embodiment

The present invention produces an excellent effect on a recording apparatus using an ink jet recording method, particularly the one in which the flying droplets are formed by utilizing thermal energy for recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, it is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as, disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharging ports.

In addition, the present invention is effectively applicable to a replaceable chip type recording head which is electrically connected to the main apparatus and for which the ink is supplied when it is mounted in the main assemble; or to a cartridge type recording head having an ink tank integrally provided for the head itself.

Also, it is preferable to additionally provide the recording head recovery means, preliminarily auxiliary means, and the like for the recording head because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also contributable to executing a stabilized recording that the preliminary discharge mode is adopted aside from the regular discharging for recording.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given.

In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Laid-Open application No. 54-56847 or 60-71260 in order to enable the ink to face the electrothermal transducers. In the present invention, the most effective method for the various kinds of ink mentioned above is the one capable of implementing the film boiling method as described above.

Further, as the mode of the recording apparatus according to the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

Figure 49:
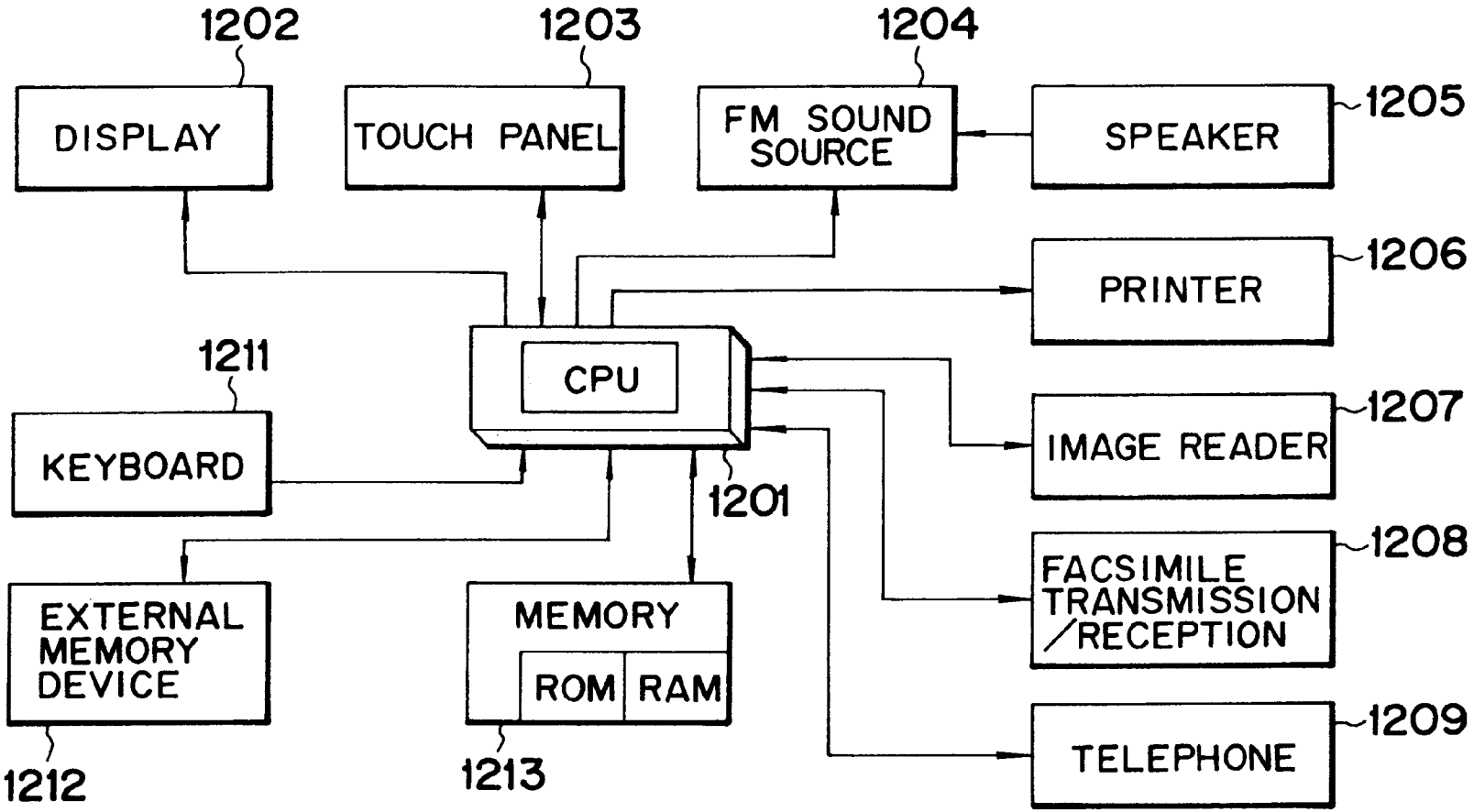
FIG. 49 is a block diagram schematically illustrating the structure in which a recording apparatus to which the present invention is applicable is installed in an information processing apparatus.

FIG. 49 is a block diagram schematically showing the structure of a recording apparatus according to the present invention in which the apparatus is applicable to an information processing apparatus having functions as a word processor, a personal computer, a facsimile apparatus, and a copying apparatus. In FIG. 49, a reference numeral 1201 designates a control unit provided with a CPU such as a microprocessor, and various I/O ports to control the entire system of the apparatus by outputting control signals, data signals, and others to each unit and receiving control signals and data signals from each unit; 1202, a display unit on the screen of which various menus, documentary information, image data read by an image reader 1207, and others are displayed; and 1203, a pressure sensitive transparent touch panel arranged on the display unit 1202 which enables items, coordinate positions, and others indicated on the display unit 1202 to be inputted when its surface is depressed by a finger or the like as required.

A reference numeral 1204 designates an FM (Frequency Modulation) sound source which stores the music information created by a music editor or the like in a memory 1210 and/or an external memory device 1212 as digital data, and reads them from the memory and others to perform an FM modulation. The electrical signals from the FM sound source 1204 are transduced into the audible sounds by a speaker unit 1205. A printer unit 1206 is the apparatus to which the present invention is applicable as an output terminal for a word processor, personal computer, facsimile apparatus, and copying apparatus.

A reference numeral 1207 designates an image reader which is arranged on the feeding path of source documents in order to photoelectrically read the data on source documents for facsimile and copying operations in addition to reading various other source documents; 1208, a facsimile transmission and reception unit which performs the facsimile transmission of the data on the source document read by the image reader 1207, and receives the transmitted facsimile signals for demodulation, and which also has a function to interface with the external devices; 1209, a telephone unit which has various functions to serve as an ordinary telephone and as a device to automatically take, and record messages among others; and 1210, a memory unit including the ROM which stores a system program, manager program, and other application programs as well as character fonts, dictionaries, and others, the RAM which stores the application program and text information loaded from the external memory device 1212, and a video RAM among others.

Figure 50:
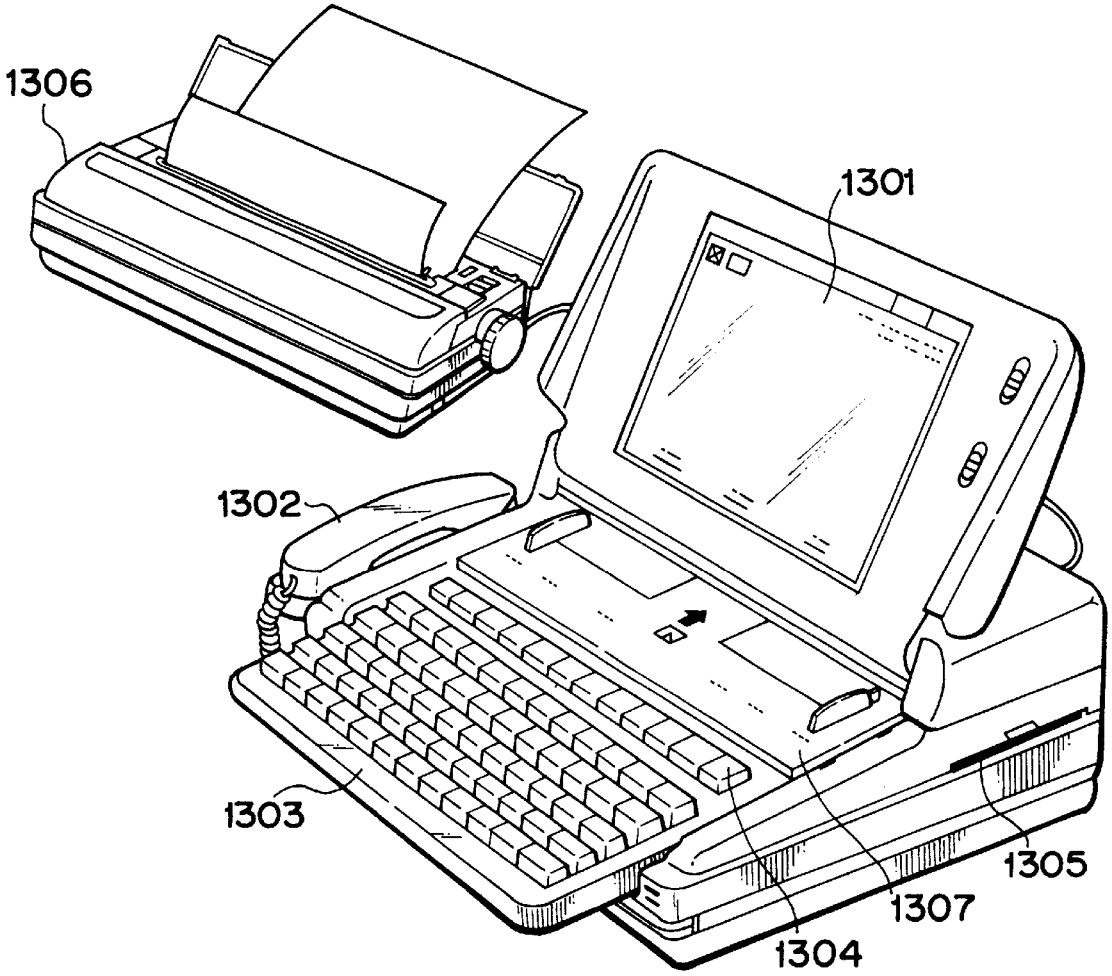
FIGS. 50 and 51 are views showing the external appearance of the information processing apparatus shown in FIG. 49.

A reference numeral 1211 designates a keyboard unit which enables text information and various commands to be inputted; 1212, an external memory device using a floppy disk, hard disk, and the like as its storing medium, and in this external memory device 1212, text information, music, or voice information, and user's application program and others are stored. FIG. 50 is a view views illustrating the external appearance of the information processing apparatus shown in FIG. 49. In FIG. 50, a reference numeral 1301 designates a flat panel display which utilizes liquid crystal and others to display various menus, graphic information, and text information, and enables the coordinates and specific items to be inputted by depressing the surface of the touch panel arranged on this display 1301 by a finger or the like as required; and 1302, a hand set which is used when the apparatus functions as a telephone unit.

The keyboard 1303 is detachably connected to the main body through a cord, through which various text information and various data can be inputted. Also, the keyboard 1303 is provided with various functional keys 1304 and others; and 1305, an insertion inlet for a floppy disk.

A reference numeral 1306 designates a sheet stacker in which the source documents are stacked for the image reader 1207 to read, and the source document thus read are exhausted from the rear portion of the apparatus. Also, in a case of a facsimile reception, or the like, the recording is executed by an ink jet printer 1307.

In this respect, the above-mentioned display 1301 may be a CRT, but it i s desirable to use a flat panel such as a liquid crystal display using a ferroelectric liquid crystal because with such a display, it is possible to implement the miniaturization of the apparatus and also make it light. When the above-mentioned image processing apparatus functions as a personal computer or a word processor, the text information inputted through the keyboard unit 1211 in FIG. 49 is processed by the control unit 1201 in accordance with a given program, and is output to the printer unit 1206 as images. When the apparatus functions as a receiver of the facsimile apparatus, the facsimile information inputted from a facsimile transmission and reception unit 1208 is received by the control unit 1201 for processing in accordance with a given program and is output to the printer unit 1206 as reception images.

Figure 51:
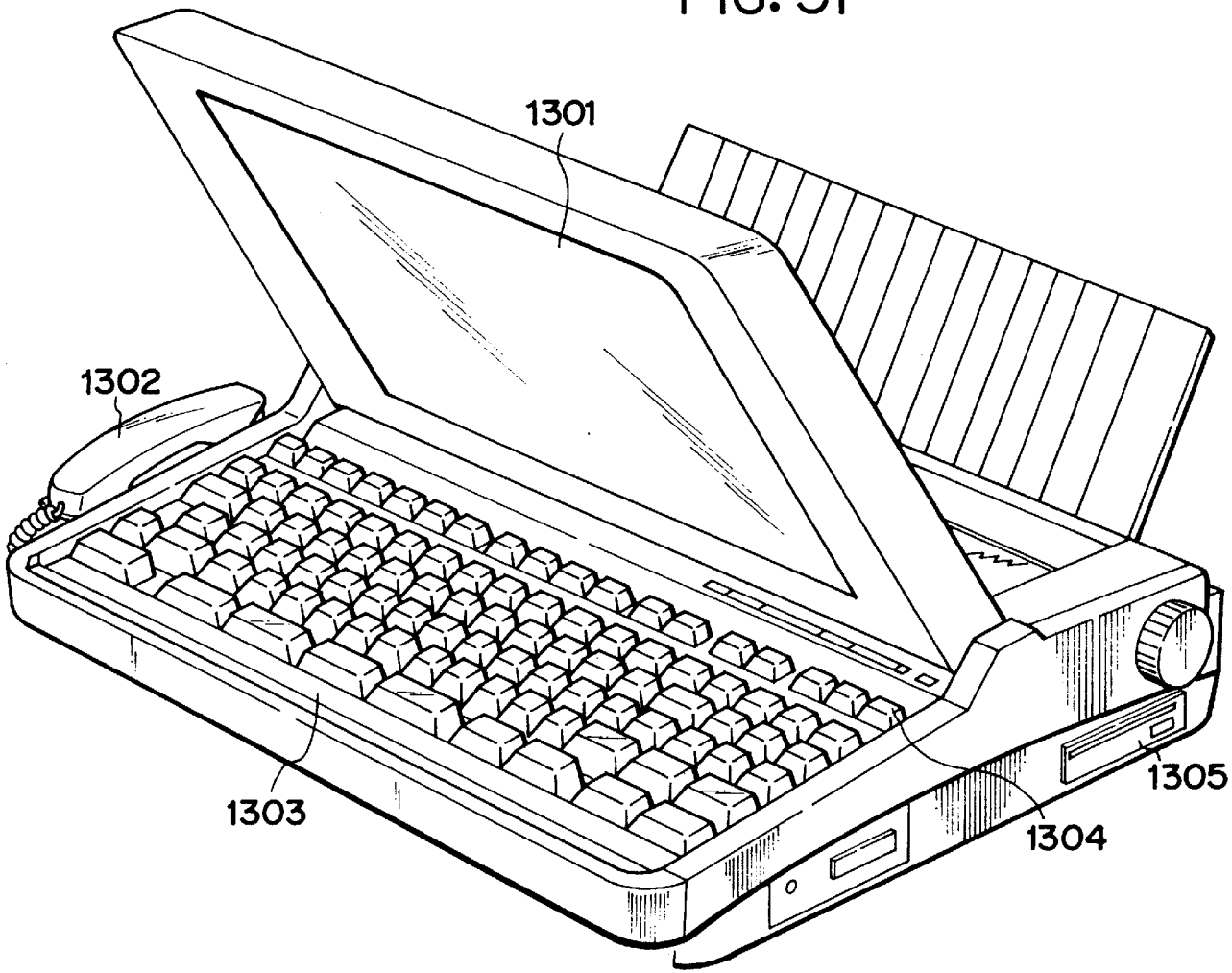

Also, when the apparatus functions as a copying apparatus, a source document is read by the image reader 1207, and the data on the source document thus read are transferred to the printer unit 1206 through the control unit 1201 and are output as copied images. In this respect, when the apparatus functions as a transmitter of the facsimile apparatus, the data on the source documents read by the image reader 1207 are processed by the control unit 1201 for transmitting in accordance with a given program, and then, transmitted to the communication line through the facsimile transmitter 1208. Here, it may be possible to arrange the above-mentioned apparatus as an integrated type in which an ink jet printer is incorporated in the main body as shown in FIG. 51. In this case, the portability will be further enhanced. In FIG. 51, the constituents having the same functions as those shown in FIG. 50 are indicated by the corresponding reference marks.

Since a high-quality recording image is obtainable by applying a recording apparatus according to the present invention to the multi-functional information processing apparatus as described above, a further enhancement of the functions of the above-mentioned information processing apparatus is possible.

What is claimed is:

1. An ink jet recording apparatus comprising:

a recording head for discharging ink, the recording head having a plurality of recording units each corresponding to inks having different colors, each of the recording units being provided with a respective discharge port formation surface having at least two discharge port arrays, each discharge port array having a plurality of discharge ports arranged such that the plurality of recording units of said recording head are arranged along a main scan direction and the plurality of discharge ports of each of the recording units are arranged in a direction different from the main scan direction, wherein the recording units corresponding to at least two colors of inks among the plurality of recording units have a plurality of discharge port arrays for discharging inks of similar colors and different densities, respectively; and a control means for controlling the movement of said recording head in the main scan direction, wherein each of the recording units also includes a plurality of inlets corresponding to a plurality of liquid chambers containing inks having similar colors and different densities, wherein each of the recording units records an area that corresponds to the area recorded by at least one other recording unit, and wherein each of the plurality of liquid chambers communicates with discharge ports of the corresponding plurality of discharge port arrays.

2. An ink jet recording apparatus according to claim 1, wherein each of the recording units has, among its plurality of discharge port arrays, a first discharge port array and a second discharge port array arranged above said first discharge port array, and wherein high density ink is discharged from said first discharge port arrays, and said second discharge port arrays discharge lower density ink.

3. An ink jet recording apparatus according to claim 1, wherein each of said plurality of discharge port arrays for discharging ink of different densities is arranged so that a part of each said discharge port array is superposed with parts of the other discharge port arrays in the direction which differs from said main scan direction.

4. An ink jet recording apparatus according to claim 1, wherein each of said plurality of discharge port arrays for discharging ink of different densities is arranged with the other discharge port arrays at given intervals in a direction which differs from said main scan direction.

5. An ink jet recording apparatus according to claim 1, further comprising:

recovery means to cover said plurality of recording units for recovering said discharge port arrays, wherein said recovery means enables said recording head and said recovery means to move correlatively at a time of operating said recovery in order to provide a space between said recording head and recovery means.

6. An ink jet recording apparatus according to claim 1, wherein said recording head includes thermal energy means for providing thermal energy to generate bubbles in the ink, and for discharging the ink on the basis of the generation of said bubbles.

7. An ink jet recording apparatus comprising:

a recording head having at least one discharge port formation surface, and having discharge ports to discharge ink, and which records by discharging ink while the recording head travels in a direction of main scan, the recording head including, as said discharge ports, a first and a second plurality of discharge port arrays, said first plurality of discharge port arrays being arranged in one said discharge port formation surface and substantially linearly along a direction different from the direction of main scan, each having a plurality of discharge ports for discharging inks of similar colors and different densities, respectively, said second plurality of discharge port arrays being arranged in one said discharge port formation surface and substantially linearly along the direction different from the direction of main scan for discharging inks of similar colors and different densities, respectively, and said first and second pluralities of discharge port arrays being arranged in the direction of main scan according to ink color; and control means for controlling recording such that a plurality of pixels in an area recordable per main scan are thinned by said recording head in accordance with thinning patterns which are in a complementary relationship with each other, and the image thus thinned is recorded by scanning said recording head a plurality of times in the direction of main scan, said recording head being moved a corresponding plurality of times relative to a recording medium in a direction which differs from the direction of main scan, wherein both said first discharge port arrays and said second discharge port arrays have a plurality of inlets corresponding to a plurality of inks and a plurality of liquid chambers corresponding to said plurality of inlets, and each of said plurality of liquid chambers communicates with said discharge ports of said corresponding first or second pluralities of discharge port arrays.

8. An ink jet recording apparatus according to claim 7, wherein said recording head includes thermal energy means for providing thermal energy to generate bubbles in the ink, and for discharging the ink on the basis of the generation of said bubbles.

9. An ink jet recording apparatus comprising:

a recording head having a discharge port formation surface, and having discharge ports to discharge ink, and which records by discharging ink while the recording head travels in a direction of main scan, said recording head including, as said discharge ports, a first and a second plurality of discharge port arrays, said first plurality of discharge port arrays being arranged in one said discharge port formation surface and substantially linearly along a direction different from the direction of main scan, each having a plurality of discharge ports for discharging inks of different colors, respectively, said second plurality of discharge port arrays being arranged in one said discharge port formation surface and substantially linearly in a direction different from the direction of main scan for discharging inks of different colors from each other, at least two colors of inks among the plurality of inks corresponding to different colors being ink of a density different from inks of the plurality of colors corresponding to the first plurality of discharge port arrays, said first and second pluralities of discharge port arrays being arranged in said direction of main scan according to density of ink; and control means for controlling recording such that a plurality of pixels in an area recordable per main scan are thinned by said recording head in accordance with thinning patterns which are in a complementary relationship with each other, and the image thus thinned is recorded by scanning the recording head a plurality of times in the direction of main scan, said recording head being moved a corresponding plurality of times relative to a recording medium in a direction which differs from the direction of main scan, wherein both said first discharge port arrays and said second discharge port arrays have a plurality of inlets corresponding to a plurality of inks and a plurality of liquid chambers corresponding to said plurality of inlets, and each of said plurality of liquid chambers communicates with said discharge ports of said corresponding first or second pluralities of discharge port arrays.

10. An ink jet recording apparatus according to claim 9, wherein said recording head includes thermal energy means for providing thermal energy to generate bubbles in the ink, and for discharging the ink on the basis of the generation of said bubbles.

11. A recording head to discharge inks having a plurality of different densities, comprising:

a plurality of discharge ports arranged in a direction different from a main scan direction, including a plurality of discharge port arrays provided in a plurality of discharge port groups to discharge inks of different colors, respectively, wherein the plurality of discharge port arrays discharge inks of similar colors and different densities, respectively.

12. An ink jet recording apparatus according to claim 11, wherein said recording head includes thermal energy means for providing thermal energy to generate bubbles in the ink, and for discharging the ink on the basis of the generation of said bubbles.

13. An ink jet recording apparatus, comprising:

a recording head having a discharge port formation surface having a plurality of discharge port arrays each having a plurality of discharge ports, said recording head also including a plurality of inlets corresponding to a plurality of inks having different densities and a plurality of liquid chambers corresponding to said plurality of inlets, each of said plurality of liquid chambers communicating with said discharge ports of a corresponding discharge port array, said discharge port arrays arranged in a direction different from a main scan direction and capable of discharging plural inks having similar colors and different densities, and which forms an image on a recording medium by discharging ink from the recording head during a scan of the recording head in a main scan direction and by conveying the recording head in the main scan direction and the recording medium in a direction different from the main scan direction;

reciprocal scanning means for reciprocally scanning said recording head relative to the recording medium in the main scan direction;

recording head driving means for driving said recording head during reciprocal scans by said reciprocal scanning means; and ink discharge controlling means for controlling discharge of ink to form a part of an image by discharging ink of a desired density from among the inks having different densities in a first scan by said reciprocal scanning means, and controlling discharge of ink to form a different part of the image by discharging ink of a similar color and a density which is different from said desired density in a second scan after executing a conveyance of the recording medium subsequent to said first scan, ink having a relatively high density being ejected for recording prior to ink having a relatively low density in a predetermined area on a recording medium.

14. An ink jet recording apparatus according to claim 13, wherein said recording head is capable of discharging ink of plural colors, and is capable of discharging a plurality of ink having different densities for each of the colors.

15. An ink jet recording apparatus according to claim 13, wherein said recording head includes thermal energy means for providing thermal energy to generate bubbles in the ink, and for discharging the ink on the basis of the generation of said bubbles.

16. An ink jet recording apparatus according to claim 13, further comprising:

means for performing at least one of transmitting and reading image information.

17. An ink jet recording apparatus according to claim 16, further comprising:

means for reading original images.

18. An ink jet recording method useable with a recording head for discharging plural inks having similar colors and different densities from discharge ports, the head having a discharge port formation surface having plural arrays of discharge ports arranged in a direction substantially orthogonal to a direction of main scan, and for forming an image by discharging ink to a recording medium while the recording head reciprocally scans the recording medium in a main scan direction, said method comprising the steps of:

forming a first part of an image by discharging ink of a desired color and a desired density from among the inks of similar colors and different densities in one scan of reciprocal scans;

conveying the recording medium in a direction different from the main scan direction; and forming a second part of the image by discharging ink of a density which is different from the desired density from among the inks of similar colors and different densities onto the first part of the image formed by ink of the desired density in another scan subsequent to the one scan, the ink discharged in the forming of the second part of the image being of a density lower than the density of the ink discharged in the forming of the first part of the image.

19. An ink jet recording method useable with a recording head having a plurality of discharge port arrays along a main scan direction, each discharge port array corresponding to a different color, respectively, for discharging plural inks having similar colors and different densities from discharge ports formed on a single discharge port formation surface and arranged in a direction substantially orthogonal to a direction of main scan, and for forming an image by discharging ink to a recording medium while the recording head reciprocally scans the recording medium, said method comprising the steps of:

forming a first part of an image by discharging ink of a desired color and a desired density from among the inks of similar colors and different densities in a first scan of reciprocal scans; and forming a second part of the image by discharging ink of a density which is different from the desired density from among the inks of the similar colors and different densities onto the first part of the image formed by the ink of the desired density in a second scan subsequent to said first scan, the ink discharged in the forming of the second part of the image being of a density lower than the density of the ink discharged in the forming of the first part of the image.

* * * * *

UNITED STATES PATENT AND TRADEMARK OFFICE

CERTIFICATE OF CORRECTION

PATENT NO. : 6,540,327 B1
DATED : April 1, 2003
INVENTOR(S) : Yuji Akiyama et al.

It is certified that error appears in the above-identified patent and that said Letters Patent is hereby corrected as shown below:

Title page, Item [54] and Column 1, lines 2 and 3,
"A INK" should read -- INKS --; and "DESITIES" should read -- DENSITIES --.

Title page,
Item [56], References Cited, FOREIGN PATENT DOCUMENTS,

| | | | | | | |
|---|---|---|---|---|---|---|
| "JP | 54056847 | 5/1979 | -- | JP | 54-056847 | 5/1979 |
| JP | 55113573 | 9/1980 | | JP | 55-113573 | 9/1980 |
| JP | 58065666 | 4/1983 | | JP | 58-065666 | 4/1983 |
| JP | 58194541 | 11/1983 | | JP | 58-194541 | 11/1983 |
| JP | 59123670 | 7/1984 should read | | JP | 59-123670 | 7/1984 |
| JP | 59138461 | 8/1984 | | JP | 59-138461 | 8/1984 |
| JP | 60071260 | 4/1985 | | JP | 60-071260 | 4/1985 |
| JP | 60107975 | 6/1985 | | JP | 60-107975 | 6/1985 |
| JP | 63295270 | 12/1988" | | JP | 63-295270 | 12/1988 -- |

Drawings,
Figure 8, "GROOPS" should read -- GROUPS --.

Column 3,
Line 23, "to. the" should read -- to the --.

Column 4,
Line 17, "over all" should read -- overall --.

Column 5,
Line 61, "cross wise" should read -- cross-wise --.

Column 6,
Line 60, "they" should read -- the --.

Column 7,
Line 31, "recording" should read -- recorded --.

Column 9,
Line 6, "imagea" should read -- image --.

Column 11,
Line 3, "effects-of" should read -- effects of --.

Column 13,
Line 22, "having-different" should read -- having different --.

UNITED STATES PATENT AND TRADEMARK OFFICE

CERTIFICATE OF CORRECTION

PATENT NO. : 6,540,327 B1
DATED : April 1, 2003
INVENTOR(S) : Yuji Akiyama et al.

It is certified that error appears in the above-identified patent and that said Letters Patent is hereby corrected as shown below:

Column 16,
Line 18, "read," should read -- red, --; and
Line 43, "proprotionally" should read -- proportionately --.

Column 21,
Line 64, "in" should be deleted; and
Line 65, "counter-cross wise." should read -- counter-cross-wise. --.

Column 24,
Line 65, "an." should read -- an --.

Column 25,
Line 55, "in" should be deleted; and
Line 56, "counter-cross wise." should read -- counter-cross-wise. --.

Column 26,
Line 27, "color ink" should read -- the color inks --;
Line 59, "there" should read -- and there --; and
Line 67, "counter-cross wise." should read -- counter-cross-wise. --.

Column 27,
Line 2, "counter-cross wise" should read -- counter-cross-wise, --.

Column 28,
Line 21, "counter-cross wise" should read -- counter-cross-wise, --; and
Line 55, "port ion," should read -- portion, --.

Column 29,
Line 18, "enter" should read -- entire --;
Line 26, "compete" should read -- complete --; and
Line 63, "ink so much." should read -- so much ink. --.

Column 31,
Line 3, "area-where" should read -- area where --; and
Line 29, "having-the" should read -- having the --.

Column 33,
Line 19, "image;" should read -- image, --.

Column 34,
Line 62, "sheet.is" should read -- sheet is --.

UNITED STATES PATENT AND TRADEMARK OFFICE

CERTIFICATE OF CORRECTION

PATENT NO. : 6,540,327 B1
DATED : April 1, 2003
INVENTOR(S) : Yuji Akiyama et al.

It is certified that error appears in the above-identified patent and that said Letters Patent is hereby corrected as shown below:

Column 35,
Line 44, "arrears" should read -- appears --.

Column 36,
Line 26, "arrange" should read -- arranged --; and
Line 30, "each other." should be deleted.

Column 38,
Line 48, "sot than" should read -- so that --.

Column 40,
Line 39, "principal," should read -- principle, --.

Column 41,
Line 42, "is" should be deleted.

Column 42,
Line 61, "record ed" should read -- recorded --; and
Line 65, "area" should read -- area is --.

Column 43,
Line 9, "pixels;" should read -- pixels, --; and
Line 18, "second-image" should read -- second image --.

Column 46,
Line 6, "views" should be deleted; and
Line 29, "i s" should read -- is --.

Signed and Sealed this

Sixteenth Day of March, 2004

JON W. DUDAS
*Acting Director of the United States Patent and Trademark Office*